US012757970B2

(12) United States Patent
Xu

(10) Patent No.: US 12,757,970 B2
(45) Date of Patent: Oct. 13, 2026

(54) DETACHABLE SHOE COVER AND DISPENSER APPARATUS THEREFOR

(71) Applicant: Liang Jie Xu, HanChuan (CN)

(72) Inventor: Liang Jie Xu, HanChuan (CN)

( * ) Notice: Subject to any disclaimer, the term of this patent is extended or adjusted under 35 U.S.C. 154(b) by 0 days.

(21) Appl. No.: 19/001,761

(22) Filed: Dec. 26, 2024

(65) Prior Publication Data

US 2026/0114543 A1 Apr. 30, 2026

Related U.S. Application Data

(63) Continuation of application No. 18/126,967, filed on Mar. 27, 2023, now Pat. No. 12,290,138, which is a continuation-in-part of application No. 18/108,608, filed on Feb. 11, 2023, now abandoned.

(51) Int. Cl.
*A43B 3/16* (2022.01)

(52) U.S. Cl.
CPC ..... *A43B 3/16* (2013.01)

(58) Field of Classification Search
CPC .. A43B 3/16; A43B 3/163; A43B 3/18; A43B 5/18
See application file for complete search history.

(56) References Cited

U.S. PATENT DOCUMENTS 1,537,778 A * 5/1925 Nyhagen ..... A43B 3/16 36/8.1
3,040,451 A * 6/1962 Hilkemeyer ..... A43B 5/18 36/11
3,399,470 A * 9/1968 Schofield ..... A43B 3/16 36/7.1 R
4,265,032 A * 5/1981 Levine ..... A43B 23/027 36/3 R
6,219,938 B1 * 4/2001 Anderson ..... A43B 3/163 36/7.1 R
6,339,888 B1 * 1/2002 Brunson ..... A43B 3/163 36/7.1 R
6,666,479 B1 * 12/2003 Maddaleni ..... A63C 3/12 280/825
6,990,755 B2 * 1/2006 Hatfield ..... A43B 13/16 36/97
2006/0086002 A1 * 4/2006 Vickers ..... A43B 7/12 36/7.1 R
2010/0325918 A1 * 12/2010 Johnson ..... A43B 23/042 36/102
2016/0107823 A1 * 4/2016 Xu ..... A43B 3/163 221/33
2017/0360145 A1 * 12/2017 Hauser ..... A43B 3/0078
2022/0160071 A1 * 5/2022 Hill ..... A47G 25/908

FOREIGN PATENT DOCUMENTS

WO WO-2022051697 A1 * 3/2022 ..... A43B 3/16

* cited by examiner

*Primary Examiner* — Ted Kavanaugh
(74) *Attorney, Agent, or Firm* — David & Raymond Patent Firm; Raymond Y Chan

(57) ABSTRACT

A detachable shoe cover includes a shoe cover main body having a receiving cavity, an elastic opening edge portion defining an opening provided around a top edge portion of the shoe cover main body, and an interconnection arrangement for interconnecting a plurality of the detachable shoe covers to be installed in a dispenser apparatus. The interconnection arrangement includes a front portion of the shoe cover main body, a rear portion of the shoe cover main body, two front joint perforations provided in the front portion, and two rear joint perforations provided in the rear portion.

11 Claims, 38 Drawing Sheets

DETACHABLE SHOE COVER AND DISPENSER APPARATUS THEREFOR

CROSS REFERENCE OF RELATED APPLICATION

This application is a related application of a non-provisional application, application Ser. No. 14/515,544, filed Oct. 16, 2024, now patent number U.S. Pat. No. 9,771,207. This application is a Continuation application that claims the benefit of priority under 35U.S.C. § 120 to a non-provisional application, application Ser. No. 18/126,967, filed Mar. 27, 2023, now patent number U.S. Pat. No. 12,290,138, which is a Continuation-In-Part application that claims the benefit of priority under 35U.S.C. § 120 to a non-provisional application, application Ser. No. 18/108,608, filed Feb. 11, 2023, now abandoned, which are incorporated herewith by references in their entireties.

BACKGROUND OF THE PRESENT INVENTION

Field of Invention

The present invention relates to shoe cover and dispenser apparatus therefor, and more particularly to a dispenser apparatus for detachable shoe covers and a method of dispensing detachable shoe cover by the dispenser apparatus, wherein the dispenser apparatus and the shoe covers being stored and dispensed by the dispenser apparatus are configured to allow each of the shoe covers being easily and conveniently detached from the dispenser apparatus without detorting and causing damage to the shoe cover in a safe and reliable manner.

Description of Related Arts

With the development of science and technology, the manufacturing of some products must be completed in a dust-free workshop. Therefore, people must wear dust-free clothing and clean disposable shoe covers before entering the dust-free workshop to avoid any pollution to the dust-free workshop. Besides, shoe cover assembly and shoe cover dispenser apparatus are widely used in furniture, factories, model houses, hospitals, dust-free workshops and other places that require environmental cleanliness.

Traditional shoe cover dispensers are complicated and difficult in operation. During the wearing of some shoe covers, user is required to manually pull the shoe covers out which is inconvenient for wearing the shoe covers. U.S. Pat. Nos. 9,764,889, 9,771,207, 9,834,368, and 11,478,098, invented by the inventor of the present invention, disclose shoe cover dispenser devices which are convenient for people to wear the shoe covers, facilitate the integration storage of multiple pairs of shoe covers and automatically open the shoe cover in turn for wearing.

In order to allow the perforations of each shoe cover passing from the upper portions to the end portions of the installation arms of the dispenser machine, the first end portions of the installation arms are respectively locked by the first locking member and then the second end portions of the installation arms can be free end portions and are released from the second locking member and removed from the second end portions, so that the plurality of shoe covers can be ready for dispensing from the second end portions of the installation arms. Nevertheless, the first and second locking members of the locking assembly have to be configured as simple as possible in a reliable manner and the installation of the first and second locking members by the user must be precise and rigid to ensure smooth dispensing operation. Accordingly, it will be a desired innovative improvement to configure the dispenser machine to be capable of smoothly dispensing shoe covers without the relatively complicated locking and releasing operation of the locking assembly.

The dispenser machines as disclosed in the above related patents require each row of two front perforation portions of a rear shoe cover passes through a row of two rear joint perforations of an adjacent front shoe cover to expose the row of two front joint perforations that allows each of the connecting rods to pass through the front joint perforations, so that a plurality of the shoe covers are connected and joined by the two connecting rods in series. It is a good arrangement since the installation of the shoe covers on the two connecting rods only requires the two connecting rods to pass through the row of the rear joint perforations. However, during the shoe cover is being pulled out by a pulling force, the interconnecting of the shoe covers with respect to the locking assembly may become holding on the installation arms tighter and tighter and produce resistance for the shoe covers to move along the installation arms. Therefore, occasionally, when one shoe cover is not run smoothly on the installation arms without any resistance to be removed from the installation arms, or even being pulled to be broken, the user has to halt the dispenser machine to remove the stuck or broken shoe cover and reset the dispenser machine to function.

SUMMARY OF THE PRESENT INVENTION

The invention is advantageous in that it provides a dispenser apparatus for detachable shoe covers which installation arms are rigidly mounted to the frame without locking assembly while allowing the shoe covers smoothly moving along the installation arms for dispensing.

Another advantage of the invention is to provide a dispenser apparatus for detachable shoe covers which installation arms are configured to provide a dispenser arrangement without a requirement of the locking assembly while smoothly guiding the dispensing shoe cover to an open state for wearing.

Another advantage of the invention is to provide a method of dispensing detachable shoe covers which allows the shoe covers to be installed in series along the installation arms, feeding smoothly and be dispensing one by one without complicated locking and releasing mechanism and the hazard of being stuck or broken during the dispensing operation.

Another advantage of the invention is to provide a detachable shoe cover which is configured to be installed in series along the installation arms of a dispenser apparatus, such for feeding smoothly and be dispensing one by one without complicated locking and releasing mechanism and the hazard of being stuck or broken during the dispensing operation.

Another advantage of the invention is to provide a dispenser apparatus for detachable shoe covers and method thereof, which is convenient to install a plurality of the shoe covers thereon, so as to reduce the difficulty of installing shoe covers.

Another advantage of the invention is to provide a detachable shoe cover which is convenient to be installed on the dispenser apparatus so as to reduce the difficulty of installing the shoe covers.

Another advantage of the invention is to provide a dispenser apparatus designed for collaborating with detachable shoe covers which are interconnecting with each other while installing in the dispenser apparatus and each of which is configured to be detached from the dispenser apparatus by simply pulling out after being worn on the shoe of the user Another advantage of the invention is to provide a detachable shoe cover which is designed for collaborating with the dispenser apparatus and configured to be interconnecting with each other while installing in the dispenser apparatus and to be detached from the dispenser apparatus by simply pulling out after being worn on the shoe of the user.

Another advantage of the invention is to provide a dispenser apparatus for detachable shoe covers and method thereof, which can ensure that after one shoe cover is detached, the subsequent shoe cover will not retract and be operated to the open state for being ready to be worn on the user's shoe.

Another advantage of the invention is to provide a detachable shoe cover which is configured that after one shoe cover is detached, the subsequent shoe cover will not retract and be operated to the open state for being ready to be worn on the user's shoe.

Another advantage of the invention is to provide a detachable shoe cover and a dispenser apparatus therefor, wherein a configuration of each shoe cover is able to be detached from installation arms and the subsequent shoe cover simply by pulling towards a direction from the subsequent shoe cover, or by separating from the subsequent shoe cover by a separator arranged at the end portions of the installation arms.

Another advantage of the invention is to provide a dispenser apparatus for detachable shoe covers and method thereof, wherein the dispenser apparatus is configured to be adapted for dispensing various embodying detachable shoe covers each of which is interconnecting with each other through a detachable interconnection arrangement that allows the shoe cover being detached from the adjacent shoe cover while maintaining the elastic configuration for wearing and holding the shoe cover to cover the user's shoe.

Additional advantages and features of the invention will become apparent from the description which follows and may be realized by means of the instrumentalities and combinations particular point out in the appended claims.

According to the present invention, the foregoing and other objects and advantages are attained by a dispenser apparatus for a plurality of detachable shoe covers each of which comprises a shoe cover main body having a receiving cavity, an elastic opening edge portion defining an opening, and an interconnection arrangement for interconnecting each of the detachable shoe covers with another adjacent detachable shoe cover of the detachable shoe covers to be installed in the dispenser apparatus, wherein the dispenser apparatus comprises:

a frame;

an installation assembly, which is installed on the frame, comprising two installation arms for installing the detachable shoe covers, wherein the two installation arms are configured to provide a dispenser arrangement at front end portions of the installation arms for guiding a frontmost detachable shoe cover of the detachable shoe covers installed in the installation assembly to be dispensed to an open state for wearing; and a separator arranged at the front end portions of the installation arms for separating the frontmost detachable shoe cover from the installation arms after being worn on a shoe of a user.

In one embodiment, the end portions of the two installation arms are stationary mounted to the frame for steady and smooth guiding of the frontmost detachable shoe cover to open the opening of the receiving cavity thereof and providing a firm support of the frontmost detachable shoe cover for the user to place his or her shoe in the receiving cavity.

In one embodiment, the detachable shoe cover can be broken away from the installation assembly while moving frontwards away from the installation assembly, such that the dispensing operation for the user is as simple as "step in" and "move out".

In one embodiment, the connectors for mounting the front end portions of the installation arms of the installation assembly to the frame are configured to be functioned as the separator to separate the interconnection of the detachable shoe cover with the installation assembly and the subsequent detachable shoe cover.

In one embodiment, the detachable shoe covers of the shoe cover assembly are interconnected with each other in the installation one by one along the two installation arms. The detachable shoe covers are interconnecting with each other through the interconnection arrangement with the two installation arms for being installed in the installation assembly along the installation arms.

In one embodiment, the shoe cover main body of each detachable shoe cover further provides a detachable connection arrangement at the elastic opening edge portion thereof for interconnecting with a subsequent detachable shoe cover.

In one embodiment, the shoe cover main body of each detachable shoe cover is interconnected with another detachable shoe cover by an interconnection member connected therebetween.

In accordance with another aspect of the invention, the present invention comprises a detachable shoe cover, comprising:

a shoe cover main body having a receiving cavity;

an elastic opening edge portion defining an opening provided around a top edge portion of the shoe cover main body; and an interconnection arrangement for interconnecting a plurality of the detachable shoe covers to be installed in a dispenser apparatus, wherein the interconnection arrangement includes a front portion of the shoe cover main body, a rear portion of the shoe cover main body, two front joint perforations provided in the front portion, and two rear joint perforations provided in the rear portion.

In one embodiment, the two rear joint perforations provided in the rear portion of the detachable shoe cover are configured for interconnecting each of the plurality of the detachable shoe covers with another adjacent detachable shoe cover of the plurality of detachable shoe covers along the two installation arms of the dispenser apparatus so as to be installed in the dispenser apparatus.

In one embodiment, the detachable shoe cover further comprises a ring shape elastic element provided around the opening edge of the elastic opening edge portion to provide an elastic effect for being stretched to open the opening for wearing on a shoe of a user and to retracted to reduce a size of the opening for holding on the shoe of the user.

In one embodiment, the two rear interconnection members are two rear joint perforations so that there are two front joint perforations and two rear joint perforations formed below the elastic element.

In one embodiment, the detachable shoe cover comprises an elastic element provided around an opening edge of the elastic opening edge portion to provide an elastic effect for being stretched to open the opening for wearing on a shoe of a user and to retracted to reduce a size of the opening for holding on the shoe of the user.

In one embodiment, the two front joint perforations of the interconnection arrangement are another two interconnection members each of which has a joint perforation therein.

In one embodiment, the interconnection arrangement is configured by the two front joint perforations and two rear joint perforations, wherein the ring shape elastic element is formed below the front and rear joint perforations of the interconnection arrangement while the four detachable lines are respectively extended from the opening edge and the front and rear joint perforations, so that no sealing portion is required. Since the elastic element is provided below the front and rear joint perforations, when the detachable lines are cut off to separate by the separator (or the cutter separator), the elastic element will not be cut off for wearing on the user's shoe.

In one embodiment, the ring shape elastic element provided at the opening edge of the elastic opening edge portion to provide the elastic effect for being stretched to open the opening for wearing on a shoe of a user and to retracted to reduce a size of the opening for holding on the shoe of the user, such that the two installation arms of the installation assembly are directly penetrating through the front and rear joint perforations of the interconnection arrangement.

In one embodiment, the interconnection arrangement further comprises an interconnection member connecting the rear portion of the detachable shoe cover with the front portion of another subsequent detachable shoe cover, wherein a detachable line is formed across the interconnection member, so as to interconnect the plurality of detachable shoe covers one-by-one in series while installed in the installation assembly by penetrating the two installation arms through the front and rear joint perforations of the detachable shoe covers.

In one embodiment, the plurality of detachable shoe covers installed in the installation arrangement of the installation assembly is stacked one-by-one in series along the two installation arms of the installation assembly to maximize the storage capacity of the detachable shoe covers.

In one embodiment, the detachable shoe cover further comprises two rear connecting strips each having two ends affixed to the rear portion of the shoe cover main body to form a loop shape configuration, wherein the two rear connecting strips are affixed to two sides of the rear portion of the shoe cover main body respectively in a symmetrical manner to define the two rear joint perforations of the interconnection arrangement through symmetrically. Two connecting holes are forms in two sides of the front portion of the shoe cover main body respectively to form the two front joint perforations respectively.

In one embodiment, both symmetrical sides of the rear portion of the shoe cover main body have two pairs of parallel slits to form the two rear connecting strips symmetrically at the two sides of the rear portion of the shoe cover main body respectively.

In one embodiment, the detachable shoe cover further comprises two front connecting strips each having two ends affixed to the front portion of the shoe cover main body to form a U shape configuration, wherein the two front connecting strips are affixed to two sides of the front portion of the shoe cover main body respectively in a symmetrical manner to define the two front joint perforations of the interconnection arrangement through symmetrically. Two connecting holes are forms in two sides of the rear portion of the shoe cover main body respectively to form the two rear joint perforations respectively.

In one embodiment, both symmetrical sides of the front portion of the shoe cover main body have two pairs of parallel slits to form the two front connecting strips symmetrically at the two sides of the front portion of the shoe cover main body respectively.

In one embodiment, the detachable shoe cover further comprises two front connecting strips each having two ends affixed to the front portion of the shoe cover main body to form U shape configuration and two rear connecting strips each having two ends affixed to the rear portion of the shoe cover main body to form U shape configuration, wherein the two rear connecting strips are affixed to two sides of the rear portion of the shoe cover main body respectively in a symmetrical manner to define the two rear joint perforations of the interconnection arrangement through symmetrically and the two front connecting strips are affixed to two sides of the front portion of the shoe cover main body respectively in a symmetrical manner to define the two front joint perforations of the interconnection arrangement through symmetrically.

In one embodiment, both symmetrical sides of the front portion of the shoe cover main body have two pairs of parallel slits to form the two front connecting strips symmetrically at the two sides of the front portion of the shoe cover main body respectively, and that both symmetrical sides of the rear portion of the shoe cover main body have two pairs of parallel slits to form the two rear connecting strips symmetrically at the two sides of the rear portion of the shoe cover main body respectively.

In one embodiment, both sides of the front portion of the shoe cover main body have two slits formed therein respectively to form the two the front joint perforations.

In one embodiment, both sides of the rear portion of the shoe cover main body have two slits formed therein respectively to form the two rear joint perforations.

In accordance with another aspect of the invention, the present invention comprises a method of dispensing detachable shoe covers, comprising steps of:

(a) guiding a plurality of interconnecting detachable shoe covers to move from an installation arrangement to a dispenser arrangement provided at front end portions by a pair of installation arms of an installation assembly of a dispenser apparatus;

(b) opening a frontmost detachable shoe cover of the plurality of detachable shoe covers at the dispenser arrangement of the dispenser apparatus for wearing the frontmost detachable shoe cover on a shoe of a user; and (c) separating the frontmost detachable shoe cover from a subsequent detachable shoe cover of the plurality of detachable shoe covers by a separator arranged at the dispenser arrangement of the installation assembly of the dispenser apparatus under a pulling of the frontmost detachable shoe cover away from the subsequent detachable shoe cover.

In one embodiment, before the step (a), the method further comprising a step of interconnecting each of the shoe covers with a subsequent shoe cover through the interconnection arrangement and the installation arms.

In one embodiment, the step (c) further comprises steps of:

(c1) separating the detachable connecting arrangement to detach the frontmost detachable shoe cover from the subsequent detachable shoe cover;

(c2) moving the subsequent shoe cover to the dispenser arrangement by the pulling out of the frontmost detachable shoe cover for separation; and (c3) opening the subsequent shoe cover at the dispenser arrangement to a ready-to-use mode.

Still further objects and advantages will become apparent from a consideration of the ensuing description and drawings.

These and other objectives, features, and advantages of the present invention will become apparent from the following detailed description, the accompanying drawings, and the appended claims.

BRIEF DESCRIPTION OF THE DRAWINGS

FIG. 34A is a schematic view illustrating a modification of the above fifth alternative mode of the detachable shoe cover according to the above preferred embodiment of the present invention.

FIG. 34B is a schematic view illustrating a modification of the above sixth alternative mode of the detachable shoe cover according to the above preferred embodiment of the present invention.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

As shown in FIG. 1 to FIG. 4, a dispenser apparatus for detachable shoe covers 90 according to a preferred embodiment is illustrated. The dispenser apparatus comprises an installation assembly 10, a frame 20 and a separator 30.

Figure 11:
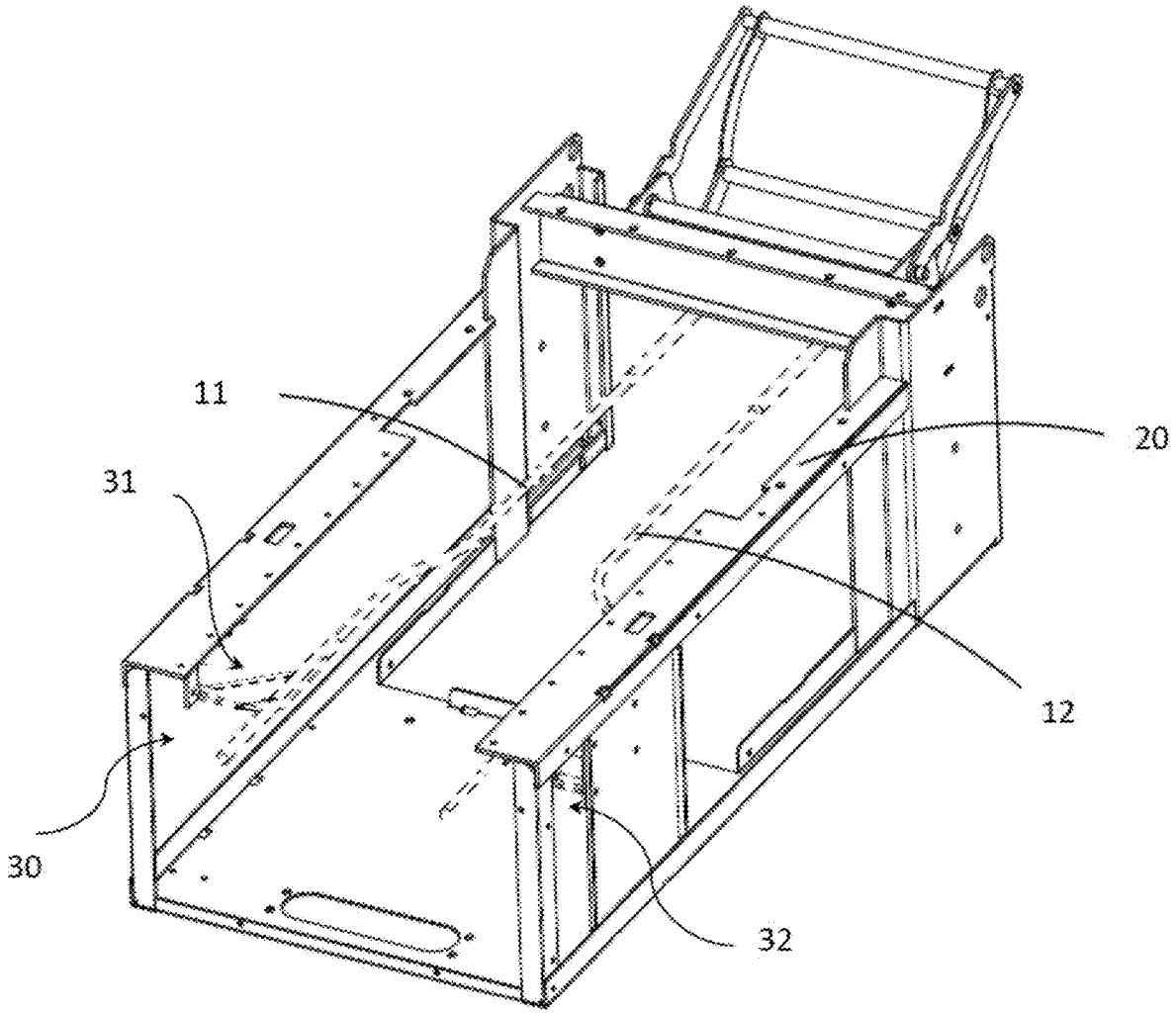
FIG. 11 is a perspective view of the frame of the dispenser apparatus for installing the pair of linear installation arms as shown in FIG. 10A according to the above preferred embodiment of the present invention.

The installation assembly 10 is installed in the frame 20, as shown in FIG. 11, and comprises a pair of elongated installation arms 11, 12 for installing the detachable shoe covers 90, wherein the two installation arms 11, 12 are arranged and configured to provide a dispenser arrangement 101 at end portions 111, 112 of the installation arms 11, 12 for guiding a frontmost detachable shoe cover 901 of the detachable shoe covers 90 installed in the installation assembly 10 to be dispensed in an open state for wearing. The separator 30 arranged at the end portions 111, 121 of the installation arms 11, 12 for separating the frontmost detachable shoe cover 901 from the installation arms 11, 12 after being worn on a shoe of a user.

The frame 20, as shown in FIG. 11, is a structure configured to support the pair of installation arms 11, 12 extending from a rear end to a front end of the frame 20 in parallel manner to define an installation arrangement 102, a transition arrangement 103 and the dispenser arrangement 101 of the installation assembly 10.

In particular, the two installation arms 11, 12 are parallelly extended to have a predetermined length and an installation distance ID therebetween for the plurality of detachable shoe covers 90 to be stacked together one-by-one in series and held therealong to form the installation arrangement 102. In other words, the longer the installation arrangement 102, the more detachable shoe covers 90 can be received and carried for dispensing. The two installation arms 11, 12 are parallelly and frontwardly extended to have a dispenser distance DD therebetween at the front end portions 111, 121 thereof to form the dispenser arrangement 101, wherein the dispenser distance DD is wider than the installation distance ID. The two installation arms 11, 12 are gradually extended from the installation arrangement 102 to the dispenser arrangement 101 frontwardly and outwardly in a symmetrical manner to form the transition arrangement 103.

Figure 5A:
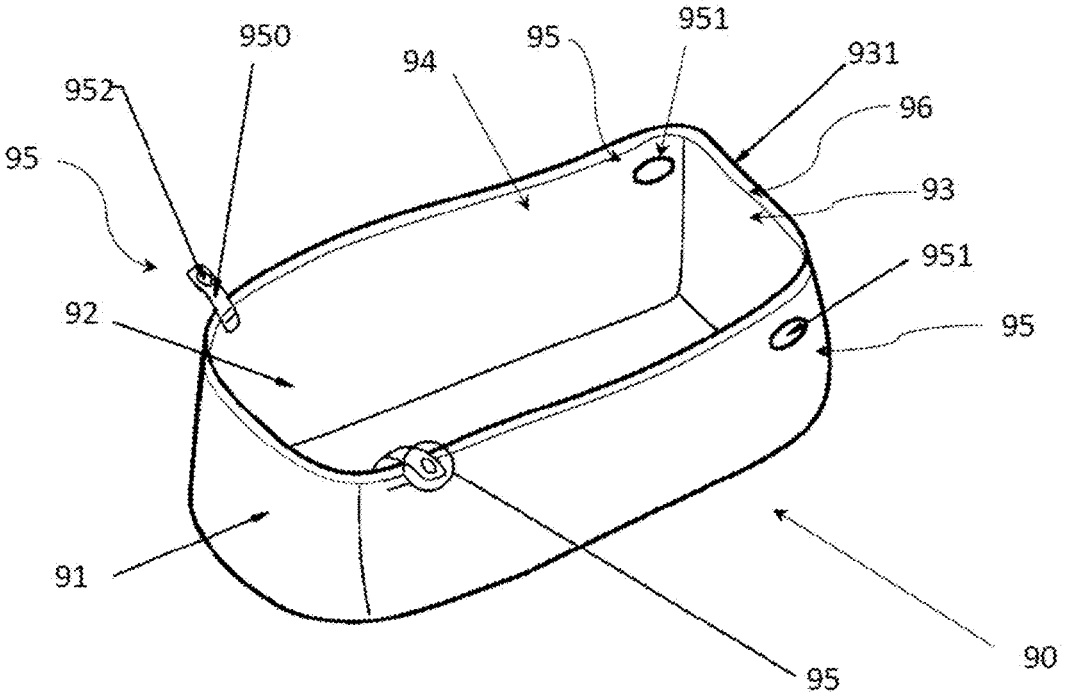
FIG. 5A is a perspective view of a detachable shoe cover in an open state according to the above preferred embodiment of the present invention.

Referring to FIG. 5A, each of the detachable shoe covers 90 comprises a shoe cover main body 91 having a receiving cavity 92, an elastic opening edge portion 93 defining an opening 94, and an interconnection arrangement 95 for interconnecting the detachable shoe covers 90 to be installed in the dispenser apparatus. The interconnection arrangement 95 includes a front portion of the shoe cover main body 91, a rear portion of the shoe cover main body 91, two front joint perforations 951 provided in the front portion, and two rear joint perforations 952 provided in the rear portion, for interconnecting each of the plurality of detachable shoe covers 90 with another adjacent detachable shoe cover 90 of the plurality of detachable shoe covers 90 along the two installation arms 11, 12 so as to be installed in the dispenser apparatus.

According to the preferred embodiment of the present invention, each of the detachable shoe covers 90 further comprises a ring shape elastic element 96 provided around an opening edge 931 of the elastic opening edge portion 93 to provide an elastic effect for being stretched to open the opening 94 for wearing on a shoe of a user and to retract to reduce a size of the opening 94 for holding on the shoe of the user. The front joint perforations 951 are formed below the elastic element 96 and the interconnection members 950 are also connected to a position below the elastic element 96.

Figure 5C:
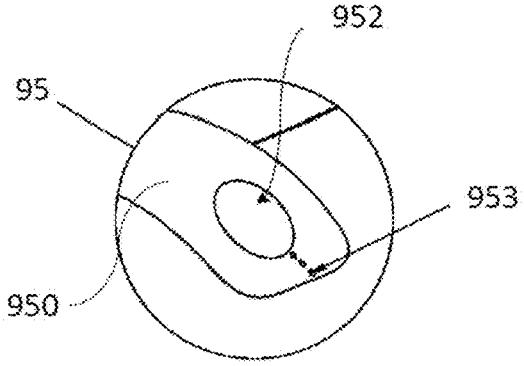
FIG. 5C is an enlarged view of a connection member of the detachable shoe cover according to the above preferred embodiment of the present invention.
Figure 5B:
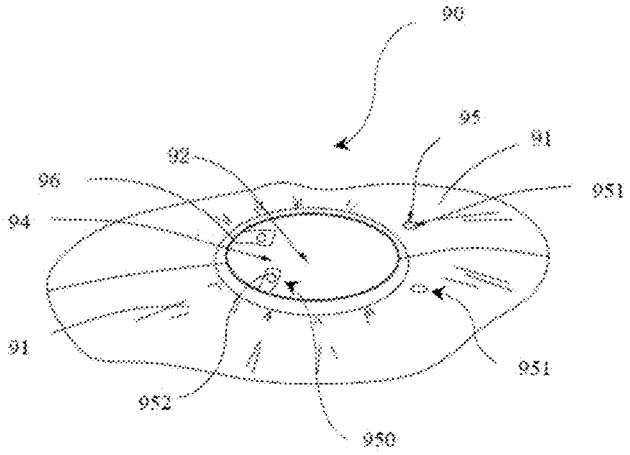
FIG. 5B is a perspective view of the detachable shoe cover in a normal state according to the above preferred embodiment of the present invention.

The interconnection arrangement 95 of the detachable shoe cover 90 can be embodied as various modes. Referring to FIG. 5A and FIG. 5B, the interconnection arrangement 95 of the detachable shoe cover 90 further comprises two interconnection members 950 integrally connected to the rear portion of the elastic opening edge portion 93 and the two front joint perforations 951 formed in a front portion of the elastic opening edge portion 93, the two rear joint perforations 952 are formed in the two interconnection members 950 respectively. Referring to FIG. 5C, according to the preferred embodiment, to facilitate the detachable shoe cover 90 to be detached from the installation assembly 10 upon pulling force, a detachable line 953 is extended from the rear joint perforation 952 to an edge of the interconnection member 950. The detachable line 953 can be embodied to have a plurality of tiny perforations formed in the interconnection member 950, a thinner thickness than that of the interconnection member 950, and etc.

Figure 1:
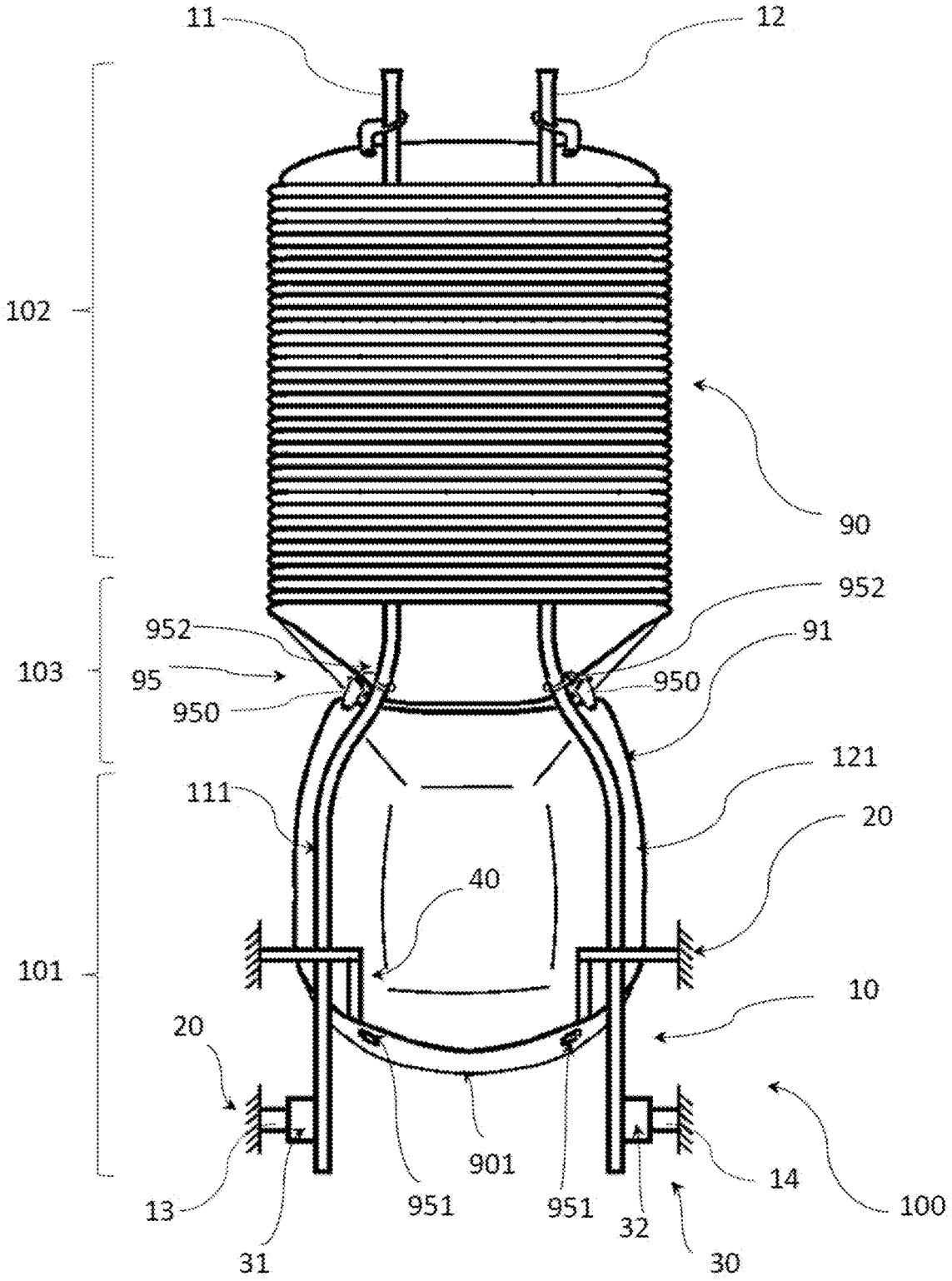
FIG. 1 is a schematic view of a dispenser apparatus for detachable shoe covers according to a preferred embodiment of the present invention.
Figure 2:
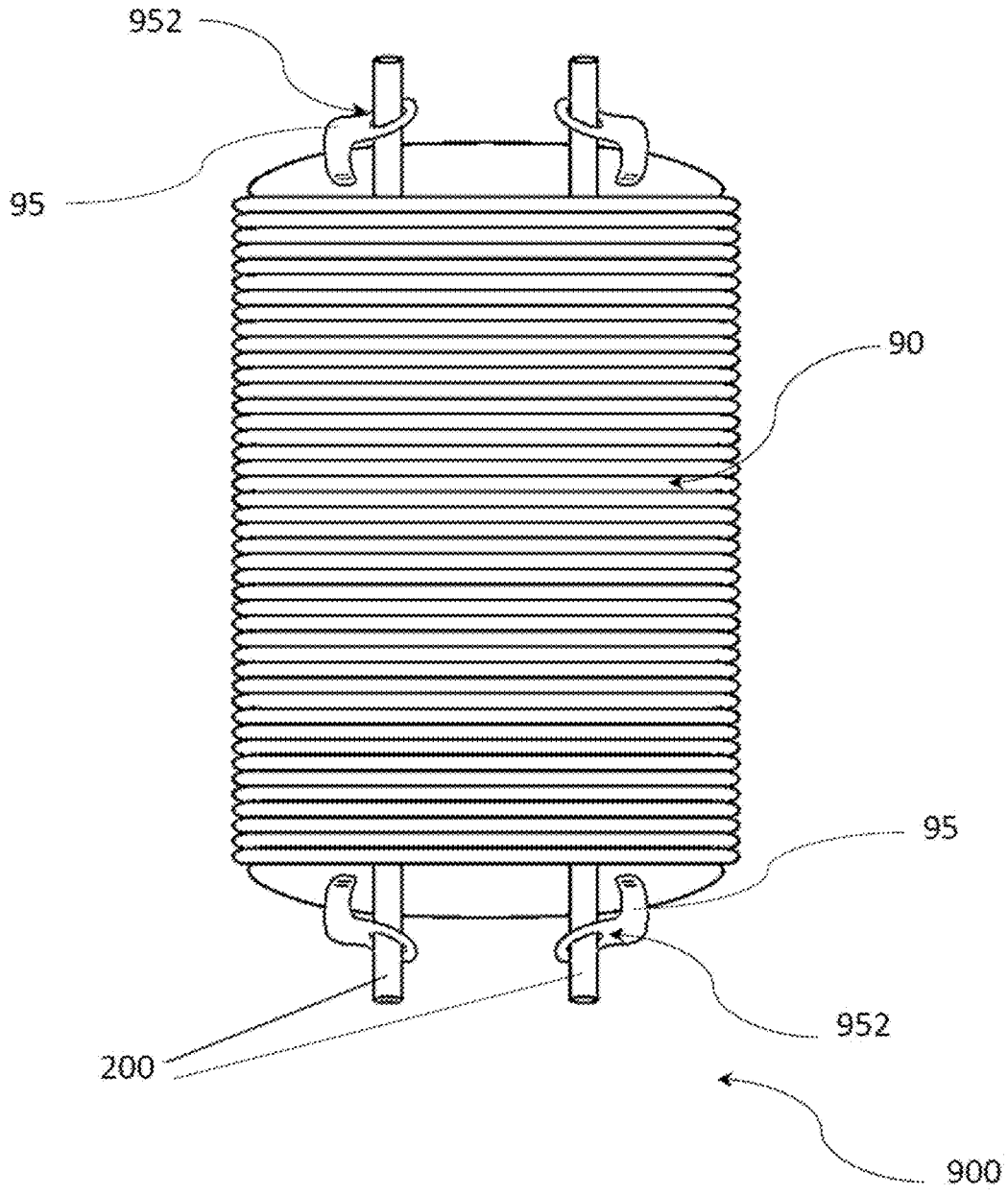
FIG. 2 is a schematic view of a shoe cover assembly of the detachable shoe covers configured for being dispensed by the dispenser apparatus according to the above preferred embodiment of the present invention.
Figure 6:
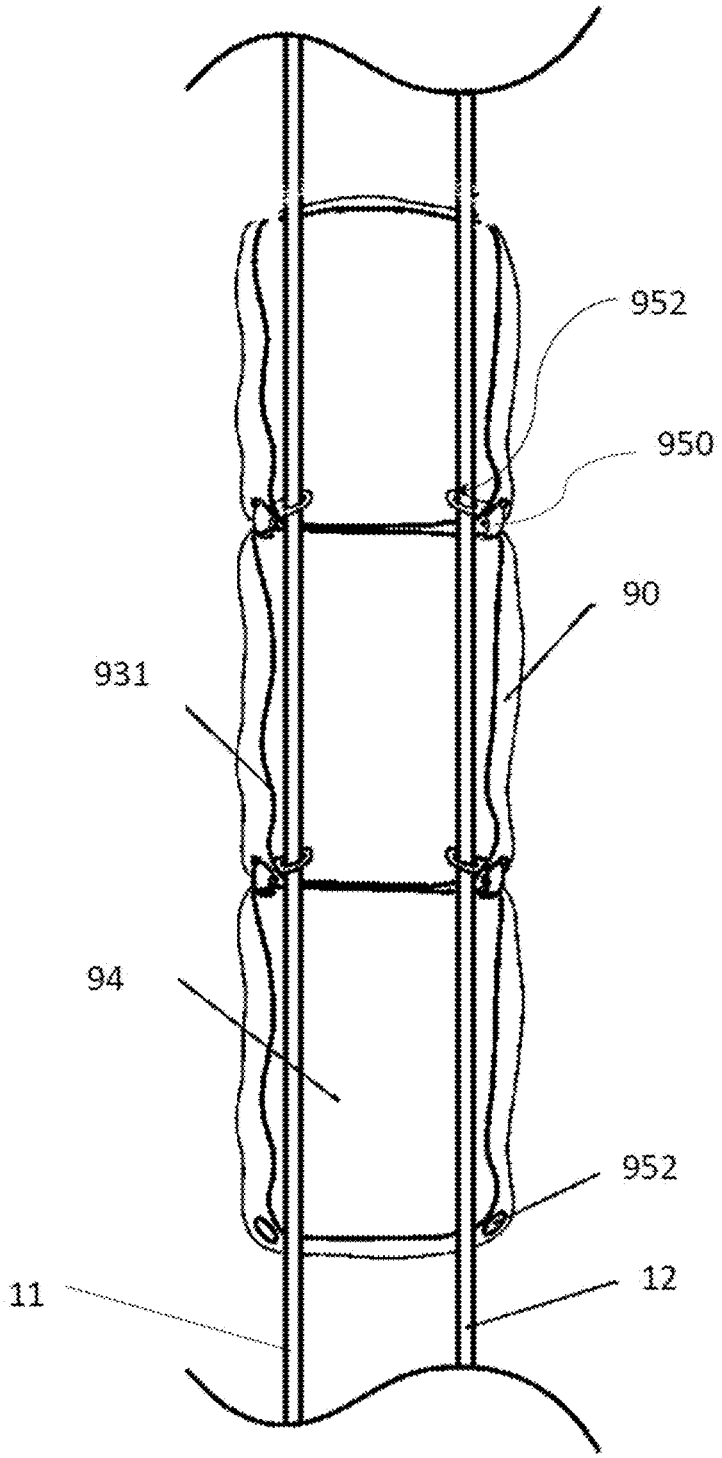
FIG. 6 is a schematic view illustrating the installation arrangement of the detachable shoe covers and the dispenser apparatus according to the above preferred embodiment of the present invention.

Referring to FIG. 6, to interconnecting the detachable shoe covers 90 one-by-one in series with the two installation arms 11, 12, the two interconnection members 950 of each of the detachable shoe covers 90 are penetrated through the two front joint perforations 951 of a subsequent detachable shoe cover 90 from an outer side to an inner side thereof respectively. Then, the two interconnection members 950 are hanged to the two installation arms 11, 12 respectively by penetrating the two installation arms 11, 12 through the two rear joint perforations 952 of the two interconnection members 950 respectively, such that the plurality of detachable shoe covers 90 are installed along the two installation arms 11, 12 of the installation assembly 10. For illustration purpose, the detachable shoe covers 90 are stretched to open state as shown in FIG. 6 to illustrate the interconnecting configuration between the interconnection members 950, the front and rear joint perforations 951, 952 and the two installation arms 11, 12. Normally, as shown in FIG. 1, the plurality of detachable shoe covers 90 installed in the installation arrangement 102 of the installation assembly 10 is stacked one-by-one in series along the two installation arms 11, 12 of the installation assembly 10 to maximize the storage capacity of the detachable shoe covers 90.

Figure 4:
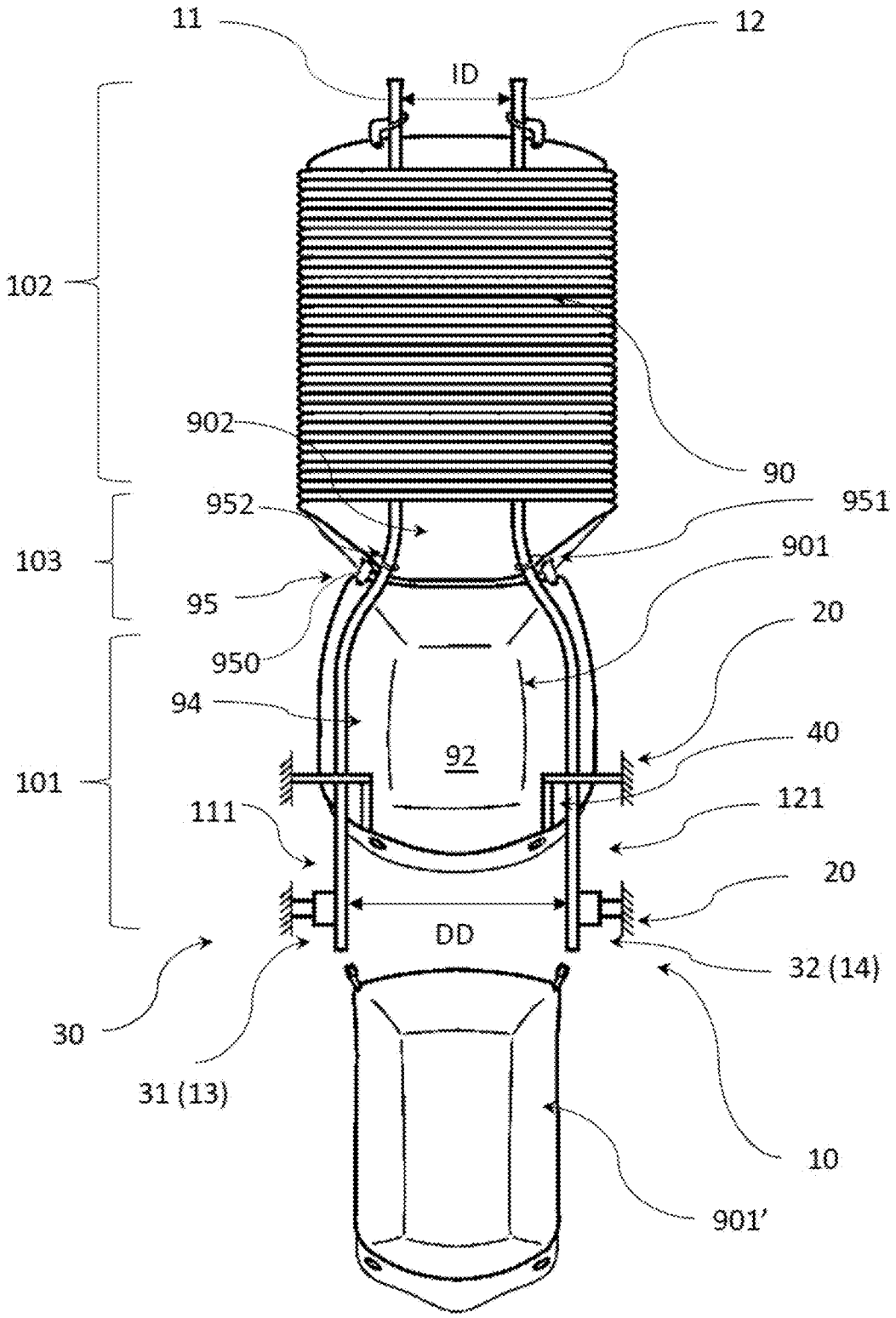
FIG. 4 is a schematic view of the dispenser apparatus installed with the detachable shoe covers during dispensing of a frontmost detachable shoe cover from a subsequent detachable shoe cover according to the above preferred embodiment of the present invention.

Referring to FIG. 4 and FIG. 5A, a first distance between the two interconnection members 950 is generally equal to a second distance between the two front joint perforations 951, wherein each of the first distance and the second distance is generally equal to the dispenser distance DD between the two parallel installation arms 11, 12 in the dispenser arrangement 101 of the installation assembly 10, so that each of the detachable shoe covers 90 can be stretched out to the open state by the two installation arms 11, 12 in the dispenser arrangement 101 of the installation assembly 10. Also, the elastic element 96 is configured to normally contract and reduce a size of the opening 94, that is the first distance between the two interconnection members 950 and the second distance between the two front joint perforations 951 are reduced correspondingly to match the installation distance ID between the two parallel installation arms 11, 12 in the installation arrangement 102 that is narrower than the dispenser distance DD, as shown in FIG. 4.

Figure 3A:
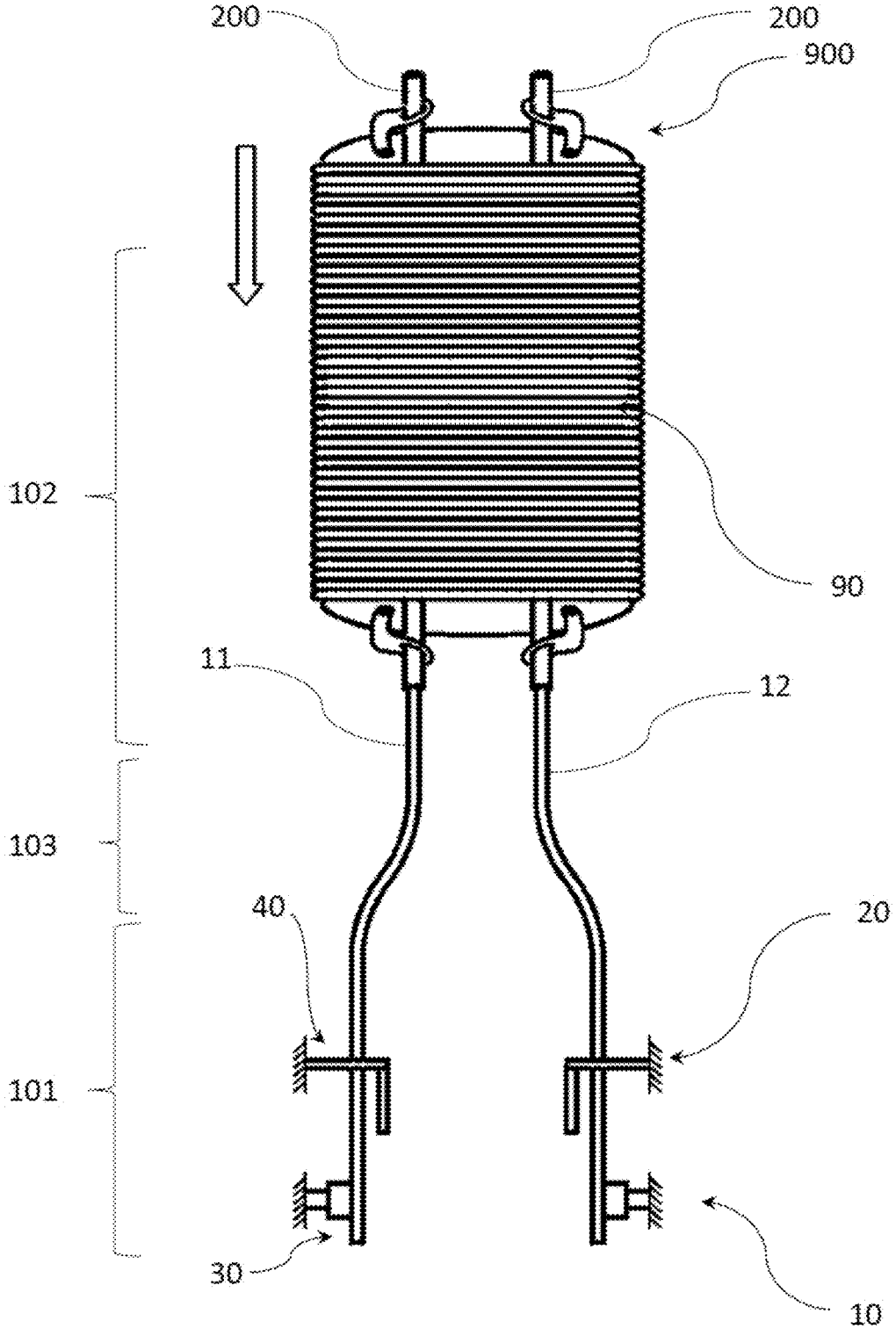
FIG. 3A and FIG. 3B are schematic views illustrating the operation of installing the detachable shoe covers of the shoe cover assembly to the installation assembly according to the above preferred embodiment of the present invention.

To facilitate the installation of the plurality of detachable shoe covers 90 in the installation assembly 10, the plurality of shoe covers 90 are pre-installed to a pair of tubular connection rods 200 to form a shoe cover package 900, as shown in FIG. 3, wherein a length of the connection rod 200 is embodied shorter or equal to a length of the portion of the installation arms 11, 12 of the installation arrangement 102 of the installation assembly 10, a distance between the two connection rods 200 is equal to the installation distance ID of the two installation arms 11, 12, and a diameter of the tubular hole of the connection rod 200 is preferred to be slightly larger than a diameter of the installation arm 11, 12. It is appreciated that the shoe cover package 900 can be pre-assembled in the supplier or seller thereof for ease of storage and transportation. In addition, the shoe cover package 900 further facilitates the installation of the detachable shoe covers 90 in the installation assembly 10. Referring to FIG. 3A, simply by inserting the portions of the installation arms 11, 12 in the installation arrangement 102 of the installation assembly 10 into the two connection rods 200 of the shoe cover package 900, the shoe cover package 900 is mounted to the installation arms 11, 12.

Figure 3B:
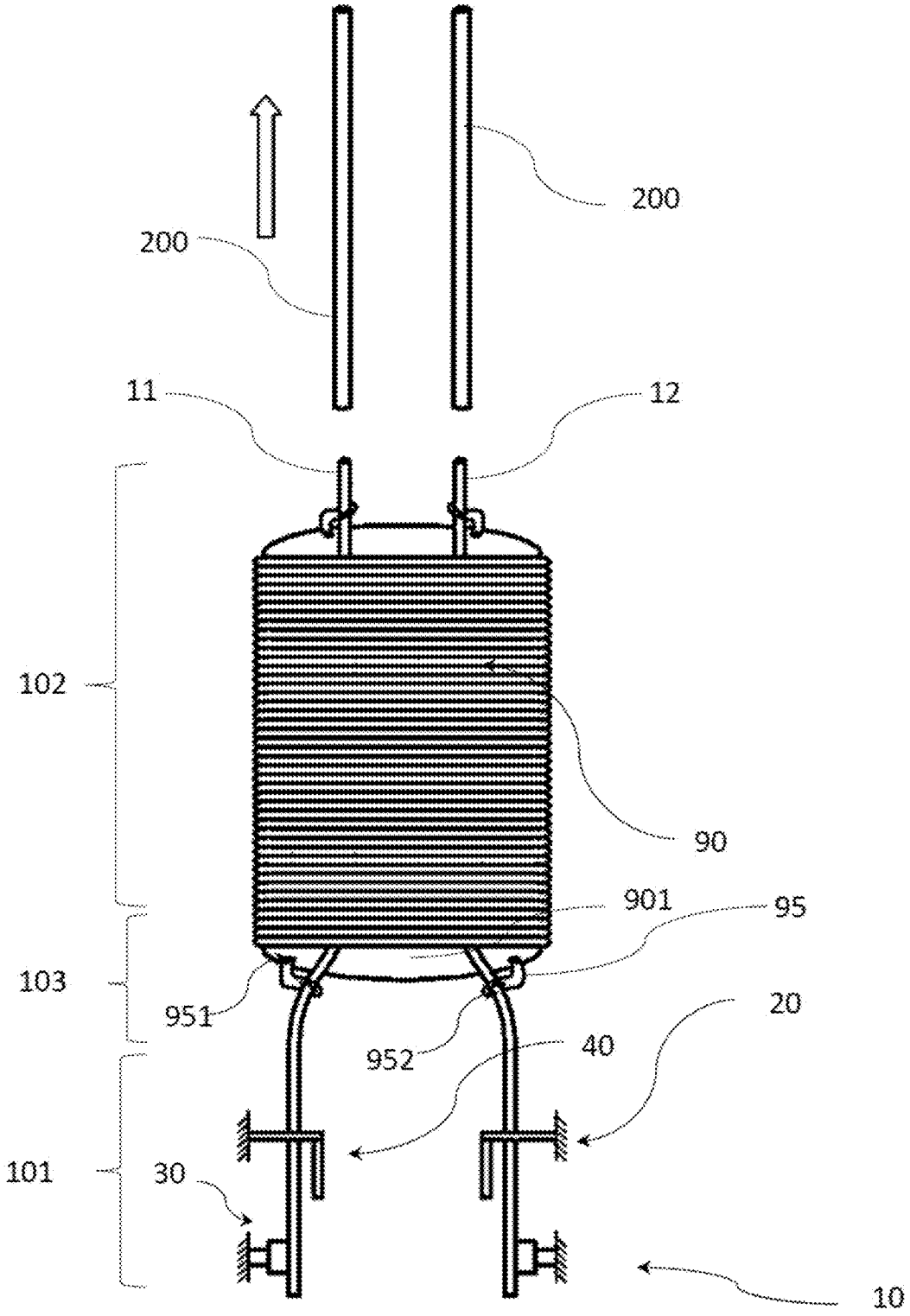

Referring to FIG. 3B, to install the plurality of detachable shoe covers 90 along the installation arms 11, 12 becomes so easily by pulling out the two connection rods 200 such that the interconnection members 950 of the detachable shoe covers 90 are hanged to the installation arms 11, 12. That is the two installation arms 11, 12 penetrate through the two rear joint perforations 952 of the two interconnection members 950 of each of the detachable shoe covers 90 respectively, while the two interconnection members 950 of each detachable shoe cover 90 are extended from outside to inside through the front joint perforations 951 of the adjacent detachable shoe cover 90 as shown in FIG. 6.

It is worth mentioning that the installation assembly 10 of the present invention is effectively simplified in structure and minimizes the manufacturing steps and cost by the curved configuration of the installation arm 11, 12 without the need of any complicated and additional component. The symmetrical configuration of the elongated and curved installation arms 11, 12 of the installation assembly 10 defines the installation arrangement 102, the transition arrangement 103 and the dispenser arrangement 101 of the installation assembly 10, wherein after the package of the plurality of detachable shoe covers 90 is installed to the installation arrangement 102, referring to FIG. 3B and FIG. 4, the distance between the portions of the installation arms 11, 12 of the installation arrangement 102 is generally equal to the distance between the two interconnection members 950 of each of the plurality of detachable shoe covers 90 so that each detachable shoe cover 90 is in a normal contract state without stretching to open its opening 94 and thus the plurality of detachable shoe covers 90 is stacked together in the installation arrangement 102. In the transition arrangement 103 of the installation assembly 10, the two installation arms 11, 12 are gradually extended frontwardly and outwardly, that substantially restricts the installed detachable shoe covers 90 in the installation arrangement 102 from moving forwards without any pulling force applied to the frontmost detachable shoe cover 901, as shown in FIG. 3B, and guides the detachable shoe cover 90 to move to the dispenser arrangement 101 along the installation arms 11, 12 gradually and smoothly.

Referring to FIG. 1 to FIG. 4, the separator 30 is preferred to be provided at a front portion of the dispenser arrangement 101, that is front ends of the installation arms 11, 12 according to the preferred embodiment and configured to detach the frontmost detachable shoe cover 901 from the subsequent detachable shoe cover 902 by separating the interconnection arrangement 95, that is separating the interconnection members 950 at the detachable lines 953 thereon, as shown in FIG. 5C, according to the preferred embodiment of the present invention.

Referring to FIG. 4, upon a pulling force is applied to the frontmost detachable shoe cover 901 frontwards, the frontmost detachable shoe cover 901 is pulled to move frontwards and be stretched out between the portions of the two installation arms 11, 12 of the dispenser arrangement 101 in an open state while a front portion, including the two front joint perforations 951 thereof, of a subsequent detachable shoe cover 902 of the plurality of detachable shoe covers 90 is pulled to partially open in the transition arrangement 103 between the two installation arms 11, 12 at the same time. Since the distance between the two installation arms 11, 12 of the dispenser arrangement 101 of the installation assembly 10 is wider than that of the installation arrangement 102, when the frontmost detachable shoe cover 901 is stretched out to the dispenser arrangement 101, the transition arrangement 103 substantially forms a rear retaining configuration to limit the rear portion of the stretched out frontmost detachable shoe cover 901 from re-stretching back to the installation arrangement 102. In order to maintain the frontmost detachable shoe cover 901 in the dispenser arrangement 101 in the open state, the installation assembly 10 further comprises a front retaining configuration 40 to restrict the front portion of the frontmost detachable shoe cover 901 retaining in the open state that the elastic element 96 is stretched out and extended to open the opening 94 enough for the user to place his or her shoe in the receiving cavity 92 of the detachable shoe cover 90, as shown in FIG. 5A.

In view of FIG. 4, in order to dispense a detachable shoe cover 90, the user may simply place his or her shoe in the receiving cavity 92 through the opening 94 to wear the frontmost detachable shoe cover 901 on the shoe and then move the worn frontmost detachable shoe cover 901 frontwards until the two interconnection members 950 reach the separator 30. Accordingly, a continuous frontward movement of the frontmost detachable shoe cover 901 away from the dispenser arrangement 101 not only pulls the interconnection members 950 against the separator 30 until the interconnection members 950 is broken by the separator 30 to detach the frontmost detachable shoe cover 901 from the subsequent detachable shoe cover 902 and separate from the installation assembly 10 to form a detached detachable shoe cover 901' worn on the user's shoe, wherein the previously subsequent detachable shoe cover 902 is also pulled to move the dispenser arrangement 101 becoming the frontmost detachable shoe cover 901 being opened in the dispenser arrangement 101 for wearing and the next detachable shoe cover 90 interconnecting with the original subsequent detachable shoe cover 902 is also pulled frontwards to be partially opened at the transition arrangement 103 and forms the current subsequent detachable shoe cover 902 of the current frontmost detachable shoe cover 901.

Figure 7A:
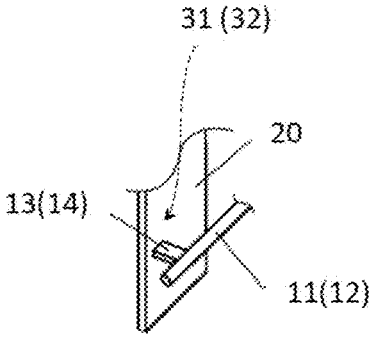
FIG. 7A to FIG. 7C are partial schematic views illustrating alternative modes of the stationary mounting of the installation arm to the frame of the dispenser apparatus according to the above preferred embodiment of the present invention.
Figure 7B:
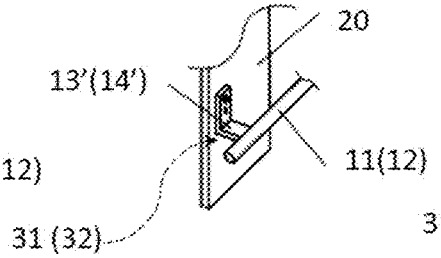
Figure 7C:
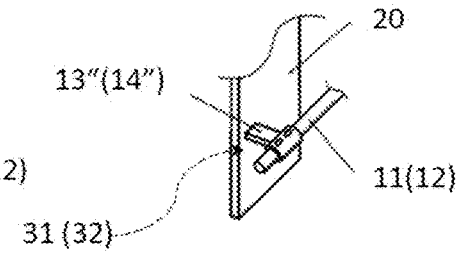

Referring to FIG. 7A to FIG. 7C, according to the preferred embodiment, the installation assembly 10 further comprises a pair of connectors 13, 14 rigidly mounted between the frame 20 and the front ends of the pair of installation arms 11, 12 so as to rigidly support the pair of installation arms 11, 12 to the frame 20 in parallel manner. Each of the connectors 13, 14 can be a connecting member integrally extended between the frame 20 and the respective installation arm 11, 12 by welding as shown in FIG. 7A. Person skilled in the art may understand that multiple supporting elements can be used to support the installation arm 11, 12 to the frame in a secure and rigid manner. For example, each of the connectors 13, 14 can be a L-shaped mount 13', 14' having one end integrally welded to the respective installation arm 11, 12 and the other end screwed to the frame 20 as shown in FIG. 7B. Alternatively, each of the connectors 13", 14" can be configured to have one end integrally connected to the frame 20 and a tubular holder to sleeve and hold the front end portion 111, 121 of the respective installation arm 11, 12 in position in a rigid and firm manner, as shown in FIG. 7C.

As shown in FIG. 1 and FIG. 4, the separator 30 is preferred to comprise a pair of resistant separating members 31, 32 provided at the front end portions 111, 121 of the installation arms 11, 12, each of which is configured to break the detachable line 953 of the interconnection member 950 hanged to the respective installation arm 11, 12 when the frontmost detachable shoe cover 901 is pulled to move out frontwardly from the installation arms 11, 12, wherein the two separating members 31, 32 are positioned that the two interconnection members 950 of the pulling out frontmost detachable shoe cover 901 would come across the two separating members 31, 32 respectively and the continuously frontward moving of the frontmost detachable shoe cover 901 would apply a shearing force to each of the interconnection members 950 against the respective separating member 31, 32 and the two interconnection members 950 are broken apart at the weaken detachable lines 953 generally allowing the frontmost detachable shoe cover 901 detaching from the installation assembly 10 of the dispenser apparatus, as shown in FIG. 4.

As shown in FIG. 1 and FIG. 4, the two separating members 31, 32 can be integrally provided between connectors 13, 14 and the two installation arms 11, 12 respectively.

It is appreciated that the two connectors 13, 14, as shown in FIG. 1 and FIGS. 7A to 7C, can be functioned as the separating members 31, 32 too, as along as the connectors 13, 14 are made strong enough to break and/or separate the interconnection members 950, wherein the formation of the detachable line 953 does facilitate the breaking and/or separating of the interconnection members 950. Similarly, the separating members 31, 32 may also be configured to function as the connectors 13, 14 such that the separator 30 not only provides the separating configuration and ability to the detachable shoe covers 90 but also provides the supporting function to the installation arms 11, 12 at the same time that further simplifies the structure and reduces the weight of the dispenser apparatus of the present invention.

Figure 8:
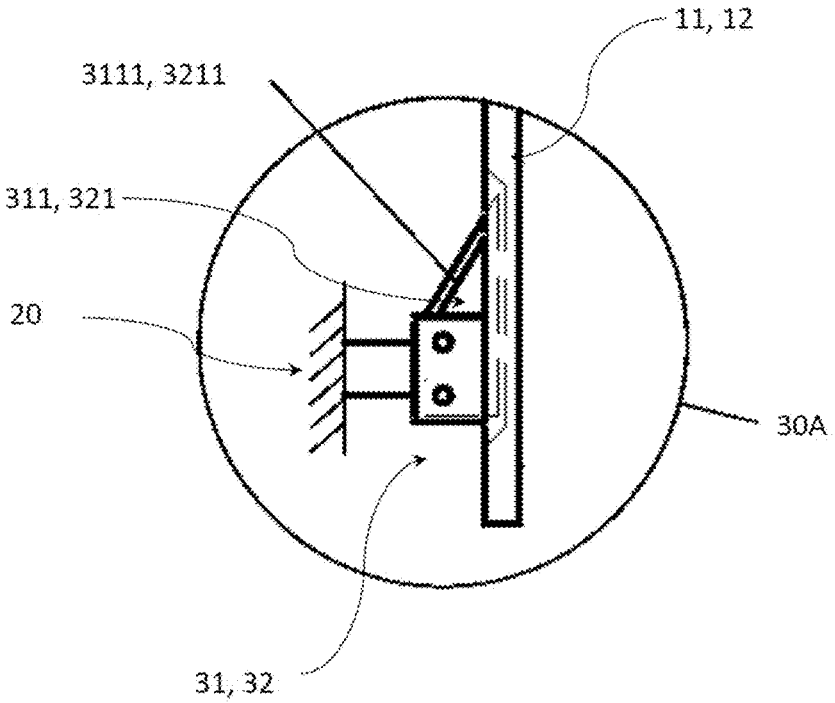
FIG. 8 is an enlarged view illustrating a cutter separator of the dispenser apparatus according to the above preferred embodiment of the present invention.

Referring to FIG. 8, an alternative mode of the separator 30 is illustrated, wherein the separator 30 can be configured to be a cutter separator 30A that a cutter 311, 321 is inclinedly mounted on each of the separating members 31, 32 while the cutting blade 3111, 3211 of the cutter 311, 321 is facing backward inclinedly towards the installed detachable shoe covers 90 and two sides of the cutter 311, 321 are embedded in the separating member 31, 32 and the installation arm 11, 12 respectively to achieve a firm and rigid configuration for separating member 31, 32 as well as the dispenser arrangement 101. Accordingly, while the interconnection members 950 of each of the detachable shoe cover 90 are moving frontward against the cutters 311, 321 respectively, the cutters 311, 321 will cut off the interconnection members 950 to separate the detachable shoe cover 90 from the installation assembly 10. Therefore, even though there is no detachable line 953 provided on the interconnection member 950, the cutter may still cut off the interconnection member 950 easily.

The key of the cutter separator 30A is the cutter 311, 321 made in various configurations as long as a cutting blade 3111, 3211 is formed on the separating member 31, 32 that faces rearwards. Alternative modes of the cutter separator 30A are illustrated in FIG. 9A to FIG. 9C.

Figure 9A:
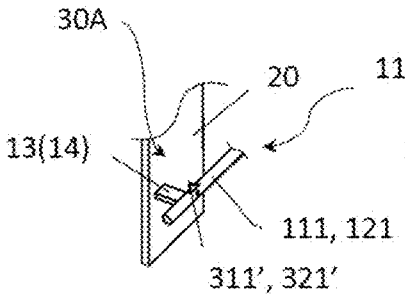
FIG. 9A to FIG. 9C are partial schematic views illustrating alternative modes of the cutter separator of the dispenser apparatus according to the above preferred embodiment of the present invention.

As shown in FIG. 9A, the cutter separator 30A is embodied to comprise a pair of triangular cutters 311', 321' protruded on the front end portions of the installation arms 11, 12 respectively at positions adjacent to the connectors 13, 14 respectively, such that the interconnection members 950 are cut off by the cutters 311', 321' to separate from the installation arms 11, 12 so as to detach the detachable shoe cover 90 from the installation assembly 10.

Figure 9B:
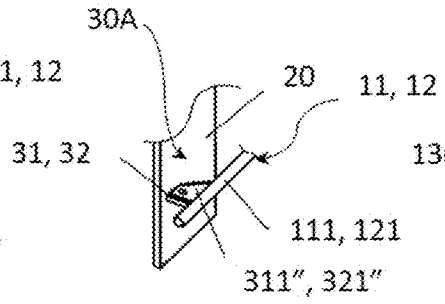

As shown in FIG. 9B, the cutters 311", 321", each having a cutting blade facing rearwards, are mounted on top of the separating members 31, 32 to form the cutter separator 30A, such that the interconnection members 950 are cut off by the cutters 311", 321" to separate from the installation arms 11, 12 so as to detach the detachable shoe cover 90 from the installation assembly 10.

Figure 9C:
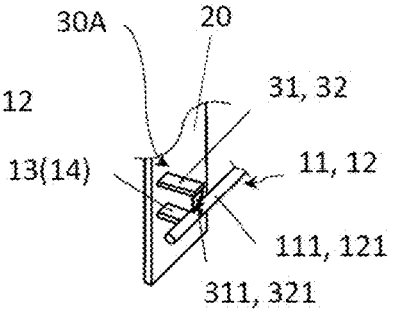

As shown in FIG. 9C, the separating members 31, 32 are mounted on top of the connectors 13, 14 and the cutters 311, 321, each having a cutting blade facing rearwards, are downwardly extended from the separating members 31, 32 to the installation arms 11, 12 respectively to form the cutter separator 30A, such that the interconnection members 950 are cut off by the cutters 311, 321 to separate from the installation arms 11, 12 so as to detach the detachable shoe cover 90 from the installation assembly 10.

Figure 10A:
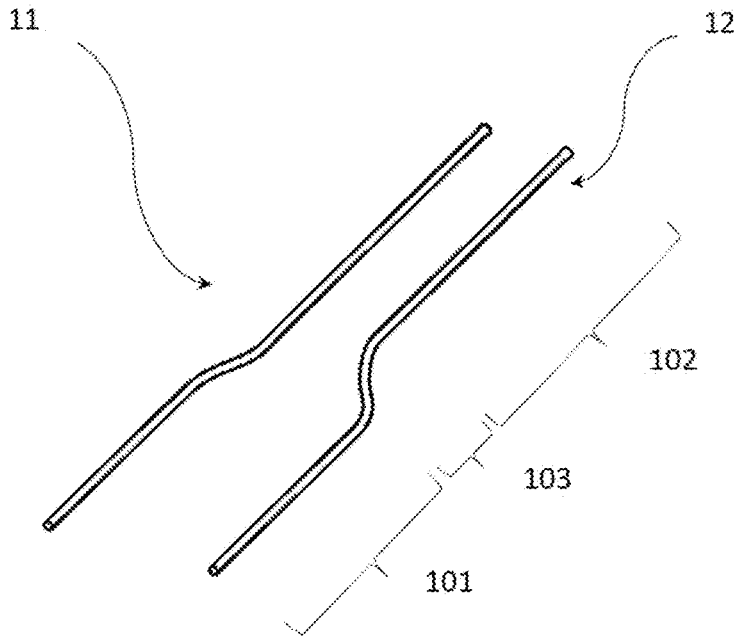
FIG. 10A is a schematic view of a pair of installation arms of the dispenser apparatus according to the above preferred embodiment of the present invention.
Figure 10B:
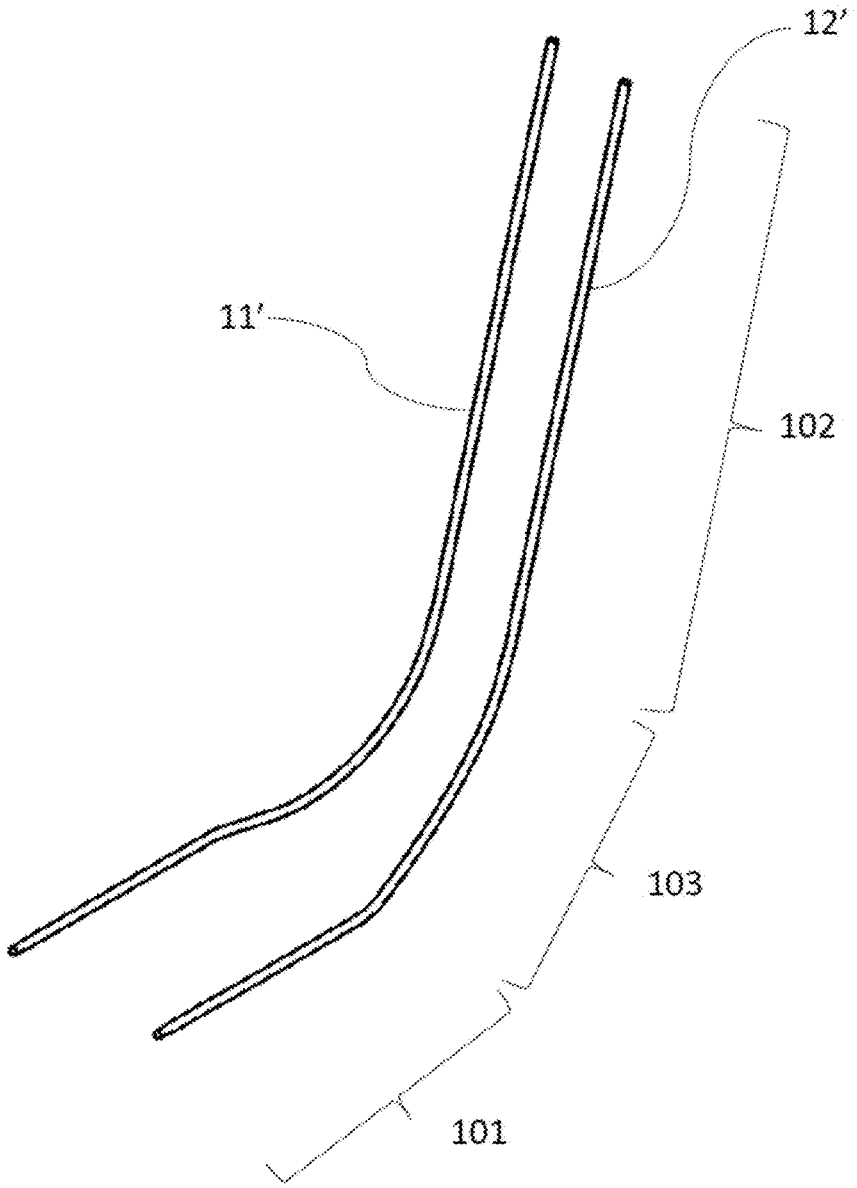
FIG. 10B is a schematic view illustrating an alternative mode of the pair of installation arms of the dispenser apparatus according to the above preferred embodiment of the present invention.
Figure 12:
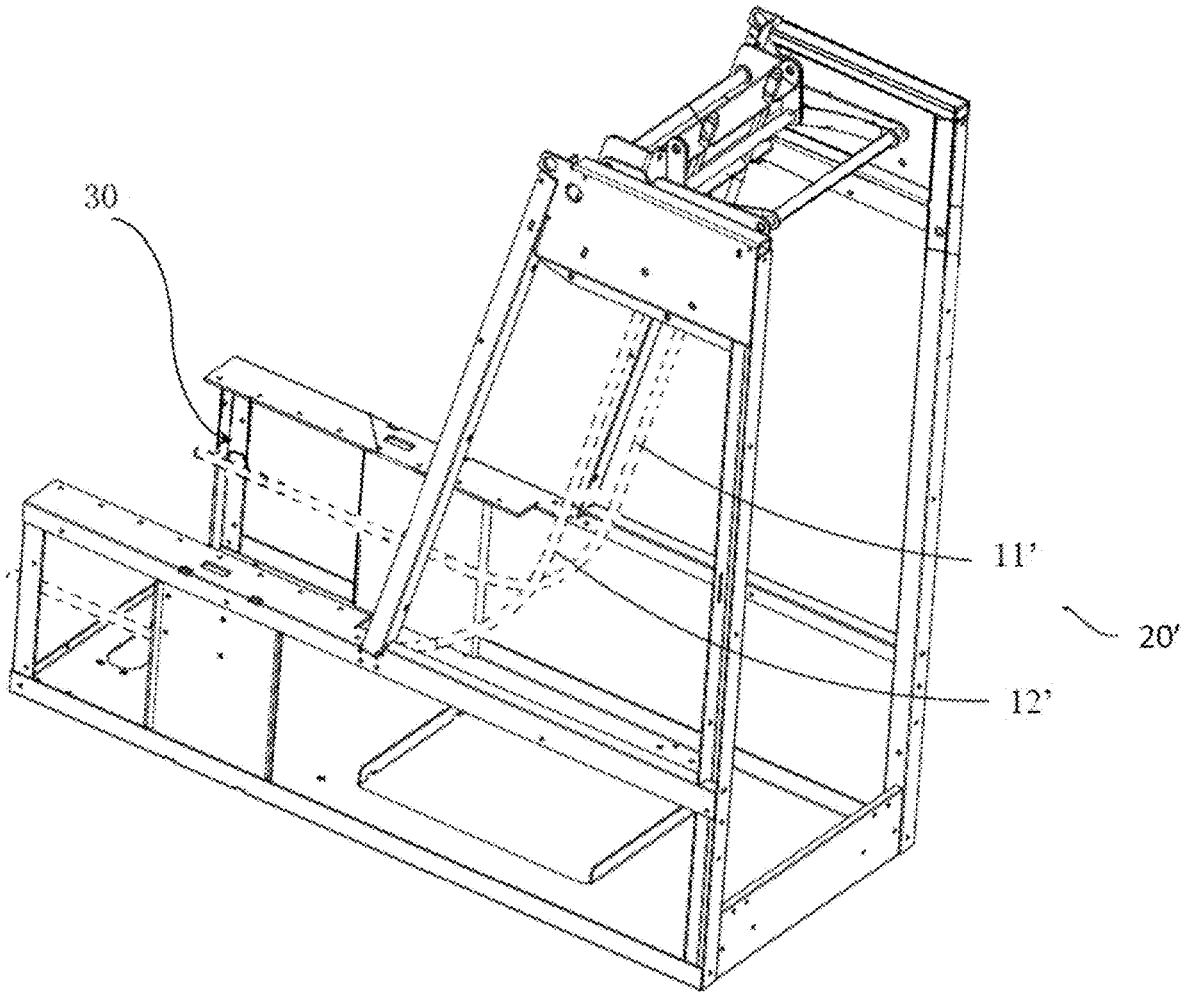
FIG. 12 is a perspective view of an alternative mode of the frame of the dispenser apparatus for installing the pair of L shape installation arms as shown in FIG. 10B according to the above preferred embodiment of the present invention.

FIG. 10A illustrates the pair of parallel and symmetrical installation arms 11, 12 in linear pattern as described in the above preferred embodiment. As shown in FIG. 10B, an alternative mode of the installation arms 11, 12 is illustrated, wherein the pair of installation arms 11', 12' are made in L shape and supported parallelly and symmetrically to the frame 20 to form the installation assembly 10. The installation arm 11', 12' are extended parallelly and horizontally to define the dispenser arrangement 101, extended curvedly, inwardly and upwardly to define the transition arrangement 103, and then extended upwardly and inclinedly in parallel to define the installation arrangement 102. The L-shape installation arms 11', 12', which are supported to the L-shape frame 20' to form an alternative mode of the dispenser apparatus as shown in FIG. 12, functions basically as the linear installation arms 11, 12, as shown in FIG. 1 to FIG. 4, while the upwardly and inclinedly extended upper portions of the installation arms 11', 12' may provide more room to install more detachable shoe covers 90 thereon for use.

According to the present invention, the pair of installation arms 11, 12 are configured to have a funnel configuration defining the narrower and parallel installation arrangement 102, the curved transition arrangement 103 and the wider and parallel dispenser arrangement 101 as shown in FIGS. 1-4 and FIGS. 10A-12, wherein the transition arrangement 103 of the installation assembly 10 can be functioned as the rear retaining configuration to limit the rear portion of the stretched out frontmost detachable shoe cover 901 from re-stretching back to the installation arrangement 102. However, the installation assembly 10 may further comprise a rear retaining arrangement 50 on the transition arrangement 103.

Figure 13A:
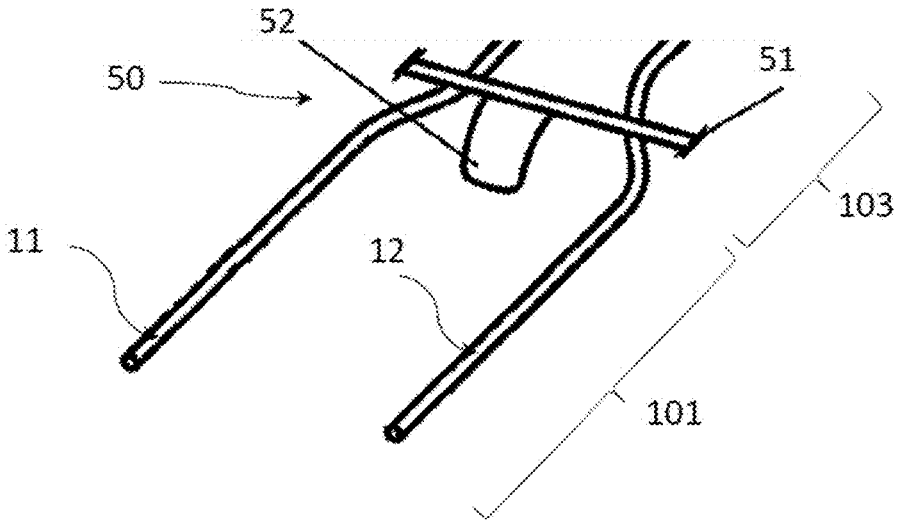
FIG. 13A is a schematic view illustrating a rear retaining arrangement of the installation assembly according to the above preferred embodiment of the present invention.

Referring to FIG. 13A, the rear retaining arrangement 50 comprises a retaining bar 51 transversely extended across the portions of the installation arms 11, 12 in the transition arrangement 103 and a retainer member 52 downwardly extended from the retaining bar 51 and configured to extend into the receiving cavity 92 of the frontmost detachable shoe cover 901 to limit the rear portion of the stretched out frontmost detachable shoe cover 901 from re-stretching back to the installation arrangement 102.

Figure 13B:
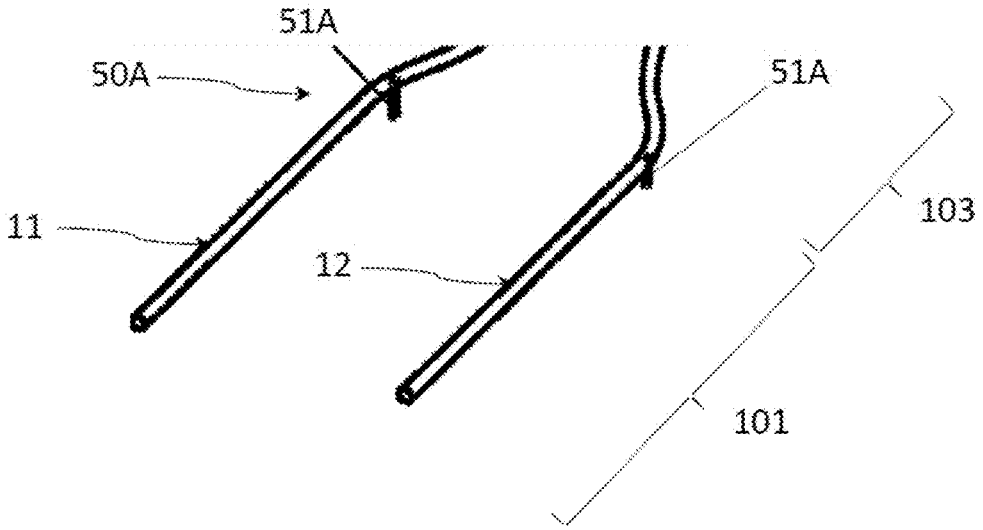
FIG. 13B is a schematic view illustrating an alternative mode of the rear retaining arrangement of the installation assembly according to the above preferred embodiment of the present invention.

FIG. 13B illustrates an alternative mode of the rear retaining arrangement 50A which comprises a pair of retainers 51A downwardly extended from the portions of the installation arms 11, 12 in the transition arrangement 103 and configured to extend into the receiving cavity 92 of the frontmost detachable shoe cover 901 to limit the rear portion of the stretched out frontmost detachable shoe cover 901 from re-stretching back to the installation arrangement 102.

Referring to FIGS. 1-4 and FIGS. 14A-14C, various embodying modes of the front retaining configuration 40 adapted to be equipped in the dispenser arrangement 101 of the installation assembly 10 are illustrated as examples.

As shown in FIGS. 1-4 and FIG. 14A, the front retaining configuration 40 comprises a pair of L shape retainers 41 each having a supporter 411 transversely extended from the frame 20, positioned behind the separator 30, across the respective installation arm 11, 12 and a retaining bar 412 downwardly extended from a free end of the supporter 411 to extend into the receiving cavity 92 of the frontmost detachable shoe cover 901 to limit the front portion of the stretched out frontmost detachable shoe cover 901 from re-stretching back to the installation arrangement 102, so as to retain the frontmost detachable shoe cover 901 in the open state with the rear retaining configuration (rear retaining arrangement 50) in the dispenser arrangement 101.

Figure 14A:
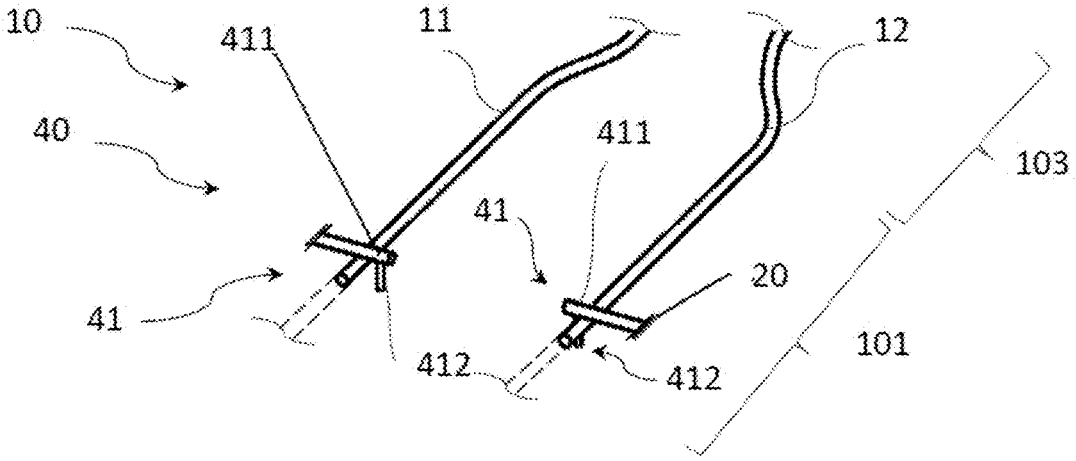
FIG. 14A to FIG. 14C are schematic views illustrating alternative modes of the front retaining configuration of the installation assembly according to the above preferred embodiment of the present invention
Figure 14B:
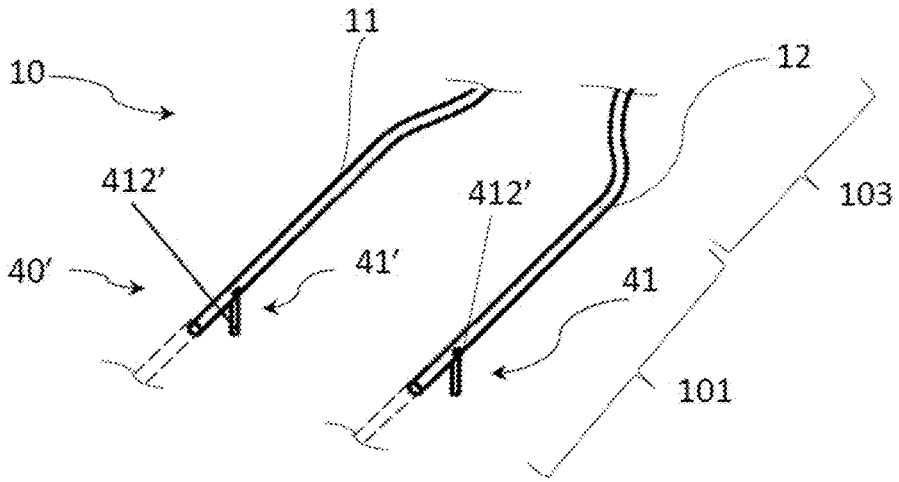

An alternative mode of the front retaining configuration 40' is illustrated in FIG. 14B, wherein the front retaining configuration 40' comprises a pair of retaining bar 412' integrally and downwardly extended from the installation arms 11, 12 respectively to extend into the receiving cavity of the frontmost detachable shoe cover 901 to limit the front portion of the stretched out frontmost detachable shoe cover 901 from re-stretching back to the installation arrangement 102, so as to retain the frontmost detachable shoe cover 901 in the open state with the rear retaining configuration (rear retaining arrangement 50) in the dispenser arrangement 101.

Figure 14C:
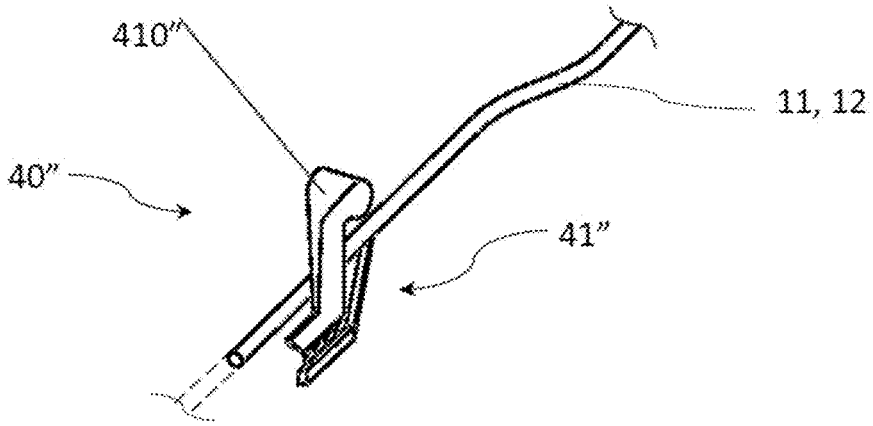

FIG. 14C illustrates another alternative mode of the front retaining configuration 40" which comprises a pair of clip type retainers 410" configured to clip on the installation arms 11, 12 respectively at the desired positions that allows the user to adjust the position of the retainers 410" on the installation arms 11, 12. In other words, the front retaining configuration 40" can be configured to be adjustable to adapt for different sizes of the detachable shoe cover 90.

According to the present invention, the funnel configuration of the pair of installation arms 11, 12 of the installation assembly 10 incorporated and equipped with the separator 30 mounted to the frame 20 enable the shoe covers 90 to be configured in detachable manner. In other words, multiple modes of the detachable shoe cover 90 are able to be dispensed by the dispenser apparatus of the present invention. One example has been disclosed in FIG. 5A to FIG. 5C of the above preferred embodiment. Referring to FIG. 15 to FIG. 31C, alternative modes of the detachable shoe cover 90 to be dispensed by the dispenser apparatus are disclosed hereinafter.

Referring to FIG. 15A to FIG. 17, a first alternative mode of the detachable shoe cover 90A according to the present invention is illustrated, wherein the detachable shoe cover 90A has the same configuration as the detachable shoe cover 90 as shown in FIG. 5A that comprises the shoe cover main body 91 having the receiving cavity 92, the elastic opening edge portion 93 defining the opening 94, and the interconnection arrangement 95 for interconnecting the detachable shoe covers 90A to be installed in the dispenser apparatus. Similarly, as shown in FIG. 15B, each of the detachable shoe covers 90A further comprises the ring shape elastic element 96 provided around the opening edge 931 of the elastic opening edge portion 93 to provide an elastic effect for being stretched to open the opening 94 for wearing on a shoe of a user and to retracted to reduce a size of the opening 94 for holding on the shoe of the user. The different of the first alternative mode of the detachable shoe cover 90A and the detachable shoe cover 90 as shown in FIG. 5A is that the two rear interconnection members 950 are replaced by two rear joint perforations 952 so that there are two front joint perforations 951 and two rear joint perforations 952 formed below the elastic element 96.

Figure 15A:
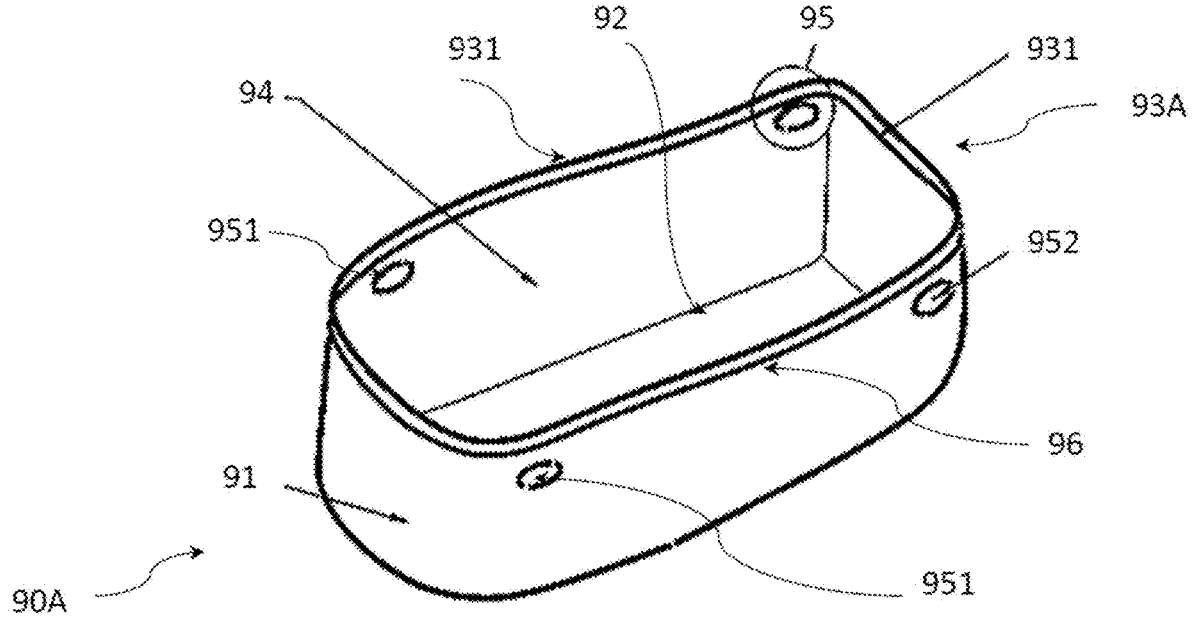
FIG. 15A is a schematic view of a first alternative mode of the detachable shoe cover according to the above preferred embodiment of the present invention.
Figure 15B:
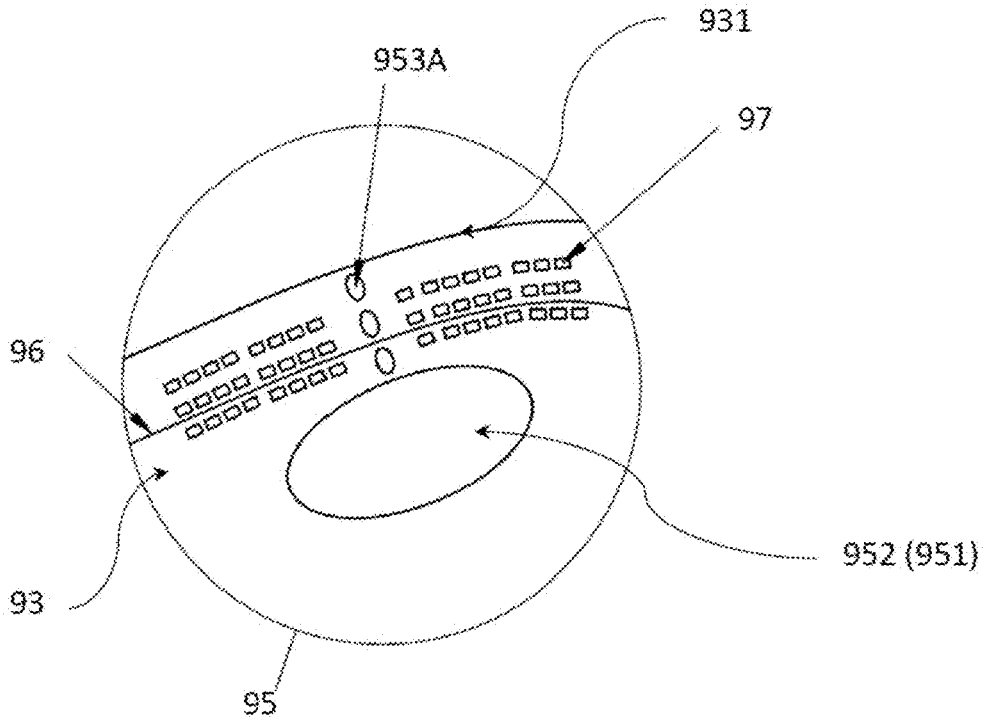
FIG. 15B is an enlarged view illustrating the detachable connection arrangement of the first alternative mode of the detachable shoe cover according to the above preferred embodiment of the present invention.

According to the first alternative mode of the detachable shoe cover 90A, between the opening edge 931 and each of the front and rear joint perforations 951, 952, as shown in FIG. 15B, a sealing portion 97 is formed by thermal pressing so as to reinforce and strength the material between the opening edge 931 and each of the front and rear joint perforations 951, 952 of the detachable shoe cover 90A, and a detachable line 953A is formed and extended from the opening edge 931 to each of the front and rear joint perforations 951, 952.

Figure 16:
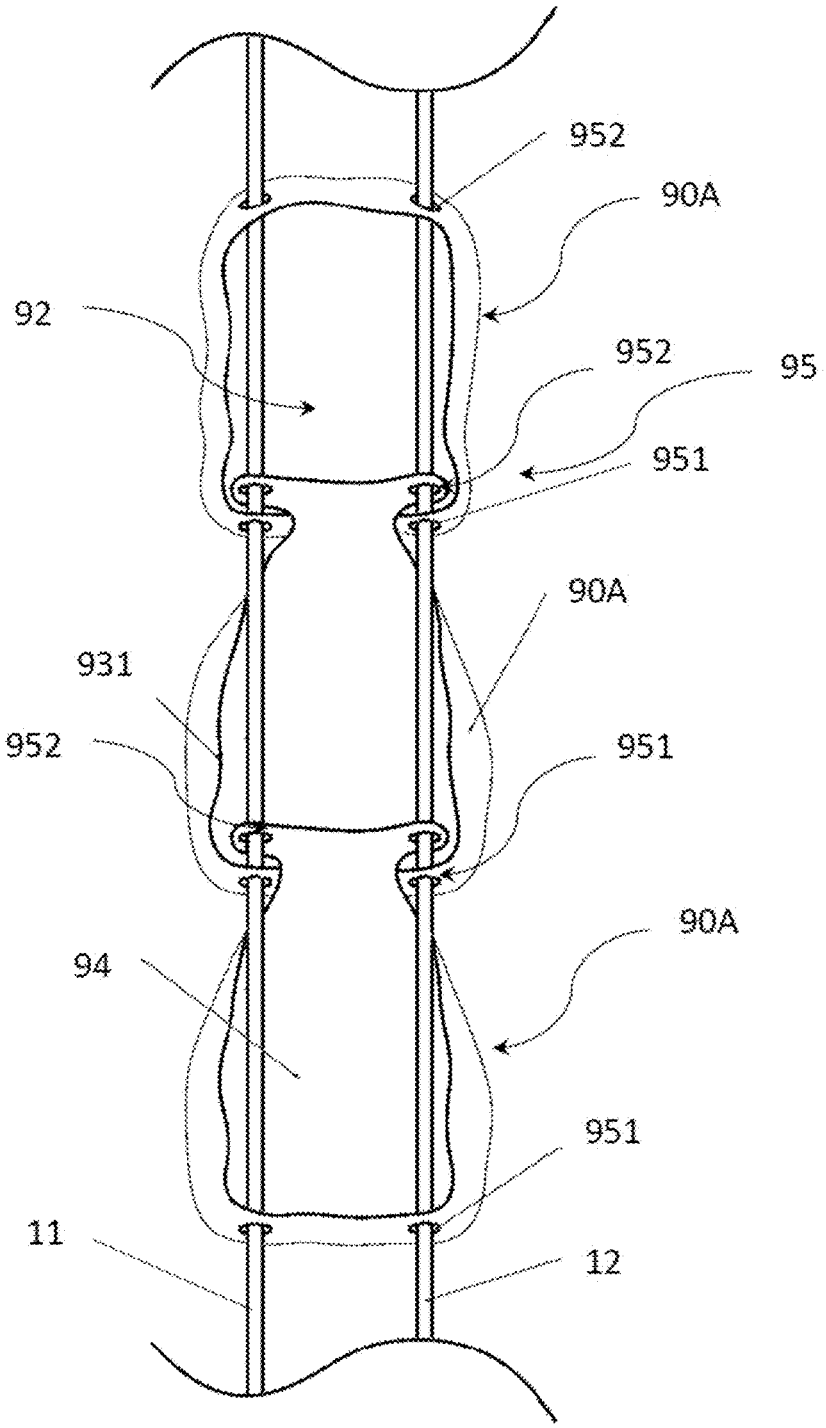
FIG. 16 is a schematic view illustrating the installation arrangement of the detachable shoe covers, according to the first alternative mode as shown in FIGS. 14A and 14B, and the dispenser apparatus according to the above preferred embodiment of the present invention.

Referring to FIG. 16, to interconnecting the detachable shoe covers 90A one-by-one in series with the two installation arms 11, 12, the rear portion of the detachable shoe cover 90A is extended in the receiving cavity 92 and positioned behind the front portion of the subsequent detachable shoe cover 90A, wherein the two rear joint perforations 952 of the detachable shoe cover 90A is aligned with the two front joint perforations 951 of the subsequent detachable shoe cover 90A allowing the two installation arms 11, 12 to penetrate through respectively so as to interconnecting the plurality of detachable shoe covers 90A along the two installation arms 11, 12 of the installation assembly 10. For illustration purpose, the detachable shoe covers 90A are stretched to open state as shown in FIG. 16 to illustrate the interconnecting configuration between the front and rear joint perforations 951, 952 and the two installation arms 11, 12. Normally, as shown in FIG. 17, the plurality of detachable shoe covers 90A installed in the installation arrangement 102 of the installation assembly 10 is stacked one-by-one in series along the two installation arms 11, 12 of the installation assembly 10 to maximize the storage capacity of the detachable shoe covers 90A.

Figure 17:
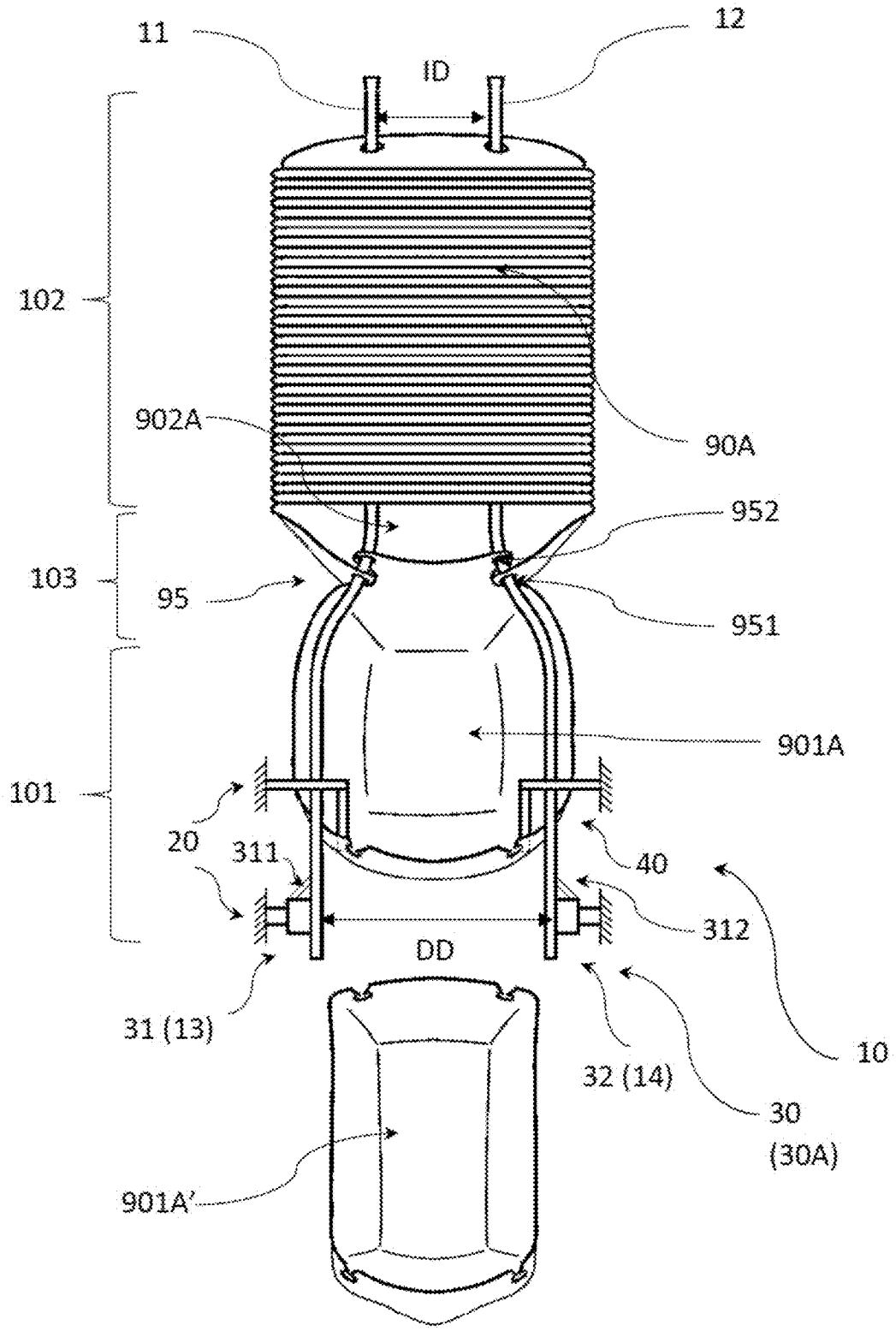
FIG. 17 is a schematic view of the dispenser apparatus installed with the detachable shoe covers, according to the first alternative mode as shown in FIGS. 14A and 14B, during dispensing of a frontmost detachable shoe cover from a subsequent detachable shoe cover according to the above preferred embodiment of the present invention.

Referring to FIG. 17, the separator 30 is preferred to be provided at a front portion of the dispenser arrangement 101, that is front ends of the installation arms 11, 12 respectively according to the preferred embodiment and configured to detach the frontmost detachable shoe cover 901A from the subsequent detachable shoe cover 902A by separating the interconnection arrangement 95, that is separating the sealing portion 97 (as shown in FIG. 15B), such that the two installation arms 11, 12 can be moved out of the front and rear joint perforations 951, 952 and thus the detachable shoe cover 90A is detached from the installation assembly 10. When the detachable line 953A is formed across the sealing portion 97, the sealing portion 97 will be separated at the detachable line 953A.

It would be even more effective in separating the sealing portion 97 when the separator 30 is a cutter separator that comprises the cutters 311, 312 which can easily cut off the sealing portions 97 of the frontmost detachable shoe cover 901A while it is pulling frontward in the dispenser arrangement 101.

It is worth mentioning that when the sealing portions 96 are cut to separate, the elastic element 96 is also cut at the sealing portion 97 but the sealing portion 97 is fused with the elastic element 96 so as to prevent the elastic element 96 from coming out and maintain the elastic holding ability of the detachable shoe cover 90A to be worn on the user's shoe.

Referring to FIG. 17, upon a pulling force is applied to the frontmost detachable shoe cover 901A frontwards, the frontmost detachable shoe cover 901A is pulled to move frontwards and be stretched out between the portions of the two installation arms 11, 12 of the dispenser arrangement 101 in the open state while the front portion of a subsequent detachable shoe cover 902A of the plurality of detachable shoe covers 90A is pulled to partially open in the transition arrangement 103 between the two installation arms 11, 12 at the same time. Since the distance between the two installation arms 11, 12 of the dispenser arrangement 101 of the installation assembly 10 is wider than that of the installation arrangement 102, when the frontmost detachable shoe cover 901A is stretched out to the dispenser arrangement 101, the transition arrangement 103 substantially forms the rear retaining configuration (or by means of the rear retaining arrangement 50 as shown in FIG. 13A and FIG. 13B in addition) to limit the rear portion of the stretched out frontmost detachable shoe cover 901A from re-stretching back to the installation arrangement 102. In addition, the front retaining configuration 40 restricts the front portion of the frontmost detachable shoe cover 901A retaining in the open state that the elastic element 96 is stretched out and extended to open the opening 94 enough for the user to place his or her shoe in the receiving cavity 92 of the detachable shoe cover 90A.

In order to dispense a detachable shoe cover 90A, the user may simply place his or her shoe in the receiving cavity 92 through the opening 94 to wear the frontmost detachable shoe cover 901A on the shoe and then move the worn frontmost detachable shoe cover 901A frontwards until the sealing portions 97 adjacent the rear joint perforations 952 of the frontmost detachable shoe cover 901A and the front joint perforations 951 of the subsequent detachable shoe cover 902A reach the separator 30. Accordingly, a continuous frontward movement of the frontmost detachable shoe cover 901A away from the dispenser arrangement 101 not only pulls the sealing portions 97 against the separator 30 until the sealing portions 97 are broken by the separator 30 or cut off by the cutter separator 30A to detach the frontmost detachable shoe cover 901A from the subsequent detachable shoe cover 902A and separate from the installation assembly 10 to form a detached detachable shoe cover 901A' worn on the user's shoe, wherein the previously subsequent detachable shoe cover 902A is also pulled to move the dispenser arrangement 101 becoming the frontmost detachable shoe cover 901A being opened in the dispenser arrangement 101 for wearing and the next detachable shoe cover 90A interconnecting with the original subsequent detachable shoe cover 902A is also pulled frontwards to be partially opened at the transition arrangement 103 and forms the current subsequent detachable shoe cover 902A of the current frontmost detachable shoe cover 901A.

Figure 18:
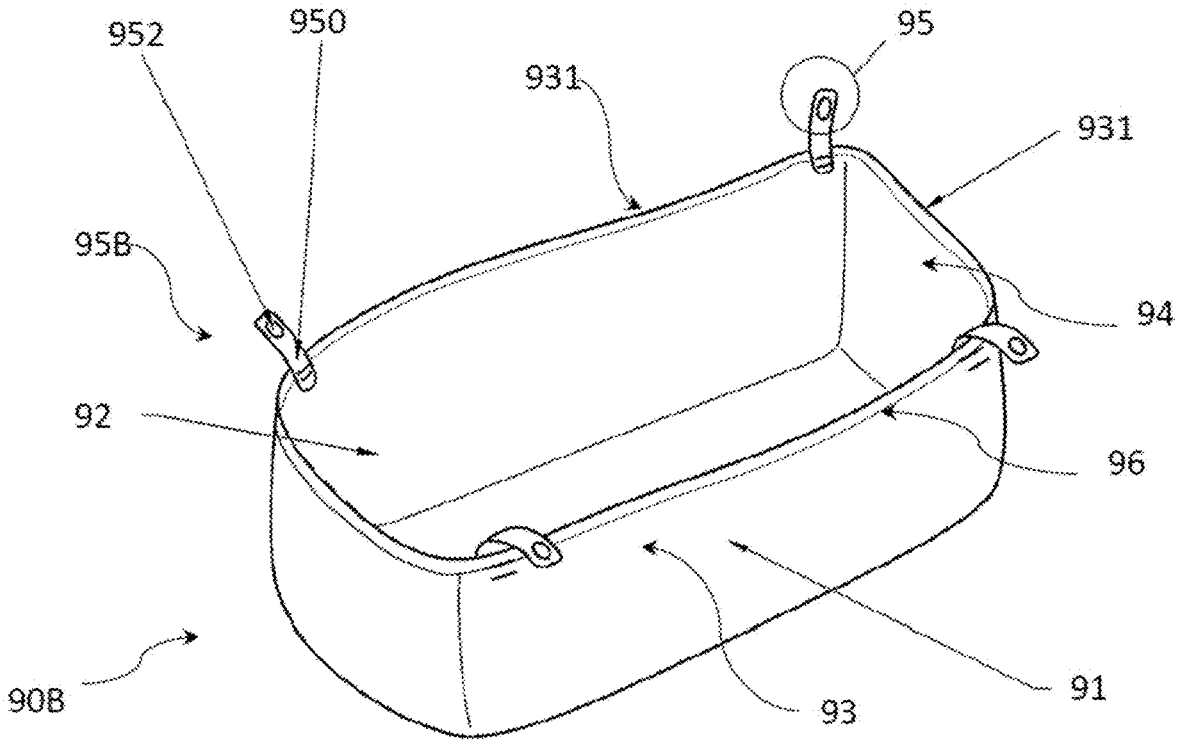
FIG. 18 is a schematic view of a second alternative mode of the detachable shoe cover according to the above preferred embodiment of the present invention.
Figure 19:
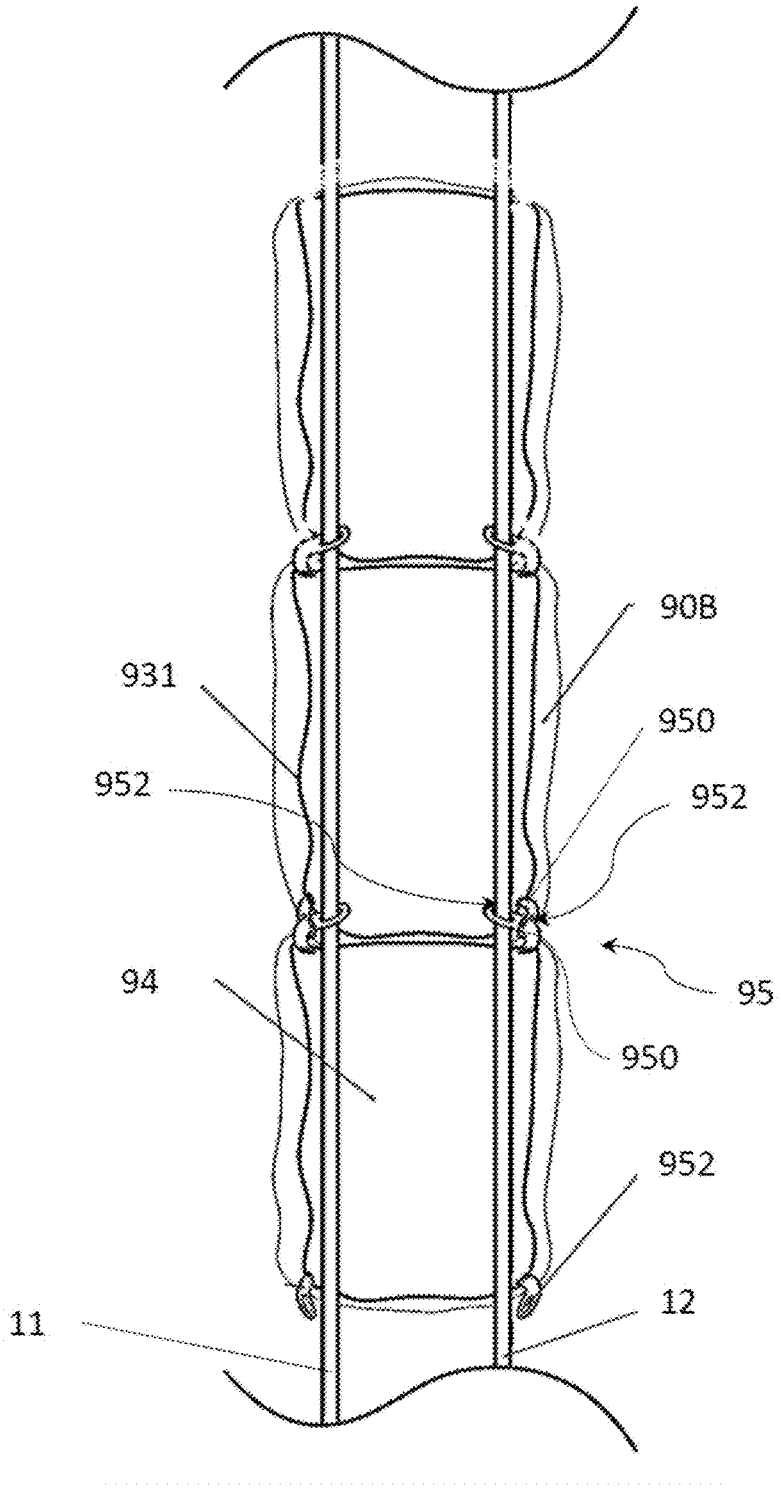
FIG. 19 is a schematic view illustrating the installation arrangement of the detachable shoe covers, according to the second alternative mode as shown in FIG. 17, and the dispenser apparatus according to the above preferred embodiment of the present invention.
Figure 20:
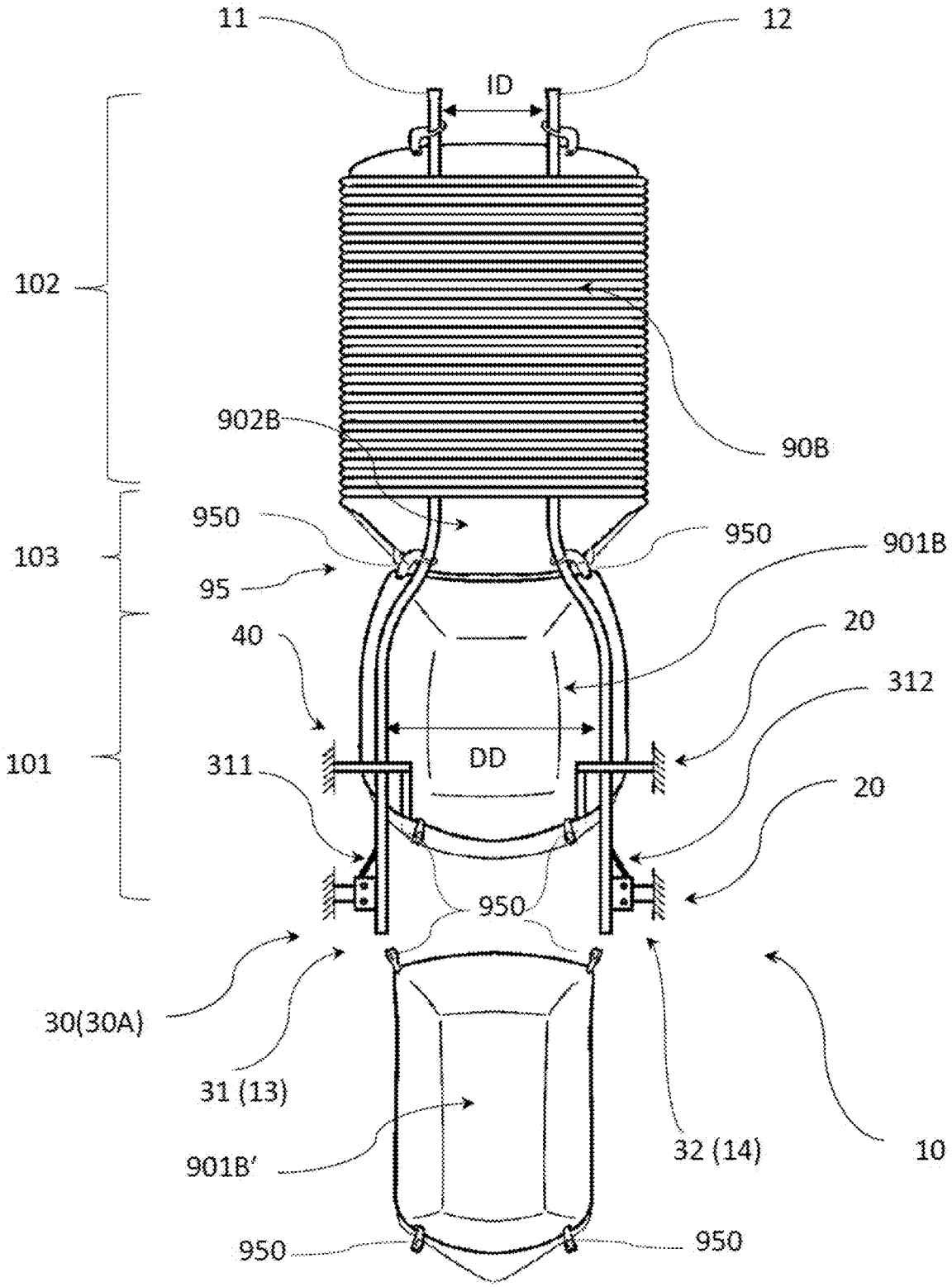
FIG. 20 is a schematic view of the dispenser apparatus installed with the detachable shoe covers, according to the second alternative mode as shown in FIG. 17, during dispensing of a frontmost detachable shoe cover from a subsequent detachable shoe cover according to the above preferred embodiment of the present invention.

Referring to FIG. 18 to FIG. 20, a second alternative mode of the detachable shoe cover 90B according to the present invention is illustrated, wherein the detachable shoe cover 90B has the same configuration as the detachable shoe cover 90 as shown in FIG. 5A that comprises the shoe cover main body 91 having the receiving cavity 92, the elastic opening edge portion 93 defining the opening 94, and the interconnection arrangement 95 for interconnecting the detachable shoe covers 90B to be installed in the dispenser apparatus. Similarly, each of the detachable shoe covers 90B further comprises an elastic element 96 provided around an opening edge 931 of the elastic opening edge portion 93 to provide an elastic effect for being stretched to open the opening 94 for wearing on a shoe of a user and to retracted to reduce a size of the opening 94 for holding on the shoe of the user. The different of the second alternative mode of the detachable shoe cover 90B and the detachable shoe cover 90 as shown in FIG. 5A is that the two front joint perforations 951 of the interconnection arrangement 95 are replaced with another two interconnection members 950 each of which has a joint perforation 952 therein as shown in FIG. 5C.

Referring to FIG. 19, to interconnecting the detachable shoe covers 90B one-by-one in series with the two installation arms 11, 12, the two rear interconnection members 950 of each of the detachable shoe covers 90B are penetrated through the two joint perforations 952 of the front interconnection members 950 a subsequent detachable shoe cover 90B respectively. Then, the two interconnection members 950 of the two rear interconnection members 950 are hanged to the two installation arms 11, 12 respectively by penetrating the two installation arms 11, 12 through the two joint perforations 952 of the two rear interconnection members 950 respectively, such that the plurality of detachable shoe covers 90B are installed along the two installation arms 11, 12 of the installation assembly 10. For illustration purpose, the detachable shoe covers 90B are stretched to open state as shown in FIG. 19 to illustrate the interconnecting configuration between the front and rear pairs of interconnection members 950, the joint perforations 952 of the front and rear pairs of interconnection members 950, and the two installation arms 11, 12. Normally, as shown in FIG. 20, the plurality of detachable shoe covers 90B installed in the installation arrangement 102 of the installation assembly 10 is stacked one-by-one in series along the two installation arms 11, 12 of the installation assembly 10 to maximize the storage capacity of the detachable shoe covers 90B.

Referring to FIG. 20, the separator 30 is preferred to be provided at a front portion of the dispenser arrangement 101, that is the separating members 31, 32 are respectively provided at front ends of the installation arms 11, 12 according to the preferred embodiment and configured to detach the frontmost detachable shoe cover 901B from the subsequent detachable shoe cover 902B by separating the interconnection arrangement 95, that is separating the rear interconnection members 950 at the detachable lines 953 thereon, as shown in FIG. 5C. Upon a pulling force is applied to the frontmost detachable shoe cover 901B frontwards, the frontmost detachable shoe cover 901B is pulled to move frontwards and be stretched out between the portions of the two installation arms 11, 12 of the dispenser arrangement 101 in the open state while the front portion of a subsequent detachable shoe cover 902B of the plurality of detachable shoe covers 90B is pulled to partially open in the transition arrangement 103 between the two installation arms 11, 12 at the same time. Since the distance between the two installation arms 11, 12 of the dispenser arrangement 101 of the installation assembly 10 is wider than that of the installation arrangement 102, when the frontmost detachable shoe cover 901B is stretched out to the dispenser arrangement 101, the transition arrangement 103 substantially forms the rear retaining configuration (or by means of the rear retaining arrangement 50 as shown in FIG. 13A and FIG. 13B in addition) to limit the rear portion of the stretched out frontmost detachable shoe cover 901B from re-stretching back to the installation arrangement 102. In addition, the front retaining configuration 40 restricts the front portion of the frontmost detachable shoe cover 901B retaining in the open state that the elastic element 96 is stretched out and extended to open the opening 94 enough for the user to place his or her shoe in the receiving cavity 92 of the detachable shoe cover 90B, as shown in FIG. 20.

In view of FIG. 20, in order to dispense a detachable shoe cover 90A, the user may simply place his or her shoe in the receiving cavity 92 through the opening 94 to wear the frontmost detachable shoe cover 901A on the shoe and then move the worn frontmost detachable shoe cover 901A frontwards until the two interconnection members 950 reach the separator 30. Accordingly, a continuous frontward movement of the frontmost detachable shoe cover 901A away from the dispenser arrangement 101 not only pulls the interconnection members 950 against the separator 30 until the rear interconnection members 950 is broken by the separator 30 to detach the frontmost detachable shoe cover 901A from the subsequent detachable shoe cover 902A and separate from the installation assembly 10 to form a detached detachable shoe cover 901A' worn on the user's shoe, wherein the previously subsequent detachable shoe cover 902A is also pulled to move the dispenser arrangement 101 becoming the frontmost detachable shoe cover 901A being opened in the dispenser arrangement 101 for wearing and the next detachable shoe cover 90A interconnecting with the original subsequent detachable shoe cover 902A is also pulled frontwards to be partially opened at the transition arrangement 103 and forms the current subsequent detachable shoe cover 902A of the current frontmost detachable shoe cover 901A.

Figure 21A:
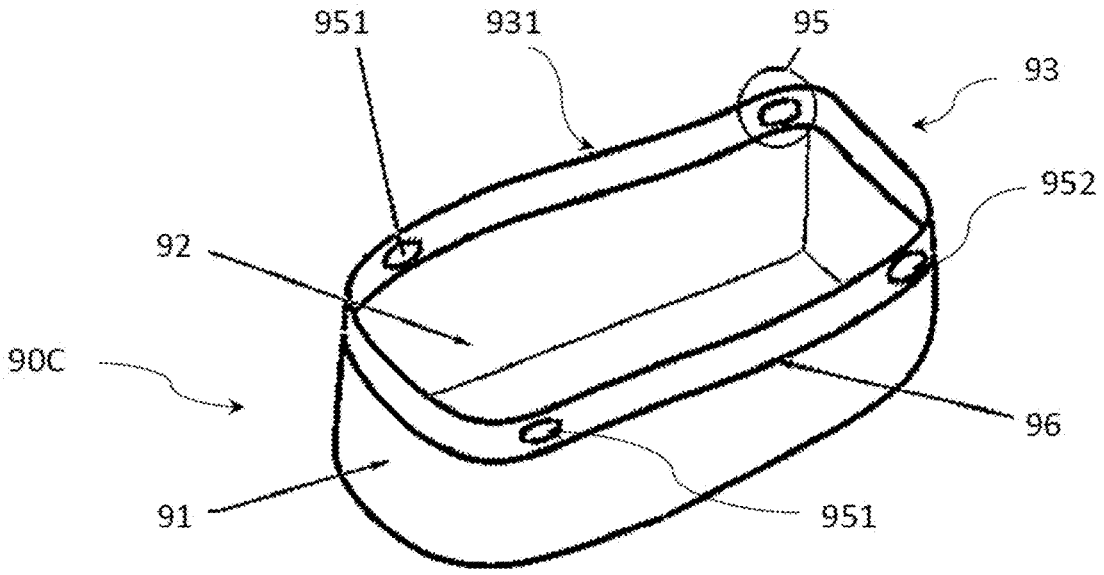
FIG. 21A is a schematic view of a third alternative mode of the detachable shoe cover according to the above preferred embodiment of the present invention.
Figure 21B:
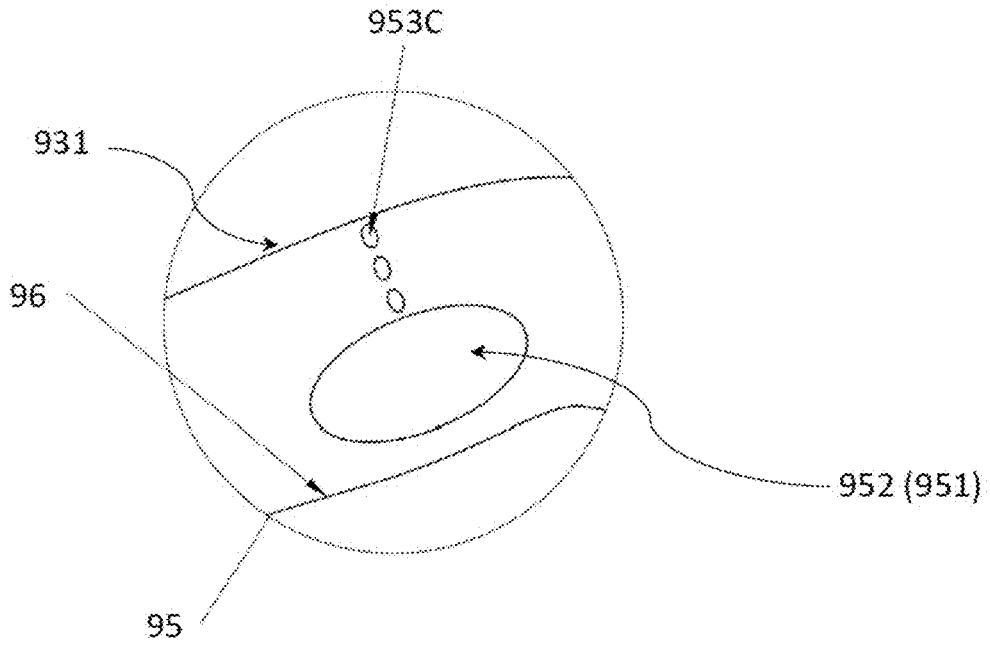
FIG. 21B is an enlarged view illustrating the detachable connection arrangement of the third alternative mode of the detachable shoe cover according to the above preferred embodiment of the present invention.
Figure 22:
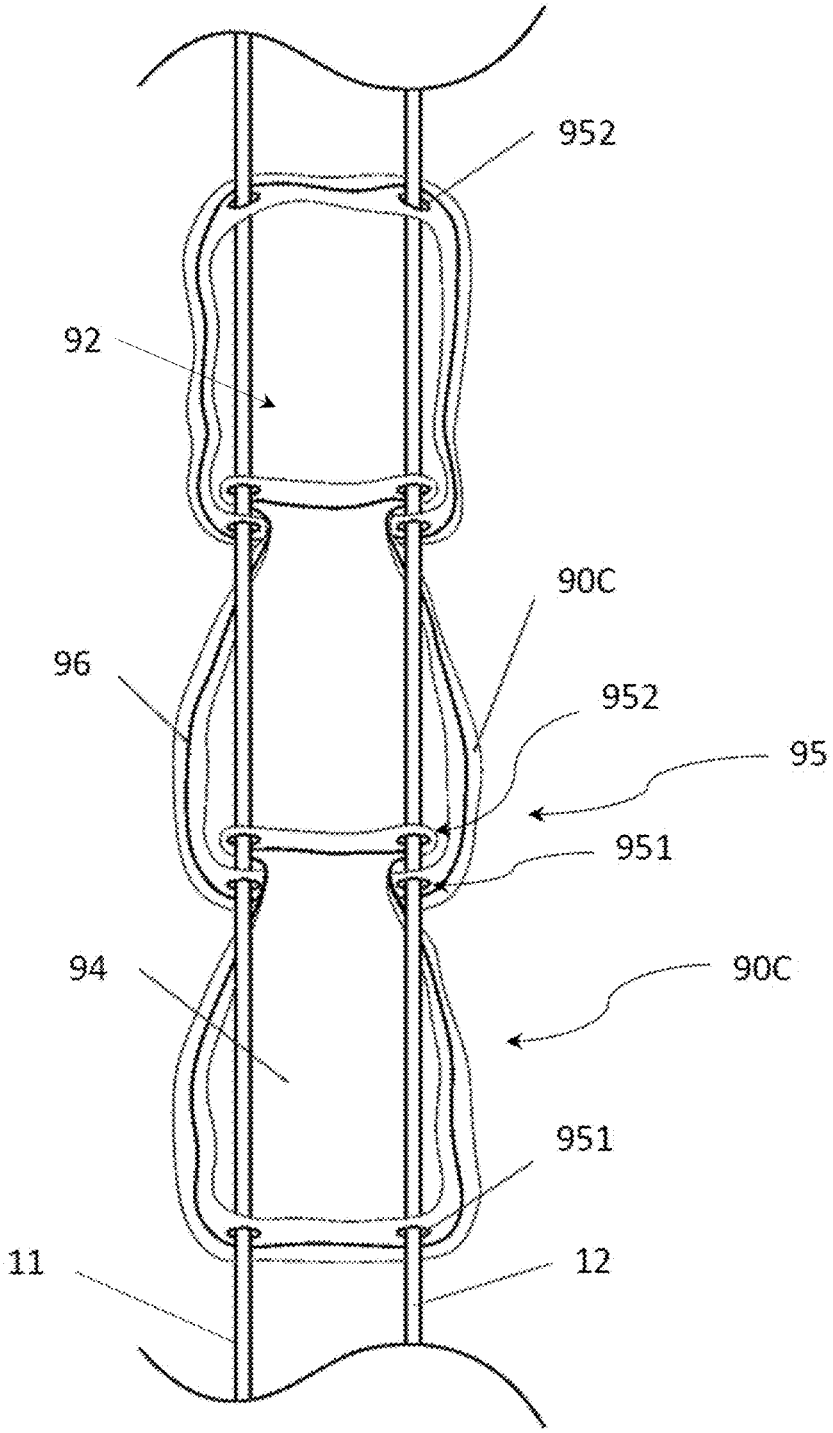
FIG. 22 is a schematic view illustrating the installation arrangement of the detachable shoe covers, according to the third alternative mode as shown in FIG. 20, and the dispenser apparatus according to the above preferred embodiment of the present invention.

Referring to FIG. 21A to FIG. 22, a third alternative mode of the detachable shoe cover 90C is illustrated, wherein the third alternative mode of the detachable shoe cover 90C is similar to the first alternative mode of the detachable shoe cover 90A, wherein the interconnection arrangement 95 is configured by the two front joint perforations 951 and two rear joint perforations 952 as shown in FIG. 21A. However, the different between the third alternative mode of the detachable shoe cover 90C is similar to the first alternative mode of the detachable shoe cover 90A is that the ring shape elastic element 96 is formed below the front and rear joint perforations 951, 952 of the interconnection arrangement 95 while the four detachable lines 953C are respectively extended from the opening edge 931 and the front and rear joint perforations 951, 952, so that no sealing portion 97 is required. Since the elastic element 96 is provided below the front and rear joint perforations 951, 952, when the detachable lines 953C are cut off to separate by the separator 30 (or the cutter separator 30A), the elastic element 96 will not be cut off for wearing on the user's shoe.

Figure 23:
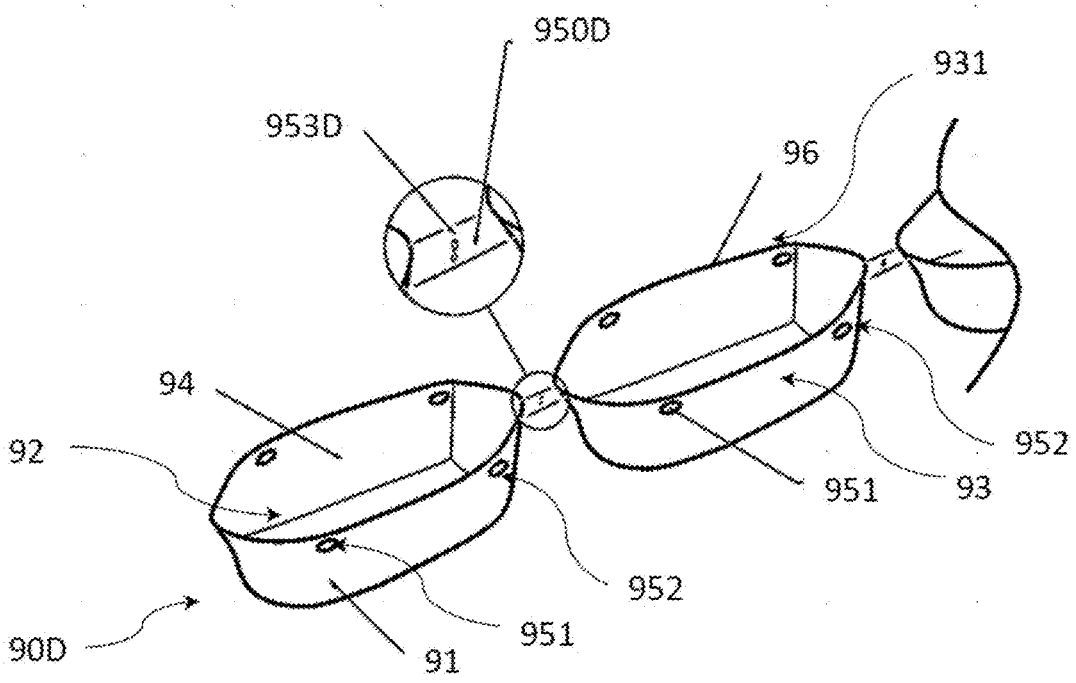
FIG. 23 is a schematic view of a fourth alternative mode of the detachable shoe cover according to the above preferred embodiment of the present invention.
Figure 24:
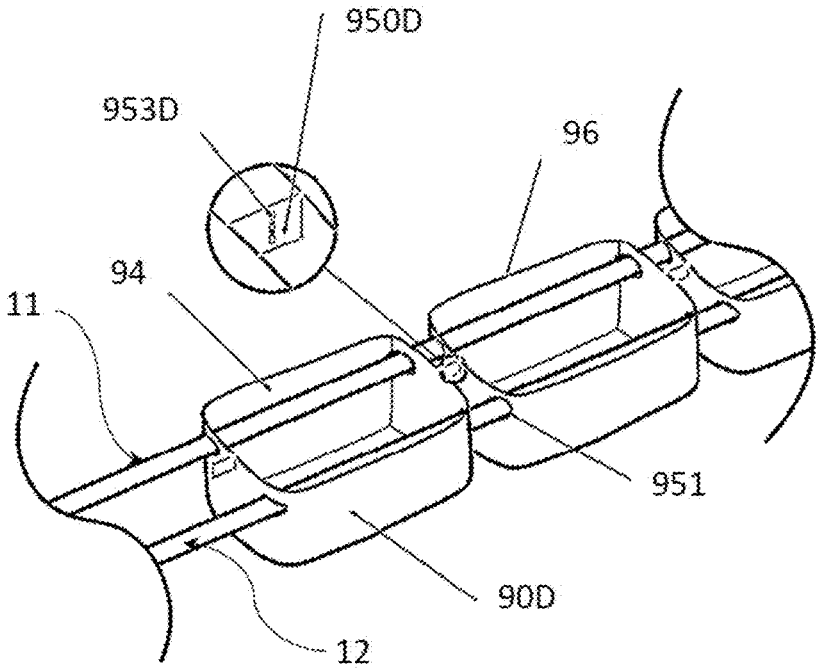
FIG. 24 is a schematic view illustrating the installation arrangement of the detachable shoe covers, according to the fourth alternative mode as shown in FIG. 20, and the dispenser apparatus according to the above preferred embodiment of the present invention.
Figure 25:
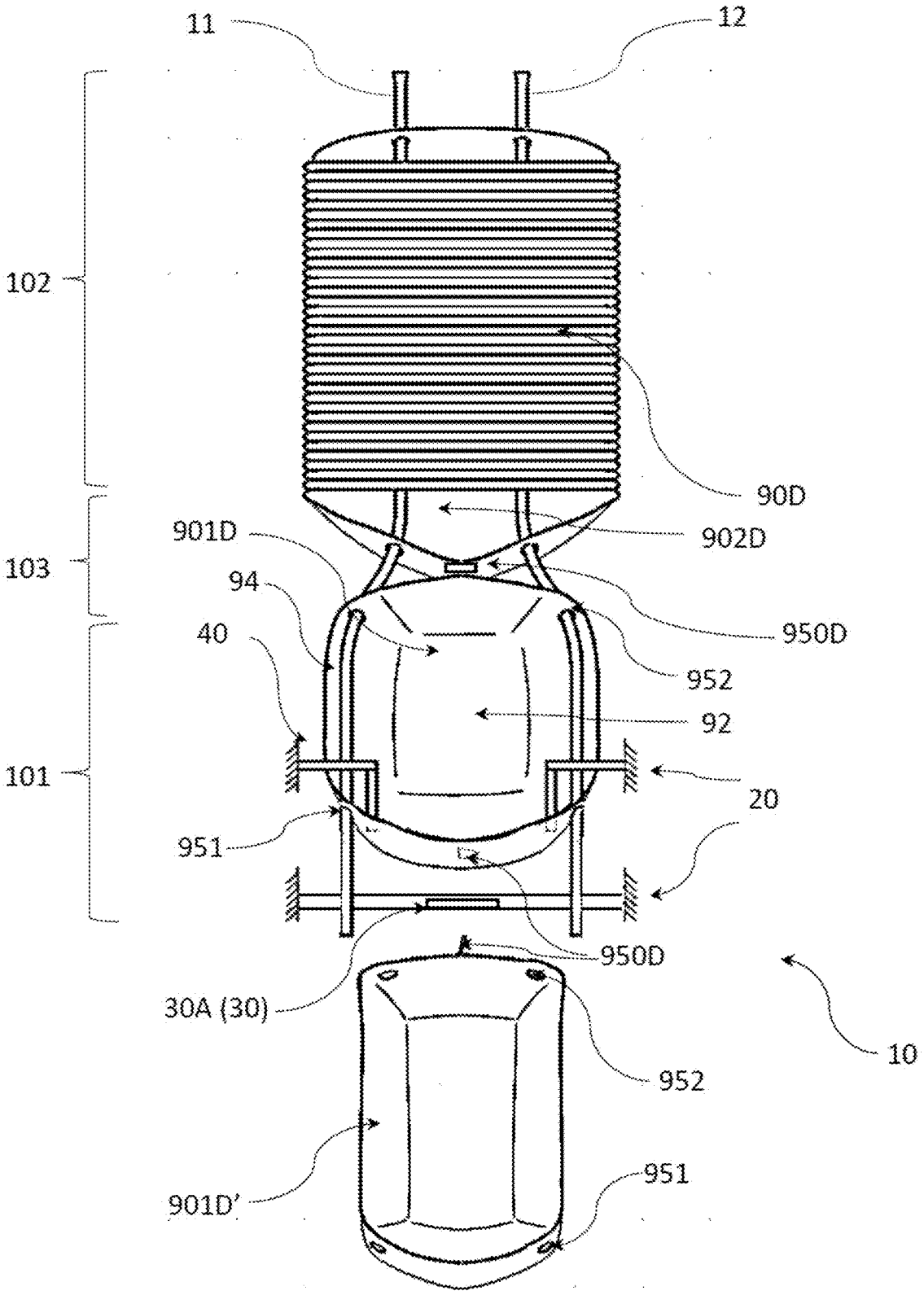
FIG. 25 is a schematic view of the dispenser apparatus installed with the detachable shoe covers, according to the fourth alternative mode as shown in FIG. 20, during dispensing of a frontmost detachable shoe cover from a subsequent detachable shoe cover according to the above preferred embodiment of the present invention.

Referring to FIG. 23 to FIG. 25, a fourth alternative mode of detachable shoe cover 90D is illustrated. The detachable shoe cover 90D may have a structure similar to the first alternative mode of the detachable shoe cover 90A that comprises the shoe cover main body 91 having the receiving cavity 92, the elastic opening edge portion 93 defining the opening 94, and the interconnection arrangement 95 for interconnecting the detachable shoe covers 90D to be installed in the dispenser apparatus, as shown in FIG. 23. The different between the fourth alternative mode of the detachable shoe cover 90D and the above first and third disclosed detachable shoe cover 90A, 90C is that the ring shape elastic element 96 provided at the opening edge 931 of the elastic opening edge portion 93 to provide the elastic effect for being stretched to open the opening 94 for wearing on a shoe of a user and to retracted to reduce a size of the opening 94 for holding on the shoe of the user, and that the two installation arms 11, 12 of the installation assembly 10 are directly penetrating through the front and rear joint perforations 951, 952 of the interconnection arrangement 95, as shown in FIG. 24. In addition, the interconnection arrangement 95 further comprises an interconnection member 950D connecting the rear portion of the detachable shoe cover 90D with the front portion of another subsequent detachable shoe cover 90D, wherein a detachable line 953D is formed across the interconnection member 950D, so as to interconnect the plurality of detachable shoe covers 90D one-by-one in series while installed in the installation assembly 10 by penetrating the two installation arms 11, 12 through the front and rear joint perforations 951, 952 of the detachable shoe covers 90D as shown in FIG. 24 and FIG. 25.

For illustration purpose, the detachable shoe covers 90D are stretched to open state as shown in FIG. 24 to illustrate the interconnecting configuration of the interconnection members 950D, the front and rear joint perforations 951, 952 and the two installation arms 11, 12. Normally, as shown in FIG. 25, the plurality of detachable shoe covers 90A installed in the installation arrangement 102 of the installation assembly 10 is stacked one-by-one in series along the two installation arms 11, 12 of the installation assembly 10 to maximize the storage capacity of the detachable shoe covers 90D.

Referring to FIG. 25, the separator 30 is preferred to be a cutter separator 30D provided between the two installation arms 11, 12 at the front portion of the dispenser arrangement 101, that is the two separating members 31, 32 are respectively provided at front ends of the installation arms 11, 12 and configured to cut off the interconnection member 950D between the frontmost detachable shoe cover 901D and the subsequent detachable shoe cover 902D so as to detach the frontmost detachable shoe cover 901D from the subsequent detachable shoe cover 902D. In detail, upon a pulling force is applied to the frontmost detachable shoe cover 901D frontwards, the frontmost detachable shoe cover 901D is pulled to move frontwards and be stretched out between the portions of the two installation arms 11, 12 of the dispenser arrangement 101 in the open state while the front portion of a subsequent detachable shoe cover 902A of the plurality of detachable shoe covers 90A is pulled to partially open in the transition arrangement 103 between the two installation arms 11, 12 at the same time. Since the distance between the two installation arms 11, 12 of the dispenser arrangement 101 of the installation assembly 10 is wider than that of the installation arrangement 102, when the frontmost detachable shoe cover 901D is stretched out to the dispenser arrangement 101, the transition arrangement 103 substantially forms the rear retaining configuration (or by means of the rear retaining arrangement 50 as shown in FIG. 13A and FIG. 13B in addition) to limit the rear portion of the stretched out frontmost detachable shoe cover 901D from re-stretching back to the installation arrangement 102. In addition, the front retaining configuration 40 restricts the front portion of the frontmost detachable shoe cover 901D retaining in the open state that the elastic element 96 is stretched out and extended to open the opening 94 enough for the user to place his or her shoe in the receiving cavity 92 of the detachable shoe cover 90D.

Similarly, in order to dispense a detachable shoe cover 90D, the user may simply place his or her shoe in the receiving cavity 92 through the opening 94 to wear the frontmost detachable shoe cover 901D on the shoe and then move the worn frontmost detachable shoe cover 901D frontwards until the interconnection member 950D reaches the separator 30 (cutter separator 30A). Accordingly, a continuous frontward movement of the frontmost detachable shoe cover 901D away from the dispenser arrangement 101 not only pulls the interconnection member 950D against the separator 30 until the interconnection member 950D is broken by the separator 30 or cut off by the cutter separator 30A to detach the frontmost detachable shoe cover 901D from the subsequent detachable shoe cover 902D and separate from the installation assembly 10, wherein the front and rear joint perforations 951, 952 of the frontmost detachable shoe cover 901D are slid out of the two installation arms 11, 12 to form a detached detachable shoe cover 901D' worn on the user's shoe. Then, the previously subsequent detachable shoe cover 902D is also pulled to move the dispenser arrangement 101 becoming the frontmost detachable shoe cover 901D being opened in the dispenser arrangement 101 for wearing and the next detachable shoe cover 90D interconnecting with the original subsequent detachable shoe cover 902D is also pulled frontwards to be partially opened at the transition arrangement 103 and forms the current subsequent detachable shoe cover 902D of the current frontmost detachable shoe cover 901D.

The separating operations of various separators 30 of the dispenser apparatus with respect to various modes of the detachable shoe covers 90 according to the present invention are illustrated as examples referencing FIG. 26A to FIG. 31C as follows.

Figure 26A:
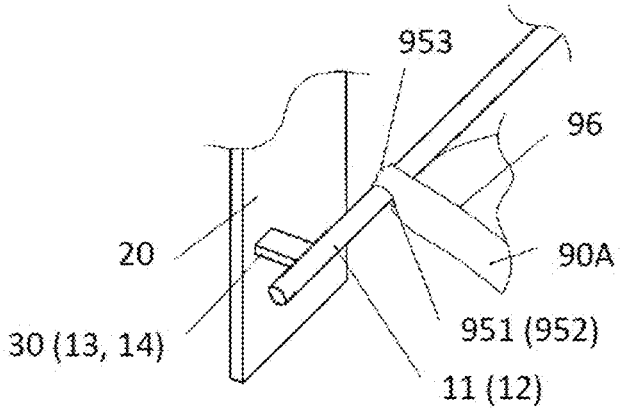
FIG. 26A to FIG. 26C are schematic views illustrating a separating operation of the frontmost shoe cover as well as the first alternative mode thereof by the separator of the dispenser apparatus according to the above preferred embodiment of the present invention
Figure 26B:
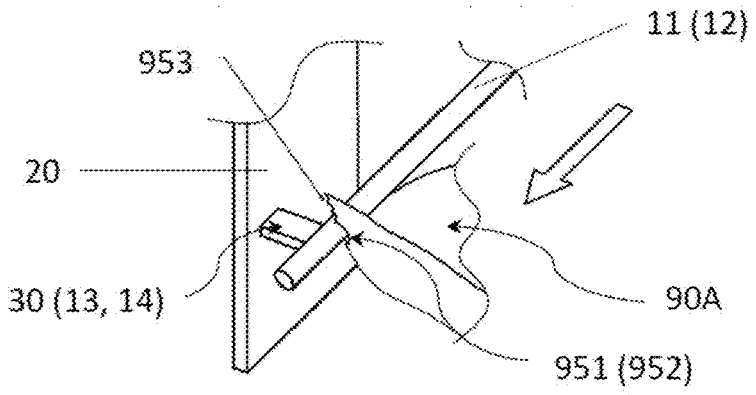
Figure 26C:
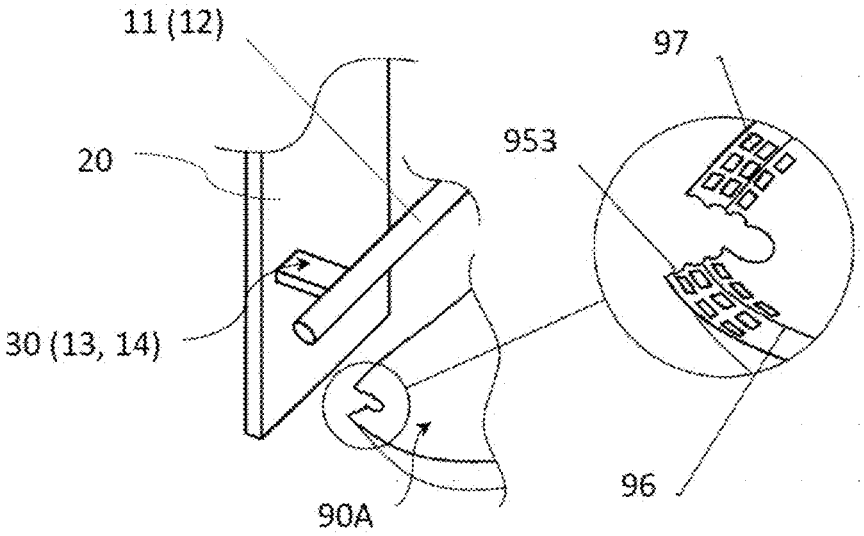
Figure 29A:
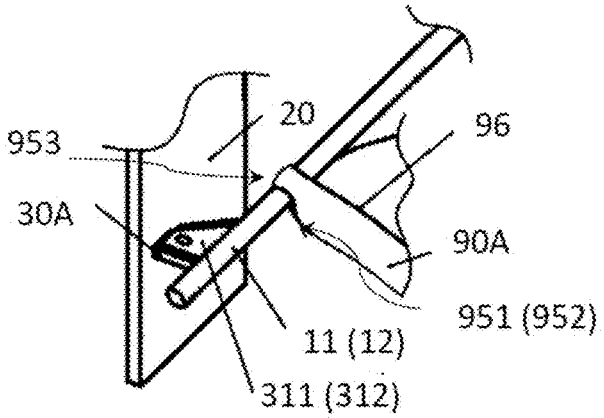
FIG. 29A to FIG. 29C are schematic views illustrating a separating operation of the frontmost shoe cover as well as the first alternative mode thereof by the cutter separator of the dispenser apparatus according to the above preferred embodiment of the present invention.
Figure 29B:
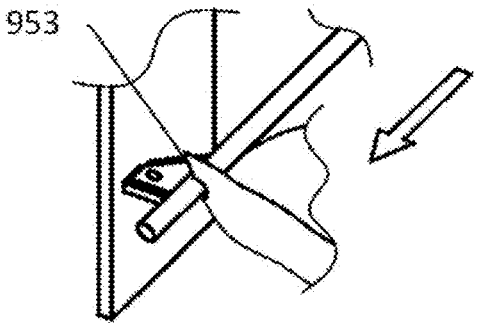
Figure 29C:
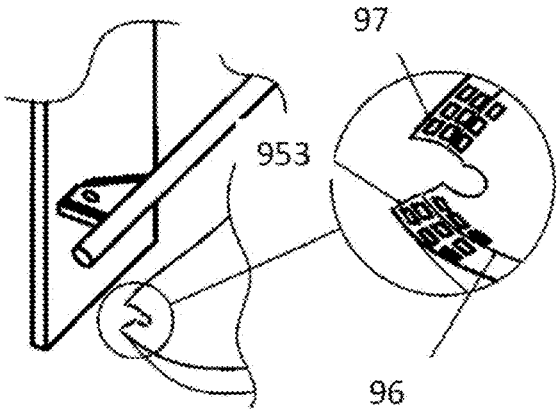

As shown in FIG. 26A to FIG. 26C, the connector 13, 14 of the installation assembly 10 as shown in FIG. 7A is embodied as the separator 30 to separate the first alternative mode of the detachable shoe cover 90A as shown in FIG. 15A and FIG. 15B, wherein when the detachable shoe cover 90A is moving forwards, the detachable line 953 is arranged to position along an outer side of the installation arm 11, 12, as shown in FIG. 26A. While the detachable shoe cover 90A is continuously moving forwards until the front joint perforation 951 reaches the separator 30, the frontward pulling force will tear or cut off the detachable line 953 to separate the detachable shoe cover 90A from the installation arm 11, 12, as shown in FIG. 26B, wherein the elastic element 96 retracts as usual due to the reinforcing of the sealing portion 97, as shown in FIG. 26C. FIG. 29A to FIG. 29C illustrates the same separating operation as in FIG. 26A to FIG. 26C while the separator 30 is the cutter separator 30A that facilitates the separation by cutting off with the cutting blade 311, 312.

Figure 27A:
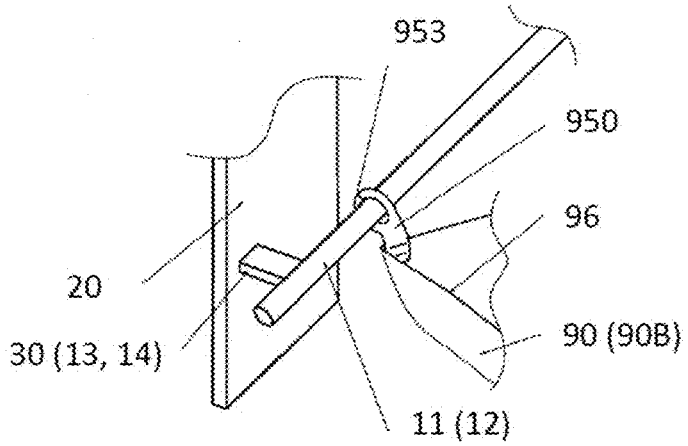
FIG. 27A to FIG. 27C are schematic views illustrating a separating operation of the frontmost shoe cover as well as the second alternative mode thereof by the separator of the dispenser apparatus according to the above preferred embodiment of the present invention.
Figure 27B:
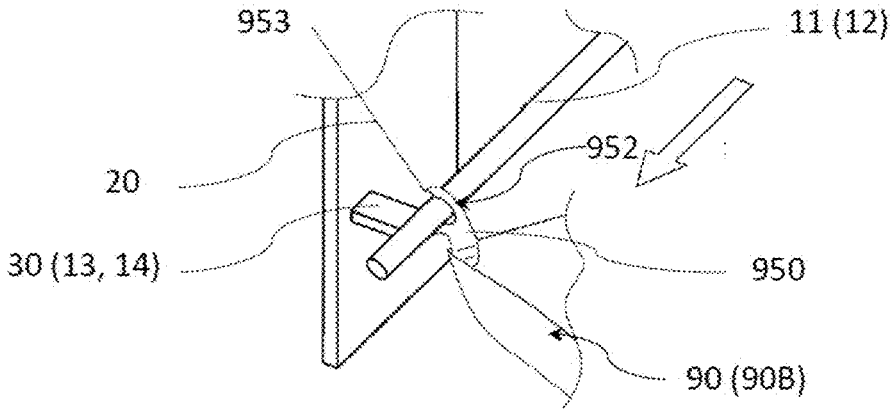
Figure 27C:
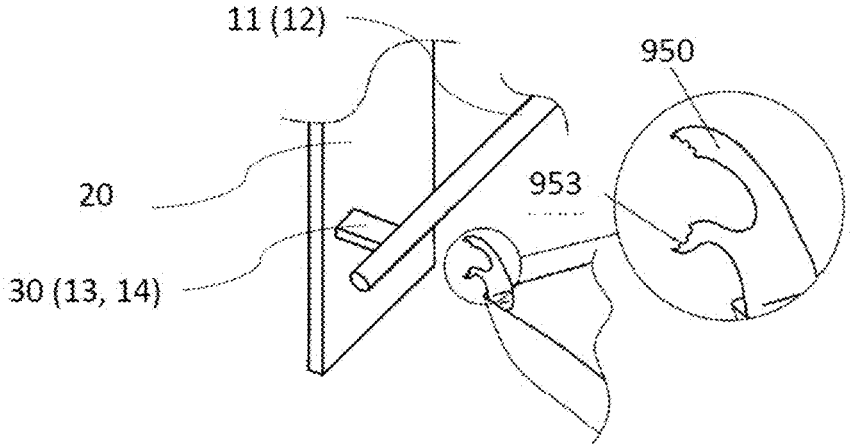
Figure 30A:
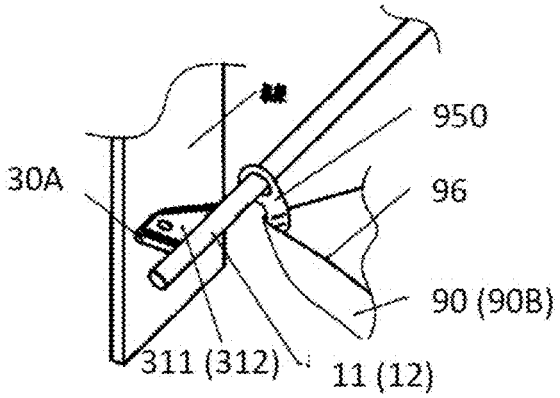
FIG. 30A to FIG. 30C are schematic views illustrating a separating operation of the frontmost shoe cover as well as the second alternative mode thereof by the cutter separator of the dispenser apparatus according to the above preferred embodiment of the present invention.
Figure 30B:
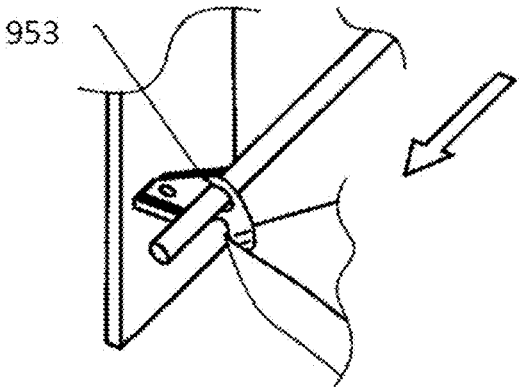
Figure 30C:
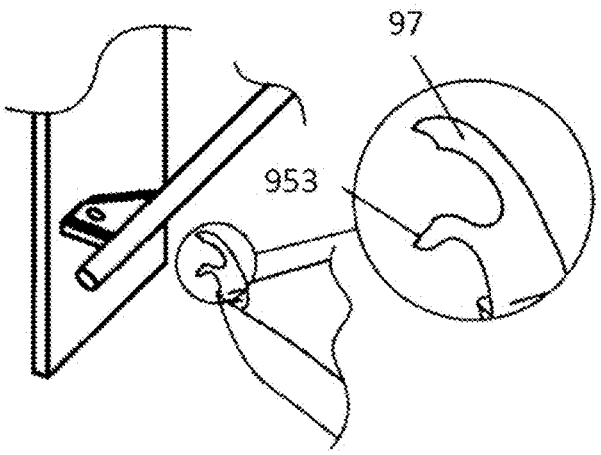

As shown in FIG. 27A to FIG. 27C, the connector 13, 14 of the installation assembly 10 as shown in FIG. 7A is embodied as the separator 30 to separate the interconnection member 950 of the detachable shoe cover 90 as shown in FIG. 5A and FIG. 5C and the second alternative mode of the detachable shoe cover 90B as shown in FIG. 18, wherein when the interconnection member 950 of the detachable shoe cover 90, 90B is moving forwards, the detachable line 953 is arranged to position along an outer side of the installation arm 11, 12, as shown in FIG. 27A. While the detachable shoe cover 90A is continuously moving forwards until the interconnection member 950 reaches the separator 30 as show in FIG. 27B, the frontward pulling force will tear or cut off the detachable line 953 to separate the interconnection member 950 from the installation arm 11, 12, as shown in FIG. 27C. FIG. 30A to FIG. 30C illustrates the same separating operation as in FIG. 27A to FIG. 27C while the separator 30 is the cutter separator 30A that facilitates the separation by cutting off with the cutting blade 311, 312.

Figure 28A:
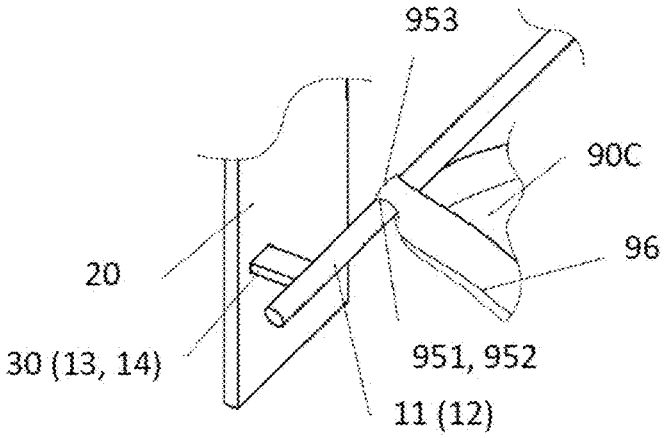
FIG. 28A to FIG. 28C are schematic views illustrating a separating operation of the frontmost shoe cover as well as the third alternative mode thereof by the separator of the dispenser apparatus according to the above preferred embodiment of the present invention.
Figure 28B:
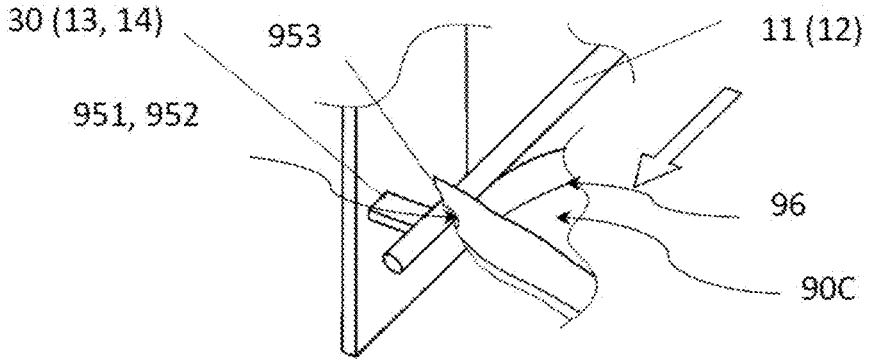
Figure 28C:
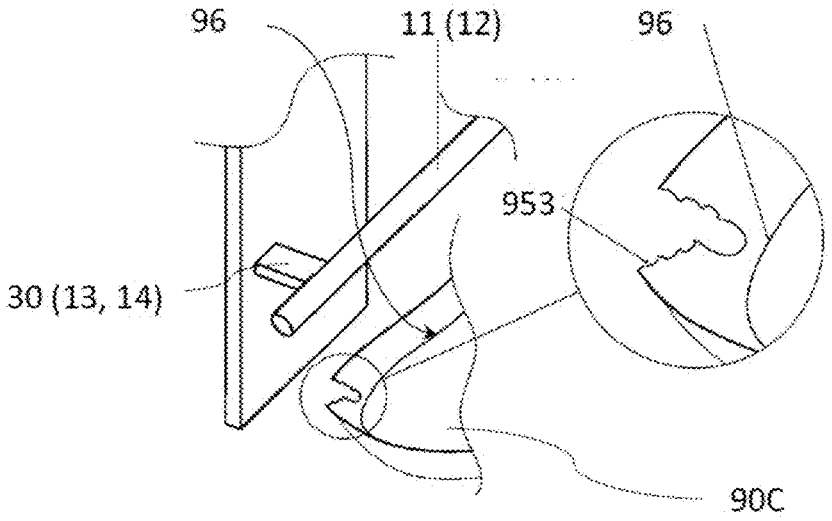
Figure 31A:
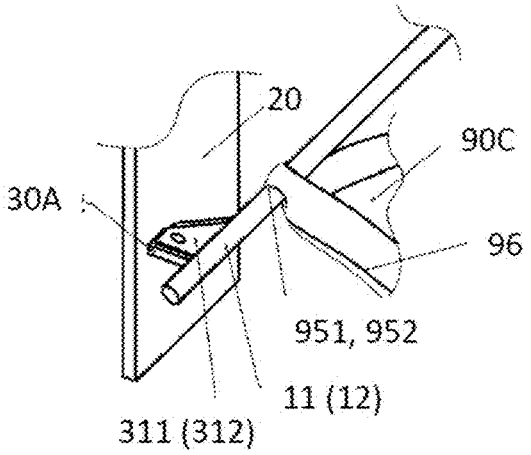
FIG. 31A to FIG. 31C are schematic views illustrating a separating operation of the frontmost shoe cover as well as the third alternative mode thereof by the cutter separator of the dispenser apparatus according to the above preferred embodiment of the present invention.
Figure 31B:
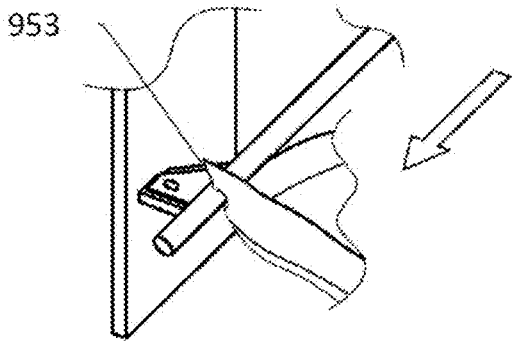
Figure 31C:
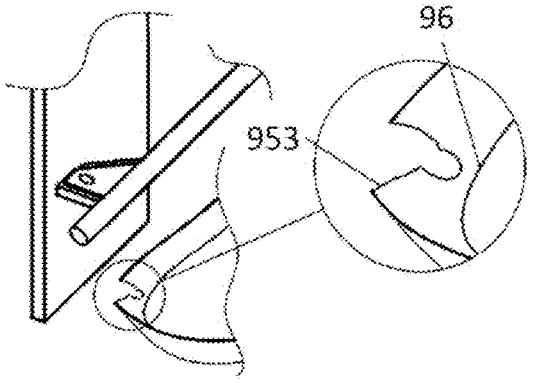

As shown in FIG. 28A to FIG. 28C, the connector 13, 14 of the installation assembly 10 as shown in FIG. 7A is embodied as the separator 30 to separate the third alternative mode of the detachable shoe cover 90C as shown in FIG. 21A and FIG. 21B, wherein when the detachable shoe cover 90C is moving forwards, the detachable line 953 is arranged to position along an outer side of the installation arm 11, 12, as shown in FIG. 28A. While the detachable shoe cover 90C is continuously moving forwards until the front joint perforation 951 reaches the separator 30, the frontward pulling force will tear or cut off the detachable line 953 to separate the detachable shoe cover 90C from the installation arm 11, 12, as shown in FIG. 28B, wherein the elastic element 96 positioned below the front and rear joint perforations 951, 952 retracts as usual, as shown in FIG. 28C. FIG. 31A to FIG. 31C illustrates the same separating operation as in FIG. 28A to FIG. 28C while the separator 30 is the cutter separator 30A that facilitates the separation by cutting off with the cutting blade 311, 312.

In view of above, the installation arms 11, 12 are stationary mounted to the frame 20 for steady and smooth guiding of the detachable shoe covers 90 (90A-90D) to move to the dispenser arrangement as the frontmost detachable shoe cover 901 in turn to open the opening 94 of the receiving cavity 92 thereof by the front retaining configuration 40 and the rear retaining arrangement 50 and providing a firm support of the frontmost detachable shoe cover 901 for user to place his or her shoe in the receiving cavity 92 thereof. The arrangement of the connectors 13,14 and/or the separating members 31, 32 of the separator 30 with respect to the installation arms 11, 12 respectively not only provides the firm support of the frontmost detachable shoe cover 901 but also collaborates with the interconnection arrangement 95 of the detachable shoe cover 90, including the interconnection member 950, the joint perforations 951, 952, the sealing portion 97, and/or the detachable line 953 of various modes of the detachable shoe cover 90 (90A-90D), to break the opening edge portions 93 adjacent the joint perforations 951, 952 or the interconnection member 950, so that the frontmost detachable shoe cover 901 can break away and disconnect from the installation arms 11, 12 of the installation assembly 10. When a cutter separator 30A is embodied, the breaking away of the frontmost detachable shoe cover 90 (90A-90D) is even more easy and precise by cutting the opening edge portion 93 or the interconnection member 950.

Accordingly, the method of dispensing detachable shoe covers installed in the dispenser apparatus of the present invention includes the following steps:

(a) guiding a plurality of interconnecting detachable shoe covers 90 (90A-90D) to move from the installation arrangement 102 to the dispenser arrangement 101 provided at the front end portions 111, 121 by the pair of installation arms 11, 12 of the installation assembly 10;

(b) opening a frontmost detachable shoe cover 901 of the plurality of detachable shoe covers 90 (90A-90D) at the dispenser arrangement 101 for wearing the frontmost detachable shoe cover 901 on the shoe of the user placed in the receiving cavity 92 through the opening 94 thereof; and (c) separating the frontmost detachable shoe cover 901 from a subsequent detachable shoe cover 902 of the plurality of detachable shoe covers 90 (90A-90D), by the separator 30 (30A) arranged at the dispenser arrangement 101 of the installation assembly 10 of the dispenser apparatus under a pulling of the frontmost detachable shoe cover 901 away from the subsequent detachable shoe cover 902.

In the step (b), the frontmost detachable shoe cover is opened by stretching the elastic element 96 provided around the opening edge portion 93 to open the opening 94 by means of the rear retaining arrangement 50 and the front retaining configuration 40 installed in the dispenser arrangement 101 of the installation assembly 10.

The step (c) further includes steps of:

(c-1) guiding the opening end portion of the frontmost detachable shoe cover 901 to be moved against the separator 30 (30A) until the opening end portion of the frontmost detachable shoe cover 901 is broken by the separator 30 (30A) to open the joint perforations 951, 952 to allow the frontmost detachable shoe cover 901 to detach from the installation assembly 10 of the dispenser apparatus; and (c-2) guiding the subsequent detachable shoe cover 902 to move to the dispenser arrangement 101 of the installation assembly 10 to become the current frontmost detachable shoe cover 901' while the previously frontmost detachable shoe cover 901 is moved to be detached from the dispenser arrangement 101 of the installation assembly 10, wherein the current frontmost detachable shoe cover 901' is opened by means of the rear retaining arrangement 50 and the front retaining configuration 40 installed in the dispenser arrangement 101 of the installation assembly 10 as in the step (b).

Therefore, the user may simply wear the frontmost detachable shoe cover 901 by placing his or her shoe therein and moves the shoe and then the frontmost detachable shoe cover 901 continuously moves frontwards with the shoe placed therein away from the installation assembly 10 will break the interconnection between the frontmost detachable shoe cover 901 and the installation arms 11, 12 and the subsequent detachable shoe cover 902 at the same time. In other words, no additional operation is required by the user. To the user, the dispensing operation is as simple as "step in" and "move out".

Further alternative modes of the detachable shoe cover 90 are disclosed in FIG. 32A to FIG. 36 to illustrate the interconnection arrangement 95 of the detachable shoe cover 90 according to the preferred embodiment can be performed in various modes while achieving the same objectives and advantages.

Referring to FIG. 32A to FIG. 32F, a fifth alternative mode of the detachable shoe cover 90E is illustrated, wherein the detachable shoe cover 90E also comprises a shoe cover main body 91 having a receiving cavity 92, an elastic opening edge portion 93 defining an opening 94, and an interconnection arrangement 95 for interconnecting the detachable shoe covers 90E to be installed in the dispenser apparatus. The interconnection arrangement 95 includes a front portion of the shoe cover main body 91, a rear portion of the shoe cover main body 91, two front joint perforations 951 provided in the front portion, and two rear joint perforations 952 provided in the rear portion, for interconnecting each of the plurality of detachable shoe covers 90E with another adjacent detachable shoe cover 90E of the plurality of detachable shoe covers 90E along the two installation arms 11, 12 so as to be installed in the dispenser apparatus.

The detachable shoe covers 90E of the sixth alternative mode further comprises a ring shape elastic element 96 provided around an opening edge 931 of the elastic opening edge portion 93 to provide an elastic effect for being stretched to open the opening 94 for wearing on a shoe of a user and to retracted to reduce a size of the opening 94 for holding on the shoe of the user, as shown in FIG. 3A.

Figure 32A:
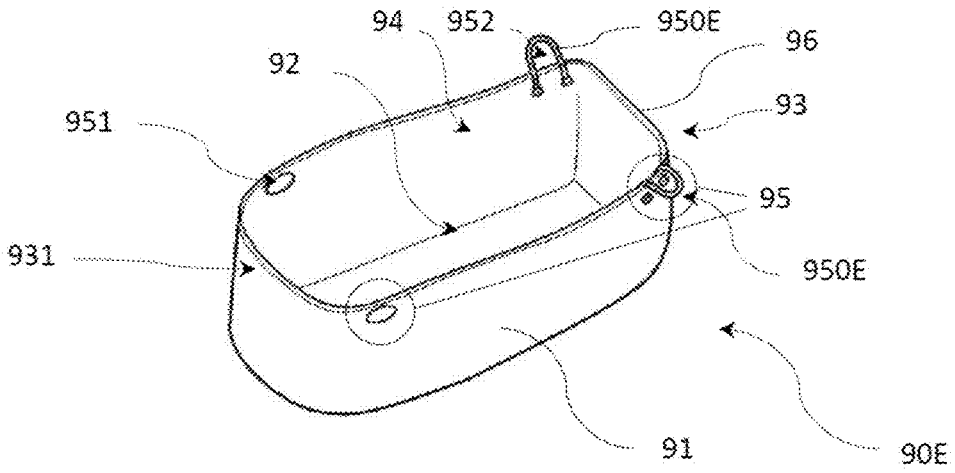
FIG. 32A is a schematic view of a fifth alternative mode of the detachable shoe cover according to the above preferred embodiment of the present invention.

According to the fifth alternative of the detachable shoe cover 90E, referring to the front joint perforations 951 are two holes symmetrically formed at two front sides of the front portion of the elastic opening edge portion 93 of the shoe cover main body 91 below the elastic element 96 and the two interconnection members 950 are two elongated strips (such as stings or the like) integrally connected to the rear portion of the elastic opening edge portion 93 of the shoe cover main body 91 symmetrically to form a pair of loops 950E extended upwardly, wherein two ends of each of the interconnection members 950 are connected to a position below the elastic element 96 so as to define the two rear joint perforations 952. As shown in FIG. 32A, the two ends of each of the two U-shape interconnection members 950 are affixed to the inner surface of the shoe cover main body 91.

Figure 32B:
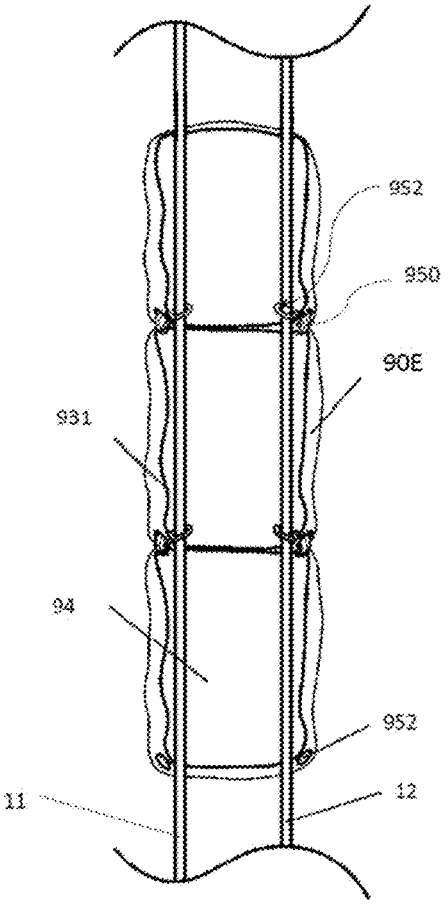
FIG. 32B is a schematic view illustrating the installation arrangement of the fifth alternative mode of the detachable shoe covers and the dispenser apparatus according to above preferred embodiment of the present invention.

Referring to FIG. 32B, to interconnecting the detachable shoe covers 90E one-by-one in series with the two installation arms 11, 12, similarly to the above detachable shoe cover 90, 90A, 90B, 90C, and 90D embodied in the present invention, the two interconnection members 950 of each of the detachable shoe covers 90 are penetrated through the two front joint perforations 951 of a subsequent detachable shoe cover 90 from an outer side to an inner side thereof respectively. Then, the two interconnection members 950 are hanged to the two installation arms 11, 12 respectively by penetrating the two installation arms 11, 12 through the two rear joint perforations 952 of the two interconnection members 950 respectively, such that the plurality of detachable shoe covers 90 are installed along the two installation arms 11, 12 of the installation assembly 10. For illustration purpose, the detachable shoe covers 90 are stretched to open state as shown in FIG. 32B to illustrate the interconnecting configuration between the interconnection members 950, the front and rear joint perforations 951, 952 and the two installation arms 11, 12. Normally, as shown in FIG. 1, the plurality of detachable shoe covers 90 installed in the installation arrangement 102 of the installation assembly 10 is stacked one-by-one in series along the two installation arms 11, 12 of the installation assembly 10 to maximize the storage capacity of the detachable shoe covers 90.

Figure 32C:
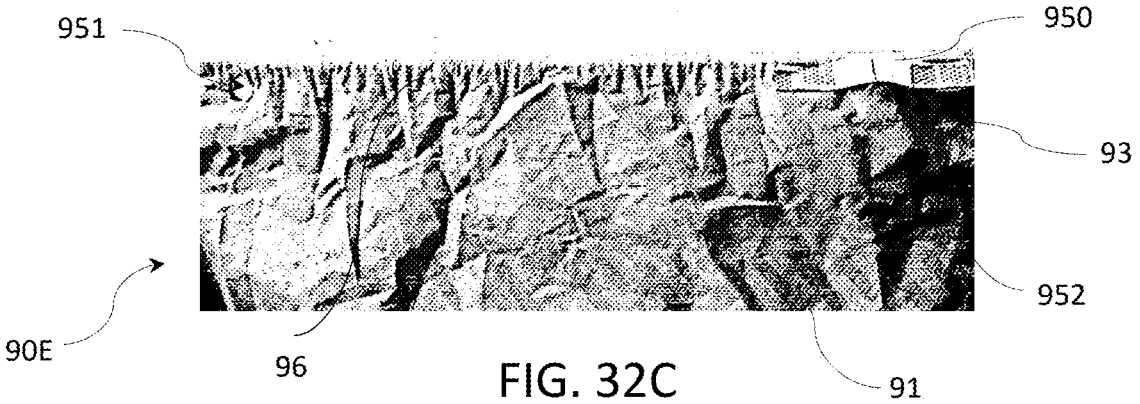
FIG. 32C is an enlarged view illustrating the interconnection arrangement of the fifth alternative mode of the detachable shoe cover while the elastic opening edge portion being stretched to the open state according to above preferred embodiment of the present invention.
Figure 32D:
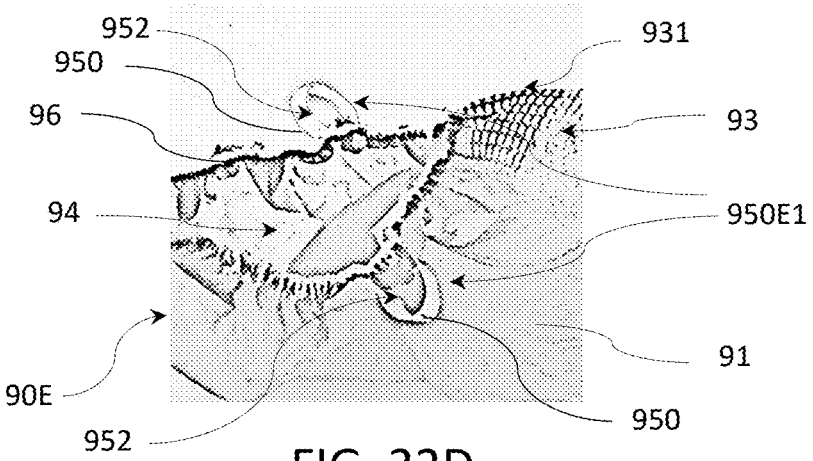
FIG. 32D is an enlarged view illustrating the interconnection member of the interconnection arrangement of the fifth alternative mode of the detachable shoe cover while the elastic opening edge portion is in the normal contract state according to the above preferred embodiment.
Figure 32E:
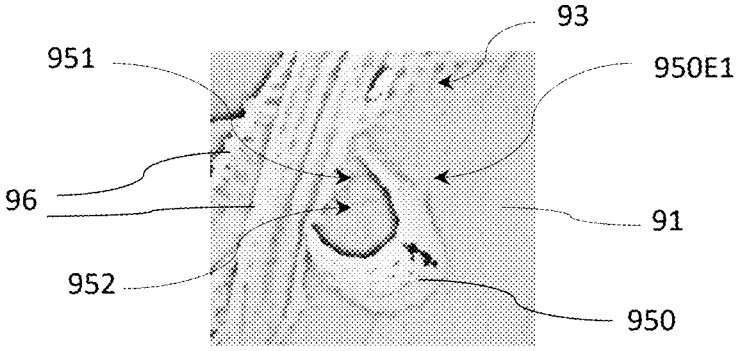
FIG. 32E is an enlarged view illustrating the interconnection of the interconnection member of one detachable shoe cover penetrating through the front joint perforation of a subsequent detachable shoe cover according to the fifth alternative mode of the detachable shoe cover according to the above preferred embodiment of the present invention.

As shown in FIG. 32C, the two interconnection members 950 can also be modified as being made of the same material of the shoe cover main body 91 and affixed to an outer surface of the shoe cover main body 91, as shown in FIGS. 32C-32E. In other words, the detachable shoe cover 90E comprises a pair of interconnection strips 950 each of which having two ends integrally connected to the outer surface of rear portion of the elastic opening edge portion 93 of the shoe cover main body 91 to form a strip loop 950E1 integrally provided horizontally at the rear portion of the elastic opening edge portion 93 of the shoe cover main body 91, as shown in FIG. 32D and FIG. 32E.

Figure 32F:
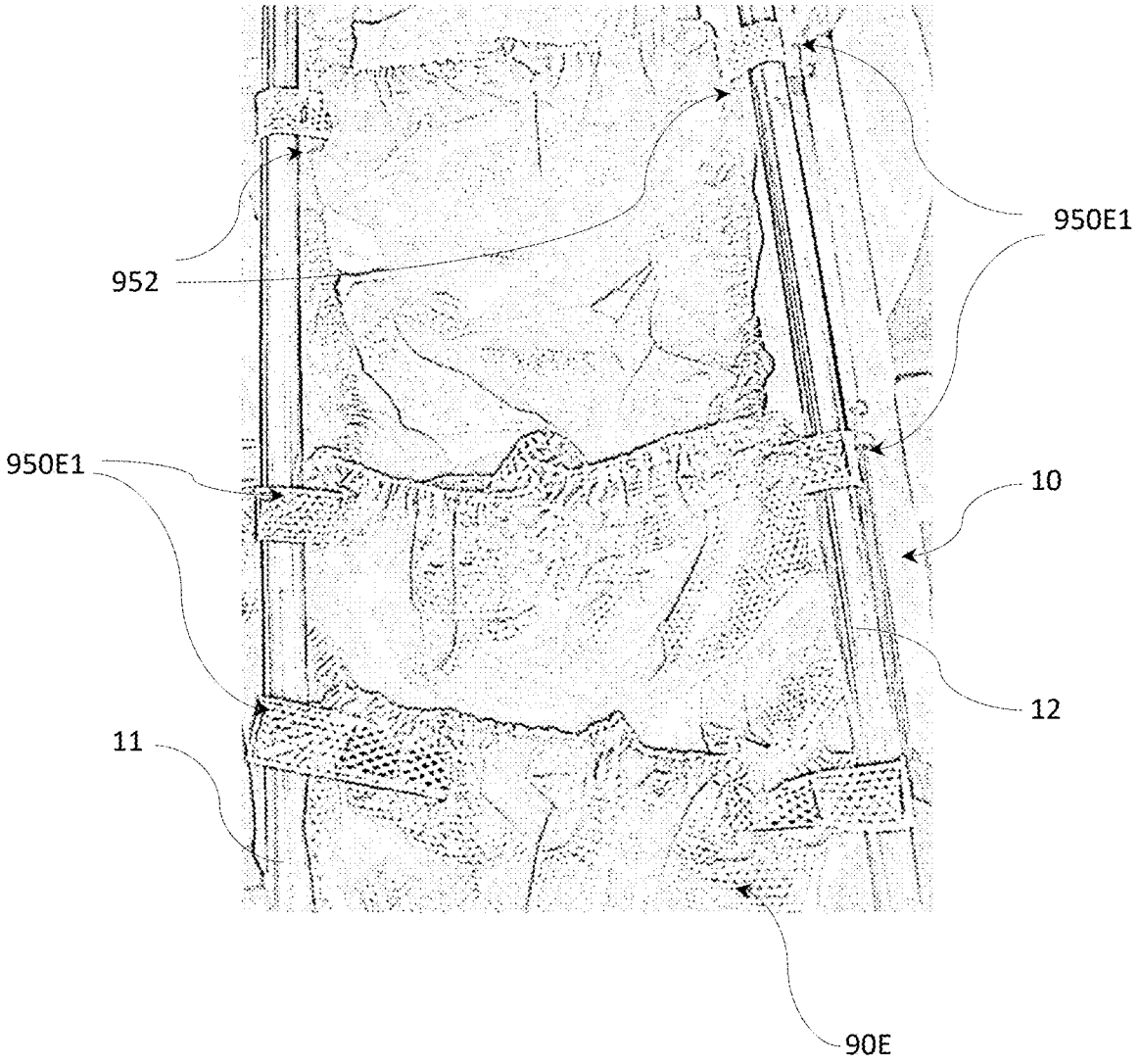
FIG. 32F is a schematic view illustrating the installation arrangement of the detachable shoe covers according to the fifth alternative mode installed along the installation arms of the dispenser apparatus according to above preferred embodiment of the present invention.

Referring to FIG. 32F, to interconnecting the modified detachable shoe covers 90E of the fifth alternative mode one-by-one in series with the two installation arms 11, 12, the two interconnection members 950E1 of each of the detachable shoe covers 90 are penetrated through the two front joint perforations 951 of a subsequent detachable shoe cover 90E from an outer side to an inner side thereof respectively. Then, the two interconnection members 950E1 are hanged to the two installation arms 11, 12 respectively by penetrating the two installation arms 11, 12 through the two rear joint perforations 952 of the two interconnection members 950E1 respectively, such that the plurality of detachable shoe covers 90 are installed along the two installation arms 11, 12 of the installation assembly 10. Normally, the plurality of detachable shoe covers 90E installed in the installation arrangement 102 of the installation assembly 10 is stacked one-by-one in series along the two installation arms 11, 12 of the installation assembly 10 to maximize the storage capacity of the detachable shoe covers 90E.

Referring to FIG. 33A to FIG. 33F, a sixth alternative mode of the detachable shoe cover 90F is illustrated, wherein the difference between this sixth alternative mode and the above fifth alternative mode is that each of the two interconnection members 950F of the interconnection arrangement 95 of the detachable shoe cover 90F is formed by two parallel cutting slits 950F1 provided horizontally in the rear portion of the elastic opening edge portion 93 of the shoe cover main body 91, and that the two front joint perforations 951 are formed by a pair of symmetrical cutting slit 951F1 provided on two sides of the front portion of the elastic opening edge portion 93 of the shoe cover main body 91. In other words, the two cutting slits 950F1 form the interconnection member 950F therebetween and define the rear joint perforation 952 therein.

Figure 33A:
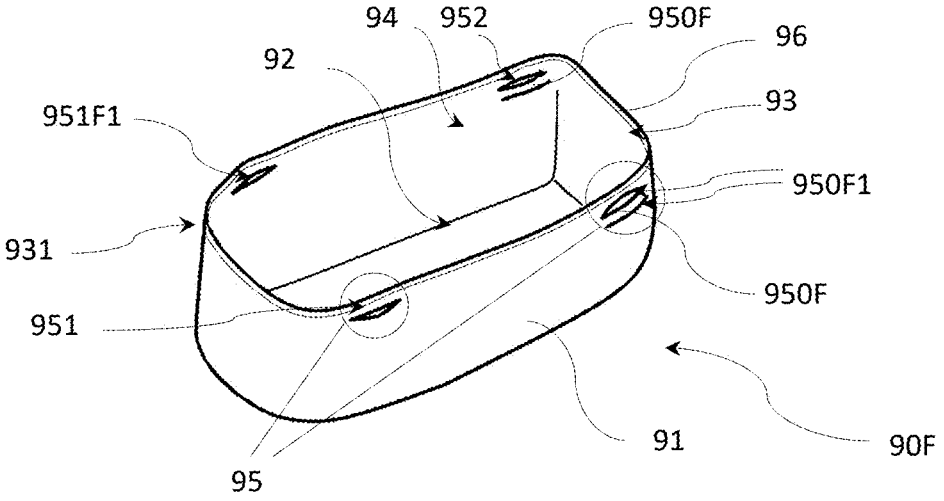
FIG. 33A is a schematic view of a sixth alternative mode of the detachable shoe cover according to the above preferred embodiment of the present invention.
Figure 33B:
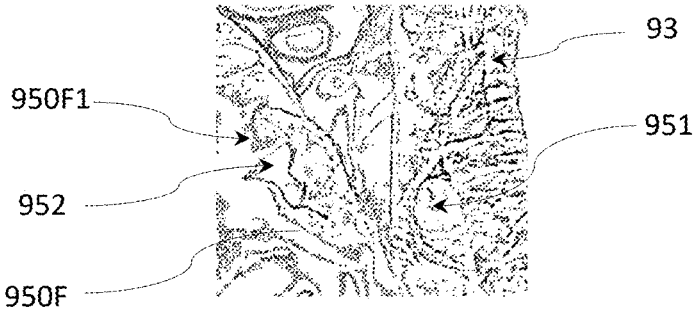
FIG. 33B is an enlarged view illustrating the interconnection arrangement of the sixth alternative mode of the detachable shoe cover according to the above preferred embodiment.
Figure 33C:
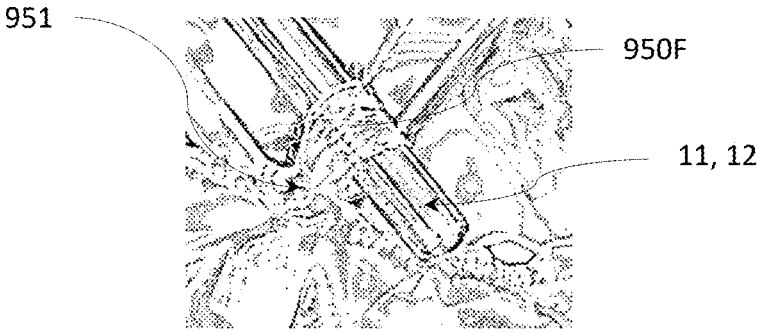
FIG. 33C is enlarged view illustrating the interconnection of the interconnection member of the detachable shoe cover according to the sixth alternative mode penetrating through the front joint perforation of a subsequent detachable shoe cover and hanging along the installation arm of the dispenser apparatus according to the above preferred embodiment of the present invention.
Figure 33D:
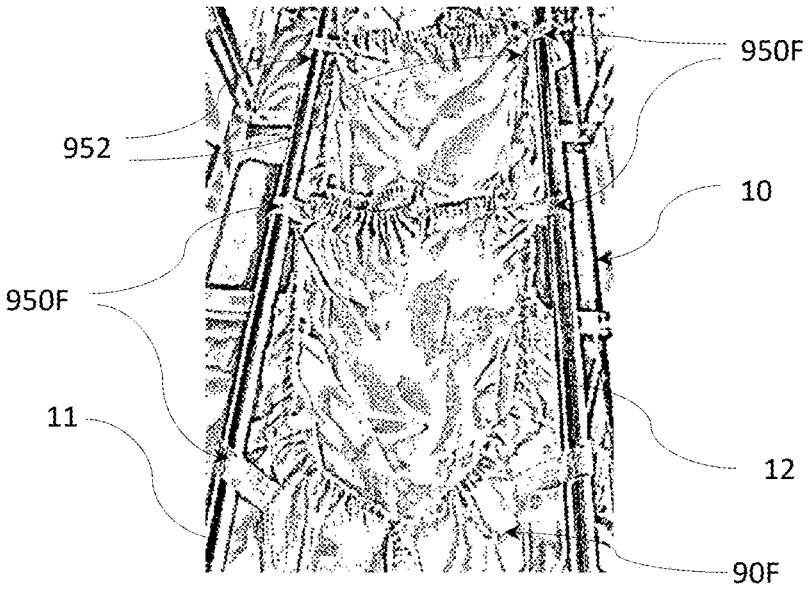
FIG. 33D is a schematic view illustrating the installation arrangement of the detachable shoe covers according to the sixth alternative mode installed along the installation arms of the dispenser apparatus according to above preferred embodiment of the present invention.

Referring to FIG. 33B to FIG. 33D, to interconnecting the detachable shoe covers 90F one-by-one in series with the two installation arms 11, 12, similarly to the above detachable shoe cover 90, 90A, 90B, 90C, 90D, and 90E embodied in the present invention, the two interconnection members 950F of each of the detachable shoe covers 90F are penetrated through the two front joint perforations 951 of a subsequent detachable shoe cover 90F from an outer side to an inner side thereof respectively. Then, the two interconnection members 950F are hanged to the two installation arms 11, 12 respectively by penetrating the two installation arms 11, 12 through the two rear joint perforations 952 of the two interconnection members 950F respectively, such that the plurality of detachable shoe covers 90F are installed along the two installation arms 11, 12 of the installation assembly 10. Similarly, the plurality of detachable shoe covers 90 installed in the installation arrangement 102 of the installation assembly 10 as illustrated in the FIG. 1 is stacked one-by-one in series along the two installation arms 11, 12 of the installation assembly 10 to maximize the storage capacity of the detachable shoe covers 90F.

Figure 33E:
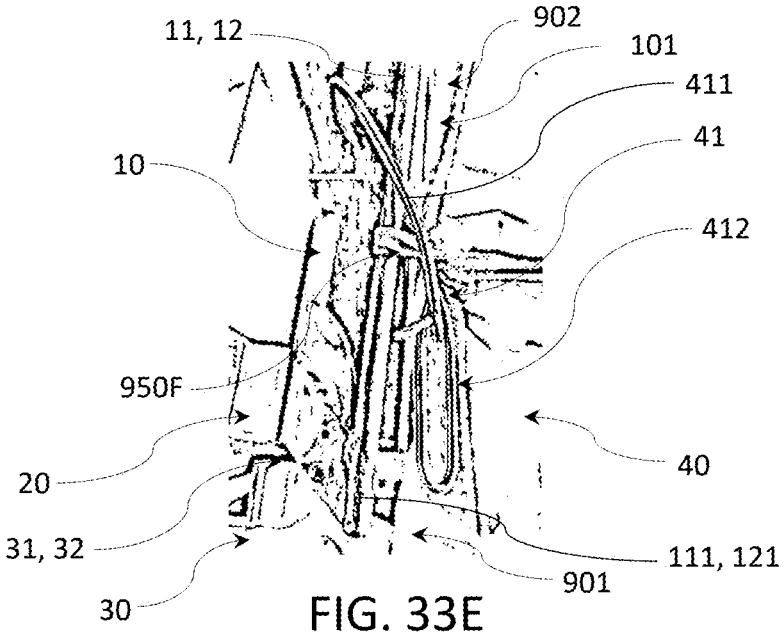
FIG. 33E is an enlarged view illustrating the interconnection arrangement of the sixth alternative mode of the detachable shoe cover moving toward the separator of the dispenser apparatus according to the above preferred embodiment of the present invention.
Figure 33F:
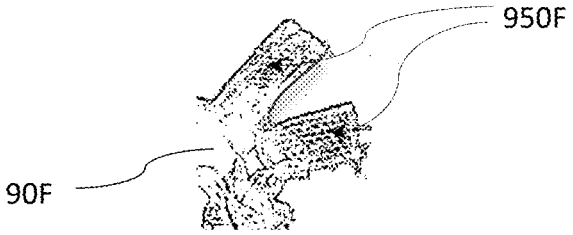
FIG. 33F is an enlarged view illustrating the interconnection member of the detachable shoe cover according to the sixth alternative mode being separated by the separator of the dispenser apparatus according to the preferred embodiment of the present invention.

In addition, as shown in FIG. 33E a practical embodiment of the separator 30 and the front retaining configuration 40 of the installation assembly 10 is illustrated, wherein the supporter 41 of the front retaining configuration 40 is curvedly extended from the frame 20 to be positioned behind the separator 30 and extended across the installation arm 11, 12 and the retaining bar 412, embodied to have a ring shape, of the front retaining configuration 40 is downwardly extended from a free end of the supporter 411 to extend into the receiving cavity 92 of the frontmost detachable shoe cover 901 to limit the front portion of the stretched out frontmost detachable shoe cover 901 from re-stretching back to the installation arrangement 102, so as to retain the frontmost detachable shoe cover 901 in the open state with the rear retaining configuration in the dispenser arrangement 101. In addition, the resistant separating member 31, 32 of the separator 30 is provided at the front end portion 111, 121 of the installation arm 11, 12, such that the resistant separating member 31, 32 is configured to break the interconnection member 950F hanged to the respective installation arm 11, 12 (as shown in FIG. 33F), while the frontmost detachable shoe cover 901 is pulled to move out frontwardly from the installation arm 11, 12, wherein the two separating members 31, 32 are positioned that each of the interconnection members 950F of the pulling out frontmost detachable shoe cover 901 would come across the respective separating member 31, 32 and the continuously frontward moving of the frontmost detachable shoe cover 901 would apply a shearing force to each of the interconnection members 950F against the respective separating member 31, 32 until the two interconnection members 950F are broken apart so as to allow the frontmost detachable shoe cover 901 detaching from the installation assembly 10 of the dispenser apparatus.

FIG. 34A illustrates a modification of the above fifth alternative mode of the detachable shoe cover 90E', wherein the two front joint perforations 951 are also formed by another pair of interconnection members 950E each of which is integrally connected to the front portion of the elastic opening edge portion 93 of the shoe cover main body 91 to define the respective front joint perforation 951 therein.

FIG. 34B illustrates a modification of the above sixth alternative mode of the detachable shoe cover 90F', wherein the two front joint perforations 951 are also formed by another pair of interconnection members 950F each of which is formed by two cutting slits 950F1 in the front portion of the elastic opening edge portion 93 of the shoe cover main body 91 to define the respective front joint perforation 951 therein.

Referring to FIG. 35A to FIG. 35F, a seventh alternative mode of the detachable shoe cover 90G is illustrated, wherein the detachable shoe cover 90G according to the seventh alternative mode is an alternative mode of the above fifth alternative mode and the difference is the interconnection members 950G each of which is made of fabric material and has two ends overlappedly affixed to the outer surface of the rear portion of the elastic opening edge portion 93 to form a strip loop extended upwardly from the elastic opening edge portion 93 of the shoe cover main body 91.

Figure 35A:
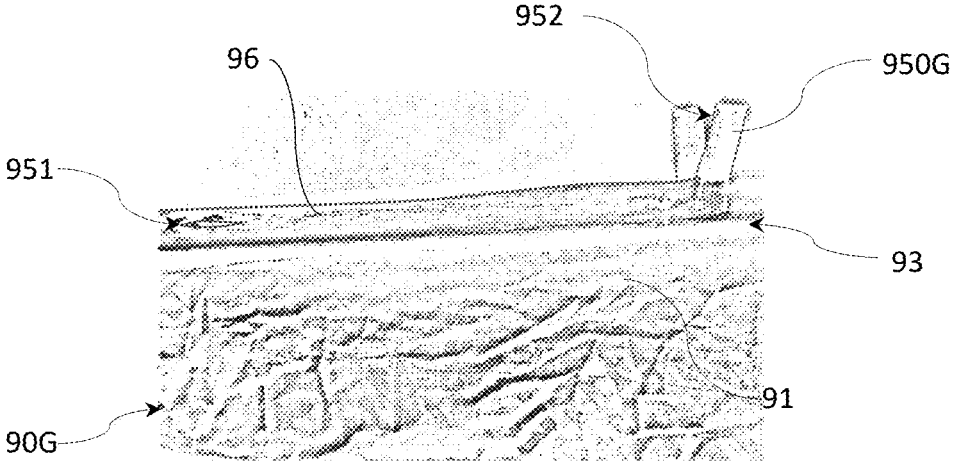
FIG. 35A is a schematic view illustrating the interconnection arrangement of a seventh alternative mode of the detachable shoe cover according to the above preferred embodiment of the present invention.
Figure 35B:
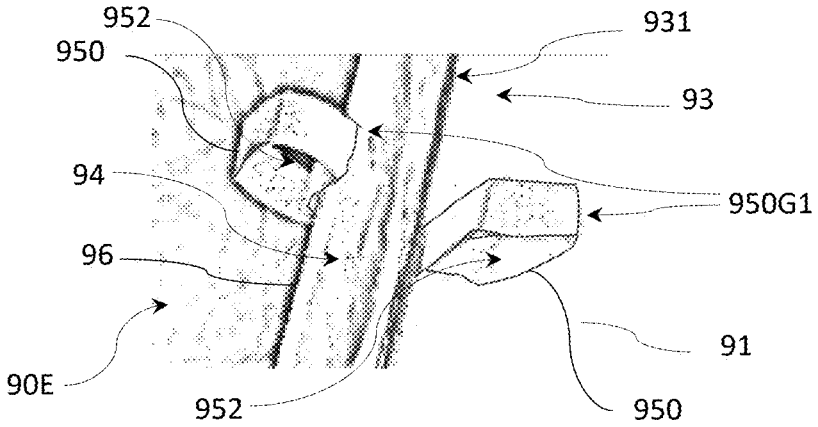
FIG. 35B is an enlarged view illustrating the interconnection member of the seventh alternative mode of the detachable shoe cover according to the above preferred embodiment of the present invention.

The detachable shoe covers 90G of the seventh alternative mode also comprises a ring shape elastic element 96 provided around an opening edge 931 of the elastic opening edge portion 93 to provide an elastic effect for being stretched to open the opening 94 for wearing on a shoe of a user and to retracted to reduce a size of the opening 94 for holding on the shoe of the user, as shown in FIG. 35B. Also, according to the seventh alternative of the detachable shoe cover 90G, referring to the front joint perforations 951 are two holes symmetrically formed at two front sides of the front portion of the elastic opening edge portion 93 of the shoe cover main body 91 below the elastic element 96 and the two upwardly extended interconnection members 950G.

Figure 35C:
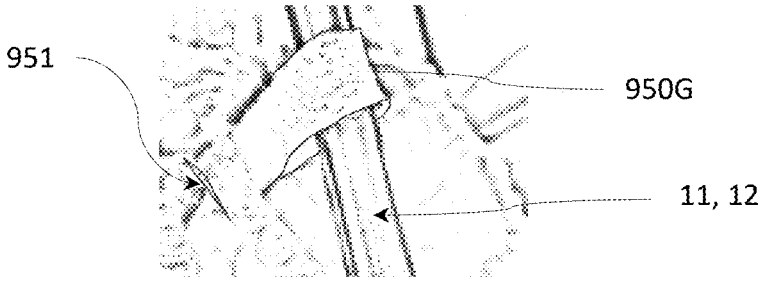
FIG. 35C is enlarged view illustrating the interconnection of the interconnection member of the detachable shoe cover according to the seventh alternative mode penetrating through the front joint perforation of a subsequent detachable shoe cover and hanging along the installation arm of the dispenser apparatus according to the above preferred embodiment of the present invention.
Figure 35D:
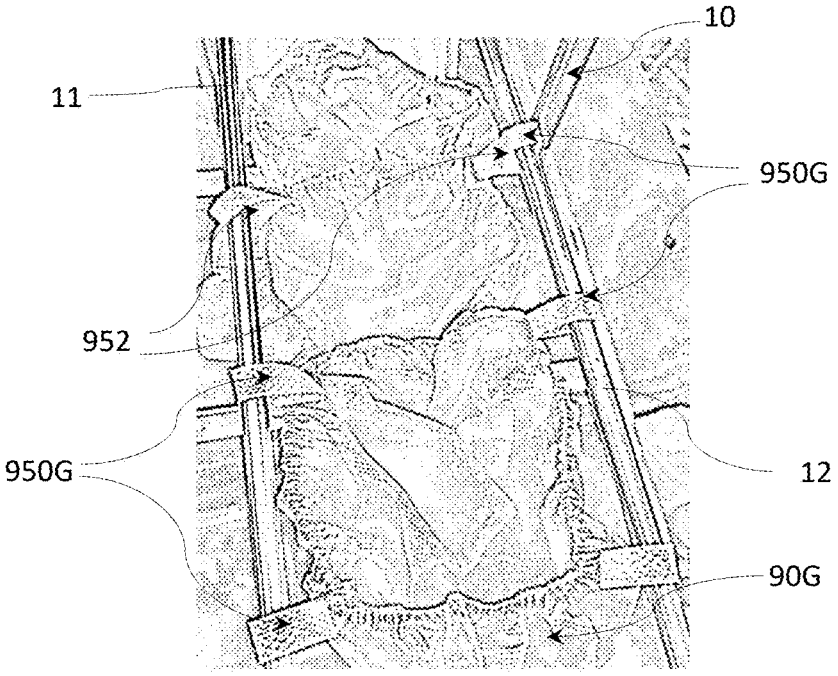
FIG. 35D is a schematic view illustrating the installation arrangement of the detachable shoe covers according to the seventh alternative mode installed along the installation arms of the dispenser apparatus according to above preferred embodiment of the present invention.

Referring to FIG. 35C and FIG. 35D, similarly, to interconnecting the detachable shoe covers 90G one-by-one in series with the two installation arms 11, 12, similarly to the above detachable shoe cover 90-90F embodied in the present invention, the two interconnection members 950G of each of the detachable shoe covers 90G are penetrated through the two front joint perforations 951 of a subsequent detachable shoe cover 90G from an outer side to an inner side thereof respectively. Then, the two interconnection members 950G are hanged to the two installation arms 11, 12 respectively by penetrating the two installation arms 11, 12 through the two rear joint perforations 952 of the two interconnection members 950 respectively, such that the plurality of detachable shoe covers 90G are installed along the two installation arms 11, 12 of the installation assembly 10.

Figure 35E:
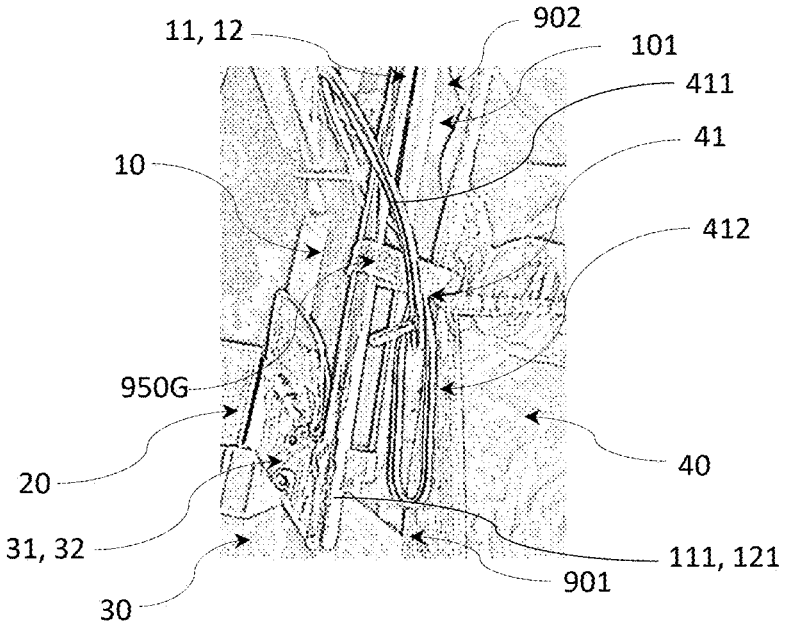
FIG. 35E is an enlarged view illustrating the interconnection arrangement of the seventh alternative mode of the detachable shoe cover moving toward the separator of the dispenser apparatus according to the above preferred embodiment of the present invention.
Figure 35F:
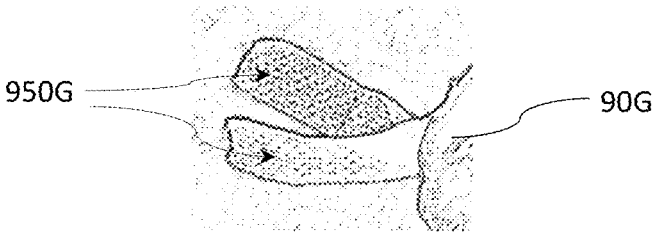
FIG. 35F is an enlarged view illustrating the interconnection member of the detachable shoe cover according to the seventh alternative mode being separated by the separator of the dispenser apparatus according to the preferred embodiment of the present invention.

As shown in FIG. 35E, a practical embodiment of the separator 30 and the front retaining configuration 40 of the installation assembly 10 is illustrated. Like that of the sixth alternative mode, wherein the supporter 41 of the front retaining configuration 40 is curvedly extended from the frame 20 to be positioned behind the separator 30 and extended across the installation arm 11, 12 and the retaining bar 412, embodied to have a ring shape, of the front retaining configuration 40 is downwardly extended from a free end of the supporter 411 to extend into the receiving cavity 92 of the frontmost detachable shoe cover 901 to limit the front portion of the stretched out frontmost detachable shoe cover 901 from re-stretching back to the installation arrangement 102, so as to retain the frontmost detachable shoe cover 901 in the open state with the rear retaining configuration in the dispenser arrangement 101. The resistant separating member 31, 32 of the separator 30 is provided at the front end portion 111, 121 of the installation arm 11, 12, such that the resistant separating member 31, 32 is configured to break the interconnection member 950F hanged to the respective installation arm 11, 12 (as shown in FIG. 35F), while the frontmost detachable shoe cover 901 is pulled to move out frontwardly from the installation arm 11, 12, wherein the two separating members 31, 32 are positioned that each of the interconnection members 950G of the pulling out frontmost detachable shoe cover 901 would come across the respective separating member 31, 32 and the continuously frontward moving of the frontmost detachable shoe cover 901 would apply a shearing force to each of the interconnection members 950G against the respective separating member 31, 32 until the two interconnection members 950G are broken apart so as to allow the frontmost detachable shoe cover 901 detaching from the installation assembly 10 of the dispenser apparatus.

Figure 36:
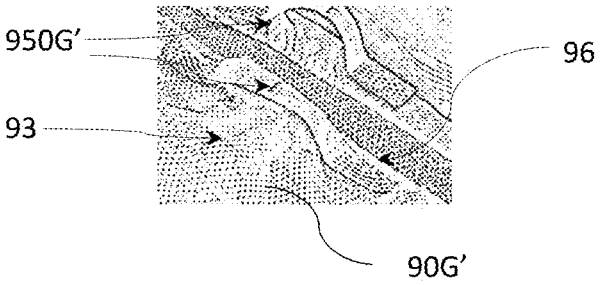
FIG. 36 is a schematic view illustrating a modification of the above seventh alternative mode of the detachable shoe cover according to the above preferred embodiment of the present invention.

FIG. 36 illustrates a modification of the above seventh alternative mode of the detachable shoe cover 90G', wherein each of the fabric made interconnection members 950G' is integrally connected to the outer surface of the elastic opening edge portion 93 of the shoe cover main body 91 horizontally below and parallel to the elastic element 96.

Various embodying modes of the detachable shoe cover 90~90G' are disclosed to demonstrate that the front and rear joint perforations 951, 952 of the interconnection arrangement 95 of the detachable shoe cover 90 are able to be embodied various equivalent modes to achieve the advantages and objectives of the present invention, wherein the general principles defined would be applied to other embodiments, alternatives, modifications, equivalents, and applications without departing from the spirit and scope of interconnection arrangement 95 of the detachable shoe cover 90 of the present invention.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention comprises all modifications encompassed within the spirit and scope of the following claims.

What is claimed is:

1. A detachable shoe cover assembly, adapted for being stored and dispensed by a dispenser apparatus which comprises two installation arms, comprising two or more detachable shoe covers, each of the two or more detachable shoe covers comprising:

a shoe cover main body having a receiving cavity;

an elastic opening edge portion defining an opening provided around a top edge portion of the shoe cover main body; and an interconnection arrangement including a front portion of the shoe cover main body, a rear portion of the shoe cover main body, two front joint perforations provided in the front portion, two U-shape interconnection members integrally connected to the rear portion of the elastic opening edge portion of the shoe cover main body, and two rear joint perforations provided in the two interconnection members connected to the rear portion, wherein the two front joint perforations are symmetrically formed at the front portion of the elastic opening edge portion below the top edge portion of the shoe cover main body wherein the two U-shape interconnection members are integrally connected to the rear portion of the elastic opening edge portion of the shoe cover main body symmetrically to form a pair of loops extended upwardly and two ends of each of the interconnection members are connected to a position below the top edge portion to define the rear joint perforation thereof;

wherein the two rear joint perforations of each of the two or more detachable shoe covers is configured to be aligned with the two front joint perforations of a subsequent detachable shoe cover of the two or more detachable shoe covers stored in the dispenser apparatus while allowing the two installation arms to penetrate through respectively so as to interconnect each of the two detachable shoe covers with the adjacent detachable shoe cover of the two or more detachable shoe covers along the two installation arms of the dispenser apparatus, such that by opening a frontmost detachable shoe cover of the two or more detachable shoe covers at the dispenser apparatus for wearing the frontmost detachable shoe cover on a shoe of a user and separating the frontmost detachable shoe cover from the subsequent detachable shoe cover of the two or more detachable shoe covers under a pulling of the frontmost detachable shoe cover away from the subsequent detachable shoe cover, the frontmost detachable shoe cover is detached from the subsequent detachable shoe cover and the two installation arms of the dispenser apparatus.

2. The detachable shoe cover assembly, as recited in claim 1, further comprising an elastic element provided around an opening edge of the elastic opening edge portion each of the two or more detachable shoe covers to provide an elastic effect for being stretched to open the opening for wearing on the shoe of the user and to retract to reduce a size of the opening for holding on the shoe, wherein the two front joint perforations are formed below the elastic element and the two ends of each of the interconnection are connected to the position below the elastic element.

3. The detachable shoe cover assembly, as recited in claim 2, wherein the two front joint perforations are two symmetrical holes respectively formed in two sides of the front portion and positioned below the elastic element.

4. The detachable shoe cover assembly, as recited in claim 3, wherein the two interconnection members are configured to penetrate through the two front joint perforations of the adjacent detachable shoe cover while the two installation arms penetrate through the two rear joint perforations respectively so as to be able to interconnect each of the two or more detachable shoe covers with the subsequent detachable shoe cover of the two or more detachable shoe covers along the two installation arms of the dispenser apparatus.

5. The detachable shoe cover assembly, as recited in claim 4, wherein the two interconnection members of each of the two or more detachable shoe covers are two connecting strips each having the two ends affixed to the rear portion to form the loop extended upwardly and defining the rear joint perforation.

6. The detachable shoe cover assembly, as recited in claim 3, The detachable shoe cover assembly, as recited in claim 1, wherein the interconnection arrangement of each of the two or more detachable shoe covers comprises two front interconnection members integrally connected to the front portion to form the two front joint perforations, wherein the two front joint perforations are formed in the two front interconnection members respectively and the two rear joint perforations are formed in the two rear interconnection members respectively, such that the two rear interconnection members of each of the two or more detachable shoe cover are configured to penetrate through the two front joint perforations of two front interconnection members the adjacent detachable shoe cover while the two installation arms penetrate through the two rear joint perforations of the two rear interconnection members respectively so as to interconnect each of the two or more detachable shoe covers with the subsequent detachable shoe cover of the two or more detachable shoe covers along the two installation arms of the dispenser apparatus.

7. The detachable shoe cover assembly, as recited in claim 1, wherein the two front joint perforations are two symmetrical holes respectively formed in two sides of the front portion of the shoe cover main body.

8. The detachable shoe cover assembly, as recited in claim 1, wherein the two interconnection members are configured to penetrate through the two front joint perforations of the adjacent detachable shoe cover while the two installation arms penetrate through the two rear joint perforations respectively so as to be able to interconnect each of the two or more detachable shoe covers with the subsequent detachable shoe cover of the two or more detachable shoe covers along the two installation arms of the dispenser apparatus.

9. The detachable shoe cover assembly, as recited in claim 8, wherein the two interconnection members of each of the two or more detachable shoe covers are two connecting strips each having the two ends affixed to the rear portion to form the loop extended upwardly and defining the rear joint perforation.

10. The detachable shoe cover assembly, as recited in claim 1, wherein the interconnection arrangement of each of the two or more detachable shoe covers comprises two front interconnection members integrally connected to the front portion to form the two front joint perforations, wherein the two front joint perforations are formed in the two front interconnection members respectively and the two rear joint perforations are formed in the two rear interconnection members respectively, such that the two rear interconnection members of each of the two or more detachable shoe cover are configured to penetrate through the two front joint perforations of two front interconnection members the adjacent detachable shoe cover while the two installation arms penetrate through the two rear joint perforations of the two rear interconnection members respectively so as to interconnect each of the two or more detachable shoe covers with the subsequent detachable shoe cover of the two or more detachable shoe covers along the two installation arms of the dispenser apparatus.

11. The detachable shoe cover assembly, as recited in claim 1, wherein the two front joint perforations of the two or more detachable shoe covers are two symmetrical slits respectively formed in two sides of the front portion.

* * * * *